US012492452B2

(12) United States Patent
Jankowski

(10) Patent No.: US 12,492,452 B2
(45) Date of Patent: Dec. 9, 2025

(54) NICKEL-BASE ALLOYS

(71) Applicant: ATI Properties LLC, Albany, OR (US)

(72) Inventor: Joseph A. Jankowski, Matthews, NC (US)

(73) Assignee: ATI PROPERTIES LLC, Albany, OR (US)

( * ) Notice: Subject to any disclaimer, the term of this patent is extended or adjusted under 35 U.S.C. 154(b) by 0 days.

(21) Appl. No.: 17/751,919

(22) Filed: May 24, 2022

(65) Prior Publication Data

US 2023/0025204 A1 Jan. 26, 2023

Related U.S. Application Data

(60) Provisional application No. 63/220,057, filed on Jul. 9, 2021.

(51) Int. Cl.
*C22C 19/05* (2006.01)

(52) U.S. Cl.
CPC ..... *C22C 19/056* (2013.01); *C22C 19/055* (2013.01)

(58) Field of Classification Search
None
See application file for complete search history.

(56) References Cited

U.S. PATENT DOCUMENTS 2,747,993 A 5/1956 Johnson
2,945,758 A 7/1960 Jahnke et al.
3,222,165 A 12/1965 Bird et al.
3,248,213 A 4/1966 Smith et al.
3,356,542 A 12/1967 Smith
3,385,698 A 5/1968 MacFarlane et al.
3,576,622 A 4/1971 McCoy
4,589,937 A * 5/1986 Jackson ..... C30B 21/02 148/404
4,765,956 A * 8/1988 Smith ..... F28F 21/087 420/586
4,769,087 A * 9/1988 Genereux ..... C22F 1/10 72/364
4,818,486 A 4/1989 Rothman et al.
5,476,555 A 12/1995 Erickson
5,882,586 A 3/1999 Tamura et al.
6,177,046 B1 1/2001 Simkovich et al.
6,458,318 B1 * 10/2002 Nishiyama ..... C22C 19/055 420/447

(Continued)

FOREIGN PATENT DOCUMENTS

CN 112779440 A 5/2021
CN 112981186 A 6/2021

(Continued)

OTHER PUBLICATIONS

Murray et al. "Preparation and Characterization of Pure Metals. "ASM Handbook, vol. 2: Properties and Selection: Nonferrous Alloys and Special-Purpose Materials. ASM Handbook Committee, p. 1093-1097. 1990. (Year: 1990).*

(Continued)

*Primary Examiner* — Brian D Walck
(74) *Attorney, Agent, or Firm* — K&L Gates LLP

(57) ABSTRACT

A nickel-base alloy comprises, in weight percentages based on the total weight of the nickel-base alloy: 1.6% to 3.0% aluminum; 0.3% to 1.5% titanium; 1.5% to 4% tantalum; and nickel.

27 Claims, 30 Drawing Sheets

(56) References Cited

U.S. PATENT DOCUMENTS

| | | | | |
|---|---|---|---|---|
| 6,478,897 | B1 * | 11/2002 | Izumida | C22C 19/057 148/908 |
| 6,491,769 | B1 | 12/2002 | Smith et al. | |
| 8,066,938 | B2 | 11/2011 | Pike, Jr. | |
| 8,545,643 | B2 | 10/2013 | Pike et al. | |
| 9,738,953 | B2 | 8/2017 | Osaki et al. | |
| 9,828,657 | B2 | 11/2017 | Abe et al. | |
| 9,932,655 | B2 | 4/2018 | Hamaguchi et al. | |
| 10,280,498 | B2 | 5/2019 | Heck et al. | |
| 10,358,699 | B2 | 7/2019 | Srivastava et al. | |
| 11,186,898 | B2 | 11/2021 | Meck et al. | |
| 2003/0034098 | A1 * | 2/2003 | Henry | C22C 19/056 148/556 |
| 2010/0008778 | A1 * | 1/2010 | Patrick | F01D 5/26 416/144 |
| 2011/0274579 | A1 * | 11/2011 | Arjakine | C22C 19/056 420/586 |
| 2014/0314618 | A1 | 10/2014 | Feng et al. | |
| 2018/0223395 | A1 * | 8/2018 | Mourer | F01D 25/005 |
| 2019/0048451 | A1 * | 2/2019 | Ota | B22F 9/082 |
| 2020/0131614 | A1 | 4/2020 | Ota et al. | |
| 2024/0117472 | A1 | 4/2024 | Sharghi-Moshtaghin et al. | |

FOREIGN PATENT DOCUMENTS

| | | | |
|---|---|---|---|
| DE | 69605259 | T2 | 7/2000 |
| EP | 1842934 | B1 | 10/2011 |
| GB | 810089 | A | 3/1959 |
| GB | 1029609 | A | 5/1966 |
| IN | 105112728 | B | 3/2017 |
| JP | 1-129942 | A | 5/1989 |
| JP | 6-172900 | A | 6/1994 |
| JP | 5127749 | B2 | 1/2013 |
| WO | 2006059805 | A1 | 6/2006 |
| WO | 2019021015 | A1 | 1/2019 |
| WO | 2019/125637 | A2 | 6/2019 |
| WO | 2020203460 | A1 | 10/2020 |

OTHER PUBLICATIONS

Haynes® 282@ alloy brochure, Principal Features, 2019 Haynes International, 25 pages, https://www.haynesintl.com/docs/default-source/pdfs/new-alloy-brochures/high-temperature-alloys/brochures/282-brochure.pdf?sfvrsn=20.

Inconel® Alloy 740H® brochure, PCC EnergyGroup, May 13, 2015, 24 pages, https://www.specialmetals.com/documents/technical-bulletins/inconel/inconel-alloy-740h.pdf.

VDM® Alloy C-264, Material Data Sheet No. 4120, Jul. 2020, VDM Metals International GmbH, 9 pages,https://www.vdm-metals.com/fileadmin/user_upload/Downloads/Data_Sheets/Data_Sheet_C_264_EN.pdf.

Haynes® 263 alloy brochure, 2020 Haynes International, Jun. 12, 2020, 10 pages, http://haynesintl.com/docs/default-source/pdfs/new-alloy-brochures/high-temperature-alloys/263-brochure.pdf?sfvrsn=10.

Haynes® R-41 alloy brochure, 2019 Haynes International, Jun. 16, 2020, 9 pages, http://haynesintl.com/docs/default-source/pdfs/new-alloy-brochures/high-temperature-alloys/r-41-brochure.pdf?sfvrsn=4.

Haynes® Waspaloy alloy brochure, 2020 Haynes International, Jun. 16, 2020, 7 pages, https://www.haynesintl.com/docs/default-source/pdfs/new-alloy-brochures/high-temperature-alloys/brochures/waspaloy.pdf?sfvrsn=10.

Vamsi et al., "Effect of off-stoichiometry and ternary additions on planar fault energies in Ni3Al," Superalloys 2012, 12th International Symposium on Superalloys, The Minerals, Metals & Materials Society, 2012, pp. 521-530.

Crudden et al., "Modelling of the influence of alloy composition on flow stress in high-strength nickel-based superalloys," Acta Materialia 75, 2014, pp. 356-370.

Alman et al., "Low coefficient of thermal expansion (CTE) nickel base superalloys for interconnect applications in intermediate temperature solid oxide fuel cells (SOFC)," Superalloys 2004, The Minerals, Metals & Materials Society, pp. 617-622.

Roth et al., "Modeling solid solution strengthening in nickel alloys," Metallurgical and Materials Transactions A, vol. 28A, Jun. 1997, pp. 1329-1335.

Li et al., "Influence of the initial cooling rate from γ' supersolvus temperatures on microstructure and phase compositions in a nickel superalloy," Journal of Alloys and Compounds, 732, 2018, pp. 765-776.

Karunaratne et al., "Interdiffusion in the face-centred cubic phase of the Ni—Re, Ni—Ta, and Ni—W systems between 900 and 1300° C.," Materials Science and Engineering A281, 2000, pp. 229-233.

Maurer et al., "Role of Cobalt in Waspaloy," Superalloys, 1980, pp. 43-52.

Mishima et al., "Lattice Parameters of Ni(γ), Ni3AI(γ') and Ni3Ga (γ') solid solutions with additions of transition and B-subgroup elements," Acta Metallurgica, vol. 33, No. 6, 1985, pp. 1161-1169.

Pataky et al., "Creep Deformation and mechanisms in Haynes 230 at 800° C. and 900° C.," Journal of Nuclear Materials, 443, 2013, pp. 484-490.

Barrows et al., "A Modified System for predicting σ Formation," Metallurgical Transaction, 3, 1972, pp. 2889-2893.

Siefert et al., "Weldability and weld performance of candidate nickel based superalloys for advanced ultrasupercritical fossil power plants, Part II: weldability and cross-weld creep performance," Science and Technology of Welding and Joining, 2016, pp. 1-31.

Stellar ABD®-900AM, Powder for Additive Manufacturing, Aubert & Duval, Oct. 20, 2023, www.aubertduval.com, 4 pages.

ABD® 900AM, Nickel based superalloy for additive manufacturing, OXMET Technologies, Nov. 2019, 2 pages.

Tang et al., Alloys-by-design: Application to new superalloys for additive manufacturing, Acta Materialia 202 (2021) pp. 417-436.

Waspaloy (UNS N07001), Metals & Alloys in the Unified Numbering System, 13th Edition, SAE HS-1086/2017 ASTM DS56L, 2017, p. 244.

Haynes® 242® alloy, Principal Features, Excellent High-Temperature Strength, Low Thermal Expansion Characteristics, and Good Oxidation Resistance, H-3079G, 2017 Haynes International, 18 pages.

Haynes® 242® Alloy, H-3230a, 2020 Haynes International, 17 pages.

Lu et al., Low temperature physical properties of a Ni—Mo—Cr alloy Haynes® 242™, Journal of Applied Physics 101, Jun. 25, 2007, pp. 123710-1-123710-6.

Fahrmann et al., Development of a New 760 (1400° F.) Capable Low Thermal Expansion Alloy, Superalloys 2012: 12th International Symposium on Superalloys, eds. Huron et al., The Minerals, Metals & Materials Society, 2012, pp. 769-777.

Verma et al., Lattice parameter variation and its effect on precipitation behaviour of ordered Ni2(Cr, Mo) phase in Ni—Cr—Mo alloys. Journal of Alloys and Compounds, Elsevier B.V., Jan. 15, 2020, vol. 813, 11 pages.

Tanner, L.E., The Ordering Transformation in Ni2V, Acta Metallurgiva, vol. 20, Oct. 1972, pp. 1197-1227.

Hu et al., First principles investigation on the stability and elastic properties of Ni2Cr1-xMx (M=Nb, Mo, Ta, and W) superlattices, Intermetallics vol. 33, 2013, pp. 60-66.

Srivastava et al., A New Low-Thermal-Expansion, High-Strength Alloy for Gas Turbines, Gas Turbine and Aeroengine Congress and Exposition, Jun. 4-8, 1989, 8 pages.

Srivastava, S. K., A Low-Thermal Expansion, High Strength Ni—Mo—Cr Alloy, Superalloys, The Minerals, Metals & Materials Society, 1992, pp. 227-236.

Mann et al., Ab-initio investigation of planar defects in Immm-Ni2(Cr, Mo, W) strengthened Haynes 244 alloy, Purdue University, 2021, 30 pages.

He et al., Mechanical properties of an aged Ni—Cr—Mo alloy and effect of long-range order phase on deformation behavior, Materials Science & Engineering, A, 731, 2018, pp. 29-35.

Lu et al., Strengthening domains in a Ni—21Cr—17Mo alloy, Scripta Materialia, ScienceDirect, 56, 2007, pp. 121-124.

(56) References Cited

OTHER PUBLICATIONS

Miller et al., Microstructural characterization of Haynes® 242™ alloy, Materials Science & Engineering A 327, 2002, pp. 89-93.
Cowen et al., Elevated Temperature Mechanical Behavior of New Low CTE Superalloys, Superalloys, The Minerals, Metals & Materials Society, 2008, pp. 201-207.
Special Metals, Incoloy®, alloy 909 (UNS N19909), SMC-077, Sep. 2004, 8 pages.
Special Metals, Incoloy®, alloy 903 (UNS N19903), SMC-100, Sep. 2004, 4 pages.
Special Metals, Incoloy®, alloy 783 (UNS R30783), SMC-064, Dec. 2004, 8 pages.
Haynes® 242® alloy, Principal Features, Excellent High-Temperature Strength, Low Thermal Expansion Characteristics, and Good Oxidation Resistance, H-3079H, 2020 Haynes International, 20 pages.
UNS N19909, Nickel and Nickel Alloys, Metals & Alloys in the Unified Numbering System, 13th Edition, SAR HS-1086, ASTM DS56L, SAE International ASTM International, 2017, p. 253.

* cited by examiner

NICKEL-BASE ALLOYS

CROSS-REFERENCE TO RELATED APPLICATION

The present application claims priority to U.S. provisional patent application Ser. No. 63/220,057, filed on Jul. 9, 2021, the entire disclosure of which is hereby incorporated herein by reference.

BACKGROUND OF THE TECHNOLOGY

Field of the Technology

The present disclosure relates to nickel-base alloys.

DESCRIPTION OF THE BACKGROUND OF THE TECHNOLOGY

Nickel-base alloys are used in aerospace, aeronautic, defense, marine, energy, and automotive applications including, for example, gas turbines, super critical carbon dioxide devices, concentrating solar plants, and ultra-super critical steam applications. These applications can be demanding on the nickel-base alloy and can require an advantageous combination of strength, weldability, formability, oxidation resistance, and microstructural stability at temperatures in excess of 1400° F. (760° C.). Developing a nickel base alloy that exhibits an advantageous combination of strength, creep resistance, weldability, formability, oxidation resistance, and microstructural stability at temperature above 1400° F. (760° C.) presents certain challenges.

One of the challenges encountered is that in order to achieve desired strength at these high temperatures through precipitation hardening, weldability and formability are reduced. This is evidenced, for example, by the known fabricability issues related to Rene 41 and Waspaloy alloys, both of which exhibit rapid age hardening and, as a result, can be difficult to form and weld. To address this fabricability issue, UNS N07208 reportedly was designed to simultaneously optimize strain age cracking, microstructural stability, and creep-rupture strength. While a favorable combination of properties has been reported for UNS N07208, this came at the expense of creep-rupture (compared to Rene 41 alloy) and strain age cracking (compared to Nimonic 263 alloy). Therefore, further improvement in creep-rupture, microstructural stability, and strain age cracking resistance is highly desirable.

SUMMARY

A nickel-base alloy of the present disclosure comprises, in weight percentages based on the total weight of the nickel-base alloy: 1.6% to 3% aluminum; 0.3% to 1.5% titanium; 1.5% to 2.4% tantalum; nickel; and impurities.

Additional embodiments of a nickel-base alloy of the present disclosure comprise, in weight percentages based on the total weight of the nickel-base alloy: 1.6% to 3% aluminum; 0.3% to 1.5% titanium; 1.5% to 4% tantalum; 16% to 23% chromium; 5% to 20% cobalt; 4% to 10% molybdenum; 0 to 5% tungsten; nickel; and impurities. Certain non-limiting embodiments of the nickel-base alloy have a composition according to one or more of the following equations:

$$2.5<\{[Al]+0.56\times[Ti]+0.29\times[Nb]+0.15\times[Ta]\}<3.4$$

$$5<\{[Mo]+0.52\times[W]\}<10$$

$$0.8\leq\{[Nb]+0.51\times[Ta]\}\leq2.4.$$

Additional embodiments of a nickel-base alloy of the present disclosure comprise, in weight percentages based on the total weight of the nickel-base alloy: 1.6% to 3% aluminum; 0.3% to 1.5% titanium; 1.5% to 4% tantalum; 16% to 23% chromium; 5% to 20% cobalt; 4% to 10% molybdenum; 0 to 5% tungsten; 0 to 1.2% niobium; 0 to 0.5% carbon; 0 to 0.1% boron; 0 to 5% iron; 0 to 2% manganese; 0 to 2% vanadium; 0 to 2% copper; 0 to 1% silicon; 0 to 1% zirconium; 0 to 1% hafnium; 0 to 1% rhenium; a total of 0 to 1% of rare earth elements; nickel; and impurities.

Additional embodiments of a nickel-base alloy of the present disclosure comprise, in weight percentages based on the total weight of the nickel-base alloy: 1.6% to 2.7% aluminum; 0.4% to 1.4% titanium; 1.6% to 3% tantalum; 17% to 21% chromium; 6% to 19% cobalt; 5% to 10% molybdenum; 0 to 3% tungsten; nickel; and impurities. Certain non-limiting embodiments of the nickel-base alloy have a composition according to one or more of the following equations:

$$2.6<\{[Al]+0.56\times[Ti]+0.29\times[Nb]+0.15\times[Ta]\}<3.3$$

$$6<\{[Mo]+0.52\times[W]\}<10$$

$$0.8\leq\{[Nb]+0.51\times[Ta]\}\leq1.7.$$

Additional embodiments of a nickel-base alloy of the present disclosure comprise, in weight percentages based on total weight of the nickel-base alloy: 1.6% to 2.7% aluminum; 0.4% to 1.4% titanium; 1.6% to 3% tantalum; 17% to 21% chromium; 6% to 19% cobalt; 5% to 10% molybdenum; 0 to 3% tungsten; 0 to 0.9% niobium; 0 to 0.2% carbon; 0 to 0.05% boron; 0 to 3% iron; 0 to 2% manganese; 0 to 2% vanadium; 0 to 2% copper; 0 to 1% silicon; 0 to 1% zirconium; 0 to 1% hafnium; 0 to 1% rhenium; a total of 0 to 1% of rare earth elements; titanium; and impurities.

Additional embodiments of a nickel-base alloy of the present disclosure comprise, in weight percentages based on total weight of the nickel-base alloy: 1.7% to 2.4% aluminum; 0.5% to 1.3% titanium; 1.7% to 2.9% tantalum; 17% to 21% chromium; 7% to 18% cobalt; 6% to 9.5% molybdenum; 0 to 1% tungsten; nickel; and impurities. Certain non-limiting embodiments of the nickel-base alloy have a composition according to one or more of the following equations:

$$2.7<\{[Al]+0.56\times[Ti]+0.29\times[Nb]+0.15\times[Ta]\}<3.3$$

$$6<\{[Mo]+0.52\times[W]\}<9.5$$

$$0.8\leq\{[Nb]+0.51\times[Ta]\}\leq1.5.$$

Additional embodiments of a nickel-base alloy of the present disclosure comprise, in weight percentages based on total weight of the nickel-base alloy: 1.7% to 2.4% aluminum; 0.5% to 1.3% titanium; 1.7% to 2.9% tantalum; 17% to 21% chromium; 7% to 18% cobalt; 6% to 9.5% molybdenum; 0 to 1% tungsten; 0 to 0.5% niobium; 0 to 0.2% carbon; 0 to 0.05% boron; 0 to 1.5% iron; 0 to 2% manganese; 0 to 2% vanadium; 0 to 2% copper; 0 to 1% silicon; 0 to 1% zirconium; 0 to 1% hafnium; 0 to 1% rhenium; a total of 0 to 1% of rare earth elements; titanium; and impurities.

BRIEF DESCRIPTION OF THE DRAWINGS

The features and advantages of the examples presented herein, and the manner of attaining them, will become more apparent, and the examples will be better understood, by reference to the following description taken in conjunction with the accompanying drawings, wherein.

Figure 1:
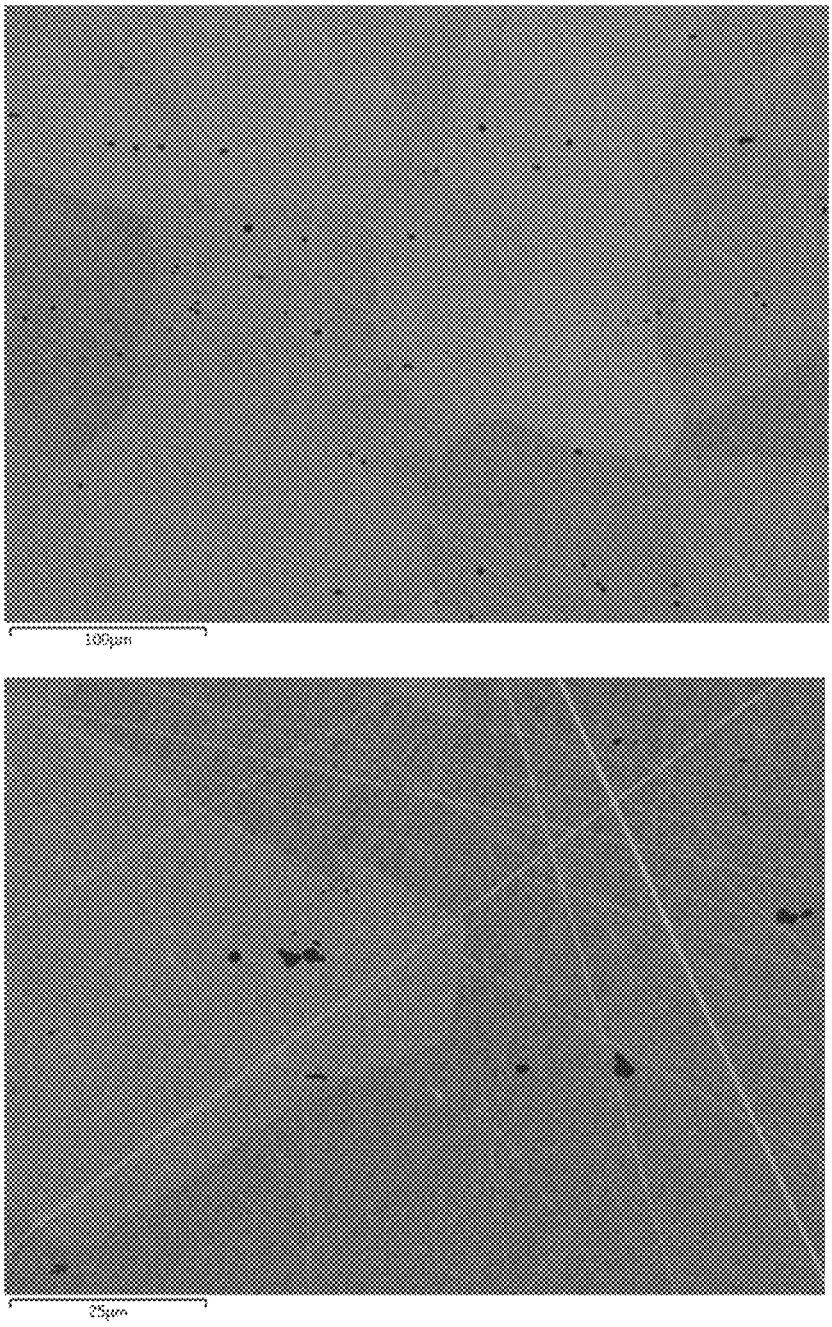
FIGS. 1, 6-7, 16-17, 26-27, and 36-37 are scanning electron microscope (SEM) images of a comparative alloy.

The examples set out herein illustrate certain embodiments, in one form, and such examples are not to be construed as limiting the scope of the appended claims in any manner.

DETAILED DESCRIPTION OF CERTAIN EMBODIMENTS

The reader will appreciate the foregoing details, as well as others, upon considering the following detailed description of various non-limiting and non-exhaustive embodiments according to the present disclosure.

Various non-limiting embodiments are described and illustrated in this specification to provide an overall understanding of the disclosed inventions. It is understood that the various non-limiting embodiments described and illustrated in this specification are non-limiting and non-exhaustive. Thus, the invention is not limited by the description of the various non-limiting and non-exhaustive embodiments disclosed in this specification. Rather, the invention sought to be patented is defined solely by the claims. The features and characteristics illustrated and/or described in connection with various non-limiting embodiments may be combined with the features and characteristics of other non-limiting embodiments. Such modifications and variations are intended to be included within the scope of this specification. As such, the claims may be amended or supplemented to recite any features or characteristics expressly or inherently described in, or otherwise expressly or inherently supported by, this specification. Further, applicant reserves the right to amend the claims to affirmatively disclaim features or characteristics that may be present in the prior art. The various non-limiting embodiments disclosed and described in this specification can comprise, consist of, or consist essentially of the features and characteristics as variously described herein.

All percentages and ratios provided herein for an alloy composition are based on the total weight of the particular alloy composition, unless otherwise indicated herein.

Any patent, publication, or other disclosure material that is said to be incorporated, in whole or in part, by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

In this specification, other than where otherwise indicated, all numerical parameters are to be understood as being prefaced and modified in all instances by the term "about", in which the numerical parameters possess the inherent variability characteristic of the underlying measurement techniques used to determine the numerical value of the parameter. At the very least, and not as an attempt to limit the application of the doctrine of equivalents to the scope of the claims, each numerical parameter described in the present description should at least be construed in light of the number of reported significant digits and by applying ordinary rounding techniques.

Also, any numerical range recited in this specification is intended to include all sub-ranges of the same numerical precision subsumed within the recited range. For example, a range of "1 to 10" is intended to include all sub-ranges between (and including) the recited minimum value of 1 and the recited maximum value of 10, that is, having a minimum value equal to or greater than 1 and a maximum value equal to or less than 10, such as, for example, 2.4 to 7.6. Any maximum numerical limitation recited in this specification is intended to include all lower numerical limitations subsumed therein, and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein. All such sub-ranges are intended to be inherently described in this specification such that amending to expressly recite any such sub-ranges would comply with the requirements of 35 U.S.C. §§ 112 and 132(a). Additionally, as used herein when referring to compositional elemental ranges, the term "up to" includes zero unless the particular element is an unavoidable impurity.

The grammatical articles "one", "a", "an", and "the", as used in this specification, are intended to include "at least one" or "one or more", unless otherwise indicated. Thus, the grammatical articles are used in this specification to refer to one or more than one (i.e., to "at least one") of the grammatical objects of the article. By way of example only, "a component" means one or more components and, thus, possibly, more than one component is contemplated and may be employed or used in an implementation of the described embodiments. Further, the use of a singular noun includes the plural, and the use of a plural noun includes the singular, unless the context of the usage requires otherwise.

Reference herein to a nickel-base alloy "comprising" a particular composition is intended to encompass alloys "consisting essentially of" or "consisting of" the stated composition. It will be understood that nickel-base alloy compositions described herein that "consist of" or "consist essentially of" a particular composition also may include impurities.

In the present disclosure, [Nb], [Ta], [Co], [W], [Al], [Ti], and [Mo] refer to weight percentage concentrations of, respectively, niobium, tantalum, cobalt, tungsten, aluminum, titanium, and molybdenum in an alloy, wherein the weight percentage concentrations are based on total weight of the alloy.

It can be challenging to formulate a nickel-base alloy that exhibits an advantageous combination of strength (e.g., creep, yield strength, and/or tensile strength), weldability, formability (e.g., hardness and/or elongation), oxidation resistance, and microstructural stability. For example, there may be tradeoffs between strength, weldability, formability, oxidation resistance, and microstructural stability in a nickel-base alloy formulation such that an improvement in one property is accompanied by a deterioration in another of the properties. For example, previously it has been observed that formulating a nickel-base alloy to improve creep resistance may be accompanied by a decrease in weldability and/or formability of the alloy.

As is understood in the art, "creep" refers to time-dependent strain occurring under continuous stress below the material's yield strength, such as, for example, at elevated temperature under a load. As used herein in connection with creep, "elevated temperature" refers to temperatures in excess of about 200° F. (93.3° C.). "Stress rupture" is the time at which a metallic article ruptures when subjected to a given sustained load at a given temperature. "Creep strength", also known as "creep limit", is a measure of a material's resistance to creep. It is also described as the stress under particular conditions that results in a particular creep rate. In other words, creep strength may be considered the combination of stress, temperature, and time required to reach a particular percentage of creep or rupture. The stress rupture for an alloy article is generally indicative of its creep strength. A higher stress rupture value indicates higher creep strength for an alloy article.

The stress rupture properties of metallic articles comprising nickel-base superalloys at elevated temperature can depend on many factors, including the composition of the matrix and microstructural features. The microstructure of nickel-base alloys can include various phases, such as, for example, a gamma (γ)-phase, which has a face-centered cubic lattice, and a gamma prime (γ')-phase, which has a primitive cubic lattice. The γ-phase forms a matrix in which the γ'-phase precipitates.

Embodiments of the nickel-base alloy provided herein can comprise an advantageous combination of strength, weldability, formability, oxidation resistance, and microstructural stability. For example, embodiments of the nickel-base alloy provided herein can exhibit an enhanced stress rupture life while maintaining and/or enhancing the weldability and/or formability of the nickel-base alloy. Certain non-limiting embodiments of a nickel-base alloy according to the present disclosure comprise, in weight percentages based on total weight of the nickel-base alloy: 1.6% to 3% aluminum; 0.3% to 1.5% titanium; 1.5% to 4% tantalum; nickel; and impurities. Additional embodiments of a nickel-base alloy according to the present disclosure comprise, in weight percentages based on total weight of the nickel-base alloy: 1.6% to 3% aluminum; 0.3% to 1.5% titanium; 1.5% to 4% tantalum; to 23% chromium; 5% to 20 nickel; 4% to 10% molybdenum; 0 to 5% tungsten; 0 to 1.2% niobium; nickel; and impurities.

The present inventors observed that the addition of tantalum and, if present, niobium in the alloy of the present disclosure can inhibit secondary carbide precipitation. The addition of tantalum and/or niobium in excess of a concentration that forms carbides (e.g., tantalum carbide, niobium carbide) can increase the stability of various carbides within the nickel-base alloy. For example, niobium and tantalum can form primary carbides (i.e., MC carbides) and inhibit precipitation of secondary carbides at grain boundaries and within the grains. The enhanced microstructural stability resulting from tantalum and, if present, niobium addition can lead to enhanced long-term elevated temperature properties such as, for example, increased stress rupture life.

The composition of the nickel-base alloy according to the present disclosure can comprise an amount of niobium and/or tantalum that satisfies the following equation, in weight percentage concentrations based on total weight of the nickel-base alloy:

$$0.8\% \leq \{[Nb]+0.51\times[Ta]\} \leq 2.4\%.$$

For example, certain non-limiting embodiments of a nickel-base alloy according to the present disclosure can comprise niobium and/or tantalum in concentrations that satisfy the following equation, wherein the concentrations are weight percentage concentrations based on total weight of the nickel-base alloy:

$$0.8\% \leq \{[Nb]+0.51\times[Ta]\} \leq 1.7\%.$$

In addition, certain non-limiting embodiments of a nickel-base alloy according to the present disclosure can comprise niobium and/or tantalum in concentrations that satisfy the following equation, wherein the concentrations are weight percentage concentrations based on total weight of the nickel-base alloy:

$$0.8\% \leq \{[Nb]+0.51\times[Ta]\} \leq 1.5\%.$$

Certain non-limiting embodiments of a nickel-base alloy according to the present disclosure can comprise, in weight percentage concentrations based on total weight of the nickel-base alloy, 1.5% to 4% tantalum, such as, for example, 1.5% to 3.9%, 1.6% to 3.5%, 1.6% to 3%, 1.6% to 2.6%, 1.7% to 2.4%, 1.7% to 2.9%, 1.8% to 2.6%, 1.8% to 3%, 1.9% to 3%, 2% to 4%, or 2% to 3% tantalum.

Certain non-limiting embodiments of a nickel-base alloy according to the present disclosure can comprise, in weight percentage concentrations based on total weight of the nickel-base alloy, 0 to 1.2% niobium, such as, for example, 0.75% to 1.2%, 0.8% to 1.2%, 0.8% to 1.1%, 0.8% to 1.0%, 0.9% to 1.2%, 0.9% to 1.1%, 0.95% to 1.2%, 1% to 1.2%, 0 to 0.9%, or 0 to 0.5% niobium.

In embodiments of the nickel-base alloy according to the present disclosure, the aluminum and titanium concentrations are balanced in relation to the tantalum content and, if present, niobium content to control the content of γ'-phase in the nickel-base alloy so as to provide desired weldability, stability of the γ'-phase, and strength. The aluminum concentration in the alloy preferably is at least 1.6 weight percent, based on the total weight of the alloy. The concentration of titanium can be increased to increase alloy strength, but the titanium concentration in the alloy preferably is no greater than 1.5 weight percent, based on the total weight of the nickel-base alloy, so as to control the stability of the γ'-phase. Aluminum content also influences alloy strength, and its content relative to titanium, niobium, and tantalum contents influences the stability of the γ'-phase and can limit the phase fraction of gamma prime in the alloy. In certain embodiments of the alloy, the elemental additions are balanced so that the titanium concentration is decreased in relation to the concentrations of tantalum, aluminum, and, if present, niobium in order to provide desirable strength but also control γ'-phase content and provide desired weldability and stability of the γ'-phase.

Certain non-limiting embodiments of a nickel-base alloy according to the present disclosure can comprise, in weight percentage concentrations based on total weight of the nickel-base alloy, 1.6% to 3% aluminum, such as, for example, 1.6% to 2.7%, 1.6% to 2.5%, 1.7% to 2.4%, 1.7% to 2.7%, 1.8% to 3%, 1.9% to 3%, 2% to 3%, 2% to 2.7%, or 1.7% to 2.5% aluminum.

Certain non-limiting embodiments of a nickel-base alloy according to the present disclosure can comprise, in weight percentage concentrations based on total weight of the nickel-base alloy, 0.3% to 1.5% titanium, such as, for example, 0.4% to 1.4%, 0.6% to 1.3%, 0.4% to 1.4%, 0.5% to 1.5%, 0.3% to 1.3%, or 0.5% to 1.3% titanium.

Weldability of a nickel-base alloy according to the present disclosure may be influenced by the content of aluminum, titanium, tantalum and, if present, niobium in the alloy. In certain non-limiting embodiments, a nickel-base alloy according to the present disclosure having favorable weldability properties can comprises concentrations of aluminum, titanium, tantalum and, if present, niobium that satisfy the following equation, wherein the concentrations are weight percentage concentrations based on total weight of the nickel-base alloy:

$$2.5\% < \{[Al]+0.56\times[Ti]+0.29\times[Nb]+0.15\times[Ta]\} < 3.4\%.$$

Certain non-limiting embodiments of a nickel-base alloy according to the present disclosure having favorable weldability properties can comprises concentrations of aluminum, niobium, titanium, tantalum and, if present, niobium that satisfy the following equation, wherein the concentrations are weight percentage concentrations based on total weight of the nickel-base alloy:

$$2.7\% < \{[Al]+0.56\times[Ti]+0.29\times[Nb]+0.15\times[Ta]\} < 3.3\%.$$

Cobalt, chromium, and molybdenum can enhance the strength of the nickel-base alloy when in solid solution, but also promote formation of topologically closed-packed (TCP) phases (e.g., μ-phase, σ-phase) in the alloy after long holds at elevated temperatures. Inhibiting formation of TCP phases can increase the ductility of the nickel-base alloy. The alloy's cobalt concentration can affect the ductility and the stress rupture life of the nickel-base alloy. For example, increasing cobalt concentration can increase the creep strength of the nickel-base alloy. The chromium and molybdenum concentrations can reduce stability of the γ-phase, but they can improve stress rupture properties at elevated temperatures. Chromium can improve hot corrosion and oxidation resistance of the nickel-base alloy.

Certain non-limiting embodiments of a nickel-base alloy according to the present disclosure can comprise, in weight percentage concentrations based on total weight of the nickel-base alloy, 5% to 20% cobalt, such as, for example, 5% to 16%, 6% to 20%, 6% to 19%, 7% to 18%, 10% to 20%, 5% to 15%, or 10% to 15% cobalt.

Certain non-limiting embodiments of a nickel-base alloy according to the present disclosure can comprise, in weight percentage concentrations based on total weight of the nickel-base alloy, 16% to 23% chromium, such as, for example, 17% to 23%, 18% to 23%, 16% to 21%, 17% to 21%, 18% to 21%, or 18% to 20% chromium.

Certain non-limiting embodiments of a nickel-base alloy according to the present disclosure can comprise, in weight percentage concentrations based on total weight of the nickel-base alloy, 4% to 10% molybdenum, such as, for example, 5% to 10%, 4% to 9%, 5% to 9%, 4% to 8%, 6% to 9.5%, or 5% to 8% molybdenum.

Tungsten can enhance stress rupture performance of the nickel-base alloy. Tungsten can build up at the γ-γ′-interface and can slow the coarsening rate of the γ′-phase precipitates due to the slow diffusion of tungsten from the γ,γ′-interface into the gamma matrix. Tungsten can also contribute to solute drag on dislocation motion through the γ-phase at elevated temperatures. In various non-limiting embodiments, the coefficient of thermal expansion (CTE) for the nickel-base alloy can decrease if tungsten and titanium concentrations are increased and the aluminum concentration is decreased. In various non-limiting embodiments, the concentrations of tungsten and cobalt in the nickel-base alloy can be balanced in order to limit formation of TCP phases. Certain non-limiting embodiments of a nickel-base alloy according to the present disclosure can comprise, in weight percentage concentrations based on total weight of the nickel-base alloy, 0 to 5% tungsten, such as, for example, greater than 0 to 5%, greater than 0 to 4%, 0.1% to 5%, 1% to 5%, 1.5% to 3%, 1.5% to 2.5%, 3% to 5%, 2% to 3.5%, or 3.5% to 4.5% tungsten.

Carbon and boron concentrations can enhance stress rupture properties of the nickel-base alloy while maintaining desirable weldability. Certain non-limiting embodiments of a nickel-base alloy according to the present disclosure can comprise, in weight percentage concentrations based on total weight of the nickel-base alloy, 0 to 0.5% carbon, such as, for example, greater than 0 to 0.5%, greater than 0 to 0.4%, 0 to 0.2%, 0 to 0.1%, 0.01% to 0.5%, 0.01% to 0.2%, 0.01% to 0.1%, 0 to 0.2%, 0.02 to 0.5%, 0.02 to 0.3%, 0.02 to 0.1%, 0.03 to 0.5%, 0.03 to 0.3%, 0.03 to 0.1%, or 0.04% to 0.5% carbon. Also, certain non-limiting embodiments of a nickel-base alloy according to the present disclosure can comprise, in weight percentage concentrations based on total weight of the nickel-base alloy, 0 to 0.1% boron, such as, for example, greater than 0 to 0.1%, greater than 0 to 0.05%, 0 to 0.05%, 0 to 0.01%, 0.001% to 0.1%, 0.001% to 0.05%, or 0.001% to 0.01% boron.

Silicon and manganese can improve oxidation of the nickel-base alloy according to the present disclosure in particular oxidizing environments. Certain non-limiting embodiments of a nickel-base alloy according to the present disclosure can comprise, in weight percentage concentrations based on total weight of the nickel-base alloy, 0 to 1% silicon such as, for example, greater than 0 to 1%, greater than 0 to 0.5%, 0 to 0.5%, 0 to 0.25%, 0.1% to 1%, 0.1% to 0.5%, 0.25% to 1.0%, or 0.25% to 0.75% silicon. Certain non-limiting embodiments of a nickel-base alloy according to the present disclosure can comprise, in weight percentage concentrations based on total weight of the nickel-base alloy, 0 to 2% manganese such as, for example, greater than 0 to 0.5%, greater than 0 to 1%, greater than 0 to 1.5%, 0 to 1.5%, 0 to 0.1%, 0.1 to 2%, 0.1% to 1%, 0.25% to 1.5%, or 1% to 2% manganese.

Zirconium, hafnium, and rhenium can improve the stress rupture life of the nickel-base alloy according to the present disclosure. Certain non-limiting embodiments of a nickel-base alloy according to the present disclosure can comprise, in weight percentages based on total weight of the nickel-base alloy, 0 to 1% zirconium such as, for example, greater than 0 to 1%, greater than 0 to 0.5%, 0 to 0.5%, 0 to 0.25%, 0.1% to 1%, 0.1% to 0.5%, 0.25% to 1.0%, or 0.25% to 0.75% zirconium. Certain non-limiting embodiments of a nickel-base alloy according to the present disclosure can comprise, in weight percentage concentrations based on total weight of the nickel-base alloy, 0 to 1% hafnium such as, for example, greater than 0 to 1%, greater than 0 to 0.5%, 0 to 0.5%, 0 to 0.25%, 0.1% to 1%, 0.1% to 0.5%, 0.25% to 1.0%, or 0.25% to 0.75% hafnium. Certain non-limiting embodiments of a nickel-base alloy according to the present disclosure can comprise, in weight percentage concentrations based on total weight of the nickel-base alloy, 0 to 1% rhenium such as, for example, greater than 0 to 1%, greater than 0 to 0.5%, 0 to 0.5%, 0 to 0.25%, 0.1% to 1%, 0.1% to 0.5%, 0.25% to 1.0%, or 0.25% to 0.75% rhenium.

Vanadium can enhance the solid solution strengthening of embodiments of the nickel-base alloy according to the present disclosure. Certain non-limiting embodiments of a nickel-base alloy according to the present disclosure can comprise, in weight percentage concentrations based on total weight of the nickel-base alloy, 0 to 2% vanadium such as, for example, greater than 0 to 0.5%, greater than 0 to 1%, greater than 0 to 1.5%, 0 to 1.5%, 0 to 0.1%, 0.1 to 2%, 0.1% to 1%, 0.25% to 1.5%, or 1% to 2% vanadium.

Copper can be included in various non-limiting embodiments of an alloy according to the present disclosure to, for example, reduce solute solubility and enhance corrosion resistance in some environments. Certain non-limiting embodiments of a nickel-base alloy according to the present disclosure can comprise, in weight percentage concentrations based on total weight of the nickel-base alloy, 0 to 2% copper such as, for example, greater than 0 to 0.5%, greater than 0 to 1%, greater than 0 to 1.5%, or 0.5% to 1.5%, 0 to 1.5%, 0 to 0.1%, 0.1 to 2%, 0.1% to 1%, 0.25% to 1.5%, or 1% to 2% copper. In certain non-limiting embodiments, a nickel-base alloy according to the present disclosure can comprise, in weight percentages based on total weight of the nickel-base alloy, copper.

Rare earth elements can enhance the oxidation resistance of a nickel-base alloy. In various non-limiting embodiments, a nickel-base alloy according the present disclosure can comprise one or more rare earth elements selected from, for example, scandium, yttrium, lanthanum, cerium, praseodymium, neodymium, samarium, europium, gadolinium, terbium, dysprosium, holmium, erbium, and ytterbium. In certain non-limiting embodiments, a nickel-base alloy according to the present disclosure can comprise, in weight percentage concentrations based on total weight of the nickel-base alloy, a total of 0 to 1% rare earth elements. Certain non-limiting embodiments of a nickel-base alloy according to the present disclosure can comprise, in weight percentage concentrations based on total weight of the nickel-base alloy a total of greater than 0 to 1%, greater than 0 to 0.5%, 0 to 0.5%, 0 to 0.25%, 0.1% to 1%, 0.1% to 0.5%, 0.25% to 1.0%, or 0.25% to 0.75% rare earth elements.

The nickel content of embodiments of alloys according to the present disclosure may be greater than 45 weight percent, or may be at least 48 weight percent or greater than 50 weight percent, based on total weight of the alloy. In certain non-limiting embodiments of a nickel-base alloy according to the present disclosure, the nickel content is 48 to 62 weight percent, or in some embodiments is 48 to 60, 48 to 55, 50 to 62, 55 to 62, or greater than 50 to 62 weight percent, based on total weight of the alloy.

Nickel-base alloys according to the present disclosure may include additional impurities. Impurities may be present in the alloys as a result of, for example, impurities in the starting materials (e.g., recycled scrap materials) and/or processing of the alloy during production. In various non-limiting embodiments of alloys according to the present disclosure, one or more of the following elements may be present as incidental impurities: sulfur, phosphorus, magnesium, calcium, oxygen, nitrogen, bismuth, lead, tin, antimony, selenium, arsenic, silver, tellurium, thallium, zinc, ruthenium, platinum, rhodium, palladium, osmium, iridium, gold, fluorine, and chlorine. Additional impurities elements, if present, typically are present in individual concentrations no greater than about 0.1 weight percent, and the total content of such impurities typically is no greater than 5.0 weight percent. It will be understood that the foregoing list of additional impurities elements is not necessarily inclusive of all elements that might be present as impurities in an alloy according to the present disclosure.

A nickel base alloy of the present disclosure can comprise, in weight percentages based on the total weight of the nickel-base alloy: 1.6% to 3% aluminum; 0.3% to 1.5% titanium; 1.5% to 2.4% tantalum; nickel, and impurities.

Certain additional embodiments of a nickel base alloy according to the present disclosure can comprise, in weight percentages based on the total weight of the nickel-base alloy: 1.6% to 3% aluminum; 0.3% to 1.5% titanium; 1.5% to 4% tantalum; 16% to 23% chromium; 5% to 20% cobalt; 4% to 10% molybdenum; 0 to 5% tungsten; nickel; and impurities. In certain alloys according to the present disclosure, the composition of the alloy is such as to satisfy one or more of the following chemistry limitations so as to optimize or improve certain mechanical properties of the alloy:

$$2.5<\{[Al]+0.56\times[Ti]+0.29\times[Nb]+0.15\times[Ta]\}<3.4$$

$$5<\{[Mo]+0.52\times[W]\}<10$$

$$0.8\leq\{[Nb]+0.51\times[Ta]\}\leq2.4.$$

Additional embodiments of a nickel base alloy according to the present disclosure can comprise, in weight percentages based on the total weight of the nickel-base alloy: 1.6% to 3% aluminum; 0.3% to 1.5% titanium; 1.5% to 4% tantalum; 16% to 23% chromium; 5% to 20% cobalt; 4% to 10% molybdenum; 0 to 5% tungsten; 0 to 1.2% niobium; 0 to 0.5% carbon; 0 to 0.1% boron; 0 to 5% iron; 0 to 2% manganese; 0 to 2% vanadium; 0 to 2% copper; 0 to 1% silicon; 0 to 1% zirconium; 0 to 1% hafnium; 0 to 1% rhenium; a total of 0 to 1% of rare earth elements; nickel; and impurities.

Additional embodiments of a nickel base alloy according to the present disclosure can comprise, in weight percentages based on the total weight of the nickel-base alloy: 1.6% to 2.7% aluminum; 0.4% to 1.4% titanium; 1.6% to 3% tantalum; 17% to 21% chromium; 6% to 19% cobalt; 5% to 10% molybdenum; 0 to 3% tungsten; nickel; and impurities. In certain alloys according to the present disclosure, the composition of the alloy is such as to satisfy one or more of the following chemistry limitations so as to optimize or improve certain mechanical properties of the alloy:

$$2.6<\{[Al]+0.56\times[Ti]+0.29\times[Nb]+0.15\times[Ta]\}<3.3$$

$$6<\{[Mo]+0.52\times[W]\}<10$$

$$0.8\leq\{[Nb]+0.51\times[Ta]\}\leq1.7.$$

Additional embodiments of a nickel base alloy according to the present disclosure can comprise, in weight percentages based on the total weight of the nickel-base alloy: 1.7% to 2.4% aluminum; 0.5% to 1.3% titanium; 1.7% to 2.9% tantalum; 17% to 21% chromium; 7% to 18% cobalt; 6% to 9.5% molybdenum; 0 to 1% tungsten; nickel; and impurities. In certain alloys according to the present disclosure, the composition of the alloy is such as to satisfy one or more of the following chemistry limitations so as to optimize or improve certain mechanical properties of the alloy:

$$2.7<\{[Al]+0.56\times[Ti]+0.29\times[Nb]+0.15\times[Ta]\}<3.3$$

$$6<\{[Mo]+0.52\times[W]\}<9.5$$

$$0.8\leq\{[Nb]+0.51\times[Ta]\}\leq1.5.$$

In various non-limiting embodiments, a nickel-base alloy according to the present disclosure can be aged at a temperature in a range of at 1200° F. (649° C.) to 2000° F. (1093° C.), such as, for example, 1300° F. (704° C.) to 1800° F. (982° C.), for a time period in a range of 0.1 hours to 24 hours, such as, for example 1 hour to 12 hours. The aging may be a single-step heat treatment or a multi-step heat treatment. The parameters of the aging can be selected based on the properties of the nickel-base alloy desired after heat treatment.

Non-limiting examples of possible heat treatments that may be applied to a nickel-base alloy according to the present disclosure include one-step, two-step, and three-step heat treatments. In certain non-limiting embodiments, a one-step heat treatment that may be applied to a nickel-base alloy according to the present disclosure may involve a single subsolvus aging heat treat step, for example, at a temperature of 1400° F. to 1600° F. (760° C. to 871° C.), e.g., at approximately 1500° F. (816° C.) for 1 to 24 hours, e.g., 6 to 12 hours, or about 8 hours. In certain non-limiting embodiments, a two-step heat treatment that may be applied to a nickel-base alloy according to the present disclosure may involve a supersolvus heat treat step (e.g., at about 1850° F. to 1950° F. (1010° C. to 1038° C.), e.g., at approximately 1900° F. (1038° C.)), followed by a subsolvus heat treat step (e.g., at about 1400° F. to 1600° F. (760° C. to 871° C.), e.g., at approximately 1450° F. (788° C.) or approximately 1500° F. (816° C.)), for 1 to 24 hours. In various embodiments of a two-step heat treatment that may be applied to a nickel-base alloy according to the present disclosure, two subsolvus heat treat steps may be used, such as, for example, a step at higher subsolvus temperature (e.g., at 1500° F. to 1800° F. (816° C. to 982° C.)) and a step at lower subsolvus temperature (e.g., at 1400° F. to 1600° F. (760° C. to 871° C.)). In certain non-limiting embodiments, a three-step heat treatment that may be applied to a nickel-base alloy according to the present disclosure may involve a supersolvus heat treat step (e.g., at about 1850° F. to 1900° F. (1010° C. to 1038° C.)) followed by two subsolvus heat treat steps (e.g., a step at higher subsolvus temperature (e.g., at 1500° F. to 1800° F. (816° C. to 982° C.)) and a step at lower subsolvus temperature (e.g., at 1400° F. to 1600° F. (760° C. to 871° C.)).

Certain non-limiting embodiments of a nickel base alloy according to the present disclosure can exhibit a yield strength in an aged condition of at least 85 ksi (586.1 MPa) at room temperature, and in certain embodiments may exhibit a yield strength in an aged condition greater than 90 ksi (620.5 MPa) or greater than 95 ksi (655.0) at room temperature. Certain embodiments of a nickel-base alloy according to the present disclosure can exhibit a yield strength in an aged condition of at least 85 ksi at room temperature and a percent elongation of at least 23% at room temperature. For example, in various embodiments, the nickel-base alloy can exhibit a yield strength in an aged condition of at least 90 ksi (620.5 MPa) at room temperature and a percent elongation of at least 25% at room temperature, or can exhibit a yield strength of at least 95 ksi (655.0 MPa) at room temperature and a percent elongation of at least 27% at room temperature. In certain non-limiting embodiments, the nickel-base alloy can exhibit a yield strength of at least 99 ksi (682.6 MPa) at room temperature, and a percent elongation of at least 28% at room temperature. Tensile properties at room temperature can be determined according to ASTM E8/E8M-16.

Certain non-limiting embodiments of a nickel base alloy according to the present disclosure can exhibit a yield strength in an annealed condition that is less than 91 ksi (627.4 MPa), and in certain embodiments may exhibit a yield strength in an annealed condition that is less than 86 ksi (592.9 MPa), or less than 81 ksi (558.5 MPa).

Certain non-limiting embodiments of a nickel base alloy according to the present disclosure can exhibit a yield strength of at least 86 ksi (592.9 MPa) at 1400° F. (760° C.), and a percent elongation of at least 10% at 1400° F. (760° C.). For example, various embodiments of the nickel-base alloy can exhibit a yield strength of at least 86 ksi (592.9 MPa) at 1400° F. (760° C.), and a percent elongation of at least 15% at 1400° F. (760° C.), or the nickel-base alloy can exhibit a yield strength of at least 86 ksi (592.9 MPa) at 1400° F. (760° C.), and a percent elongation of at least 18% at 1400° F. (760° C.). In various non-limiting embodiments, the nickel-base alloy can exhibit a yield strength at of at least 94 ksi (648.1 MPa) at 1400° F. (760° C.), and a percent elongation of at least 23% at 1400° F. (760° C.). In the present disclosure, yield strength and elongation were measured according to standard ASTM E21-20.

Certain non-limiting embodiments of a nickel base alloy according to the present disclosure can have a stress rupture life greater than 100 hours under stress of 35 ksi (241.3 MPa) at 1500° F. (816° C.), such as, for example, greater than 120 hours, greater than 140 hours, or greater than 180 hours, all under stress of 35 ksi (241.3 MPa) at 1500° F. (816° C.). Various embodiments of the nickel-base alloy according to the present disclosure can have a stress rupture life greater than 40 hours under stress of 13 ksi (89.6 MPa) at 1700° F. (927° C.), such as, for example, greater than 50 hours, greater than 60 hours, or greater than 80 hours, all under stress of 13 ksi (89.6 MPa) at 1700° F. (927° C.). The stress rupture properties may be measured according to standard ASTM E139-11(2018).

Certain non-limiting embodiments of a nickel base alloy according to the present disclosure can have a reduction in area after a controlled heating rate test (CHRT) at 1500° F. (816° C.) greater than 7%, and in some embodiments can have a reduction in area greater than 8% or greater than 10% measured under those conditions. Various non-limiting embodiments of the nickel-base alloy according to the present disclosure can have a reduction in area after a controlled heating rate test (CHRT) at 1600° F. (871° C.) in a range of 9% to 30%, such as, for example, 9% to 25%, 13% to 25%, 15% to 25%, 18% to 25%, 10% to 20%, 10% to 25%, or 20% to 25%. Certain non-limiting embodiments of a nickel base alloy according to the present disclosure can have a reduction in area after a controlled heating rate test (CHRT) at 1600° F. (871° C.) of at least 9%, at least 10%, at least 11%, at least 12%, at least 13%, at least 14%, at least 15%, at least 16%, at least 17%, at least 18%, at least 19%, or at least 20%. The Gleeble controlled heating rate test as used herein uses a fixed heat ramp rate (30° F./min) to heat a sample to a target temperature in the Gleeble. The sample is then pulled to failure at a strain rate of $10^{-3}s^{-1}$ at the target temperature. The Gleeble controlled heating rate test simulates the heat affected zone of a weld. A greater reduction in area of the sample can indicate better retention of ductility and increased resistance to strain age cracking.

Certain non-limiting embodiments of a nickel base alloy according to the present disclosure can have an average Vickers hardness (HV) in a range of 180 to 350, such as, for example, 180 to 250, or 200 to 250. The Vickers hardness as used herein is measured according to ASTM E92-17.

Various non-limiting embodiments of the nickel-base alloy according to the present disclosure can exhibit an elongation to failure in the overaged condition greater than 15%, and in some embodiments can exhibit an elongation to failure greater than 18% or in some embodiments greater than 20%. In this case, the overaged condition may be that resulting from the steps of the Track 1 heat treatment described below.

The examples that follow are intended to further describe certain non-limiting embodiments, without restricting the scope of the present invention. Persons having ordinary skill in the art will appreciate that variations of the following examples are possible within the scope of the invention.

Examples

A series of 50 lb. experimental nickel-base alloy heats and a 50 lb. comparative alloy heat were prepared by vacuum induction melting (VIM). Table 1 provides the elemental composition in weight percentages of the experimental Heats A to O and the comparative heat ("Comp.") is shown in Table 1 below. In addition to the contents reported in Table 1, each heat also included impurities, which included, but were not necessarily limited to minor, impurities concentrations of silicon, nitrogen and oxygen.

TABLE 1

Heat chemistries

| | Chemistry (wt %) | | | | | | | | | | | |
|---|---|---|---|---|---|---|---|---|---|---|---|---|
| | Ni | Co | Fe | Cr | Mo | W | Al | Ti | Nb | Ta | C | B |
| Comp. | Bal. | 10 | 0.016 | 20.1 | 8.5 | 0.001 | 1.49 | 2.07 | 0.007 | <0.01 | 0.075 | 0.006 |
| A | Bal. | 9.96 | 0.02 | 18.89 | 7.96 | 0.02 | 2.12 | 0.69 | <0.01 | 2.44 | 0.06 | 0.003 |
| B | Bal. | 9.98 | 0.02 | 18.93 | 7.99 | 0.02 | 2.14 | 0.88 | <0.01 | 2.46 | 0.067 | 0.003 |
| C | Bal. | 9.98 | 0.02 | 18.91 | 7.97 | 0.02 | 2.12 | 1.08 | <0.01 | 2.46 | 0.06 | 0.003 |
| D | Bal. | 9.98 | 0.02 | 18.90 | 7.96 | 0.02 | 2.14 | 1.27 | <0.01 | 2.46 | 0.06 | 0.003 |
| E | Bal. | 9.94 | 0.42 | 18.84 | 7.96 | 0.02 | 2.02 | 0.89 | <0.01 | 1.92 | 0.052 | 0.002 |
| F | Bal. | 9.96 | 0.42 | 18.96 | 7.97 | 0.02 | 1.81 | 1.08 | <0.01 | 1.93 | 0.059 | 0.003 |
| G | Bal. | 9.98 | 0.42 | 18.92 | 8.00 | 0.02 | 1.65 | 1.28 | <0.01 | 1.95 | 0.062 | 0.002 |
| H | Bal. | 14.91 | 0.43 | 18.80 | 7.96 | 0.02 | 2.10 | 0.69 | <0.01 | 2.35 | 0.061 | 0.002 |
| I | Bal. | 9.95 | 0.44 | 18.90 | 7.97 | 0.02 | 2.43 | 0.69 | <0.01 | 1.93 | 0.056 | 0.002 |
| J | Bal. | <0.01 | 0.5 | 18.96 | 7.97 | 3.98 | 2.10 | 0.69 | <0.01 | 2.44 | 0.059 | 0.002 |
| K | Bal. | 9.93 | 0.5 | 18.86 | 7.96 | 0.02 | 2.02 | 0.50 | 1.013 | 1.92 | 0.057 | 0.003 |
| L | Bal. | 9.92 | 0.64 | 18.86 | 7.96 | 0.02 | 2.14 | 0.69 | 0.606 | 1.25 | 0.057 | 0.002 |
| M | Bal. | 9.94 | 0.51 | 18.88 | 7.95 | 0.02 | 2.13 | 0.70 | 1.307 | <0.01 | 0.056 | 0.002 |
| N | Bal. | <0.01 | 0.43 | 18.92 | 7.95 | 4.02 | 2.11 | 0.69 | 1.315 | 0.01 | 0.059 | 0.002 |
| O | Bal. | 9.92 | 0.52 | 18.78 | 4.96 | 3.93 | 2.11 | 0.69 | <0.01 | 2.34 | 0.058 | 0.002 |

After VIM, the heats were homogenized, hot rolled, annealed, water quenched, cold rolled, and annealed, and were then processed by one of the three heating sequences described below. The cold rolled and annealed material from the heats was tested for yield strength. The cold rolled and annealed material also was tested for ductility (reduction in area) in a Gleeble controlled heating rate test (CHRT) at 1500° F. (816° C.). The results are provided in Table 2.

TABLE 2

Annealed Material Properties

| Heat | Annealed Yield Strength ksi (MPa) | 1500° F. (816° C.) CHRT Ductility (%) |
|---|---|---|
| Comp. | — | 15.6 |
| A | 67.9 (468.1) | 16.4 |
| B | 80 (551) | 10.7 |
| C | 79.1 (545.4) | 12.5 |
| D | 88.3 (608.8) | 7.3 |
| E | 52.5 (362.0) | 10.7 |
| F | 50 (345) | 10.5 |
| G | 50.4 (347.5) | 8.9 |
| H | 71.3 (491.6) | 9.5 |
| I | 52.9 (364.7) | 12.3 |
| J | 84.9 (585.4) | 6.7 |
| K | 52.1 (359.2) | 8.7 |
| L | 50.1 (345.4) | 8.8 |
| M | 49.3 (339.9) | 11.6 |
| N | 70.2 (484.0) | 12.4 |
| O | 59.6 (410.9) | 7.3 |

Cold rolled and annealed material from the heats also was evaluated for ASTM grain size, hardness (HV), elongation, and ductility after Gleeble controlled heating rate tests (CHRT) at 1400° F. (760° F.) and 1600° F. (871° C.) and those results are reported in Table 3. Hardness data was not collected for all heats as yield strength of cold rolled an annealed material was considered a better indicator of formability. Grain size is reported in the tables herein as the predominant grain size and an "as low as" (ALA) grain size. Grain sizes reported in the following tables was measured using the optical comparison method as per ASTM E112-13 (2021). In the following tables, "NM" indicates that the property was not measured.

TABLE 3

Annealed Material Properties

| Alloy | ASTM Grain Size | Hardness (HV) | Annealed Elongation (%) | 1400° F. (760° F.) CHRT Ductility (%) | 1600° F. (871° C.) CHRT Ductility (%) |
|---|---|---|---|---|---|
| Comp. | NM | 207 | NM | 20.3 | 12.5 |
| A | 4 ALA 2 | 238 | 50.5 | 19 | 16.5 |
| B | 4.5 ALA 3.5 | 290 | 45.5 | 14.7 | 16.9 |
| C | 3.5 ALA 2.5 | 295 | 47.2 | 13.9 | 13.5 |
| D | 3.5 ALA 2 | 329 | 46.9 | 9.9 | 14.1 |
| E | 3 ALA 1 | NM | 62 | 18.6 | 15.1 |
| F | 4 ALA 2 | NM | 59.7 | 18.4 | 16.9 |
| G | 4.5 ALA 3 | NM | 53.1 | 14.5 | 17.1 |
| H | 4 ALA 1.5 | NM | 48.3 | 14.9 | 12.4 |
| I | 3.5 ALA 2 | NM | 58.8 | 17.1 | 14.8 |
| J | 4.5 ALA 3 | NM | 43.8 | 10.1 | 10.4 |
| K | 4 ALA 2.5 | NM | 59 | 17.4 | 15.8 |
| L | 3.5 ALA 1.5 | NM | 53.9 | 15.1 | 11.6 |
| M | 3 ALA 1.5 | NM | 57.7 | 17.5 | 14.3 |
| N | 5 ALA 3 | NM | 49.8 | 13.8 | 21.8 |
| O | 3.5 ALA 1.5 | NM | 54.3 | 15.5 | 11.3 |

The cold rolled and annealed samples from Heats A-O and the comparative heat were heat treated using one of the three aging sequences listed in Table 4, identified as Tracks 1, 2, and 3. Track 1 included a two-step aging heat treat (2 hours at 1900° F. (1038° C.), followed by 16 hours at 1450° F. (788° C.)). Track 2 involved a one-step aging (1500° F. (816° C.) for 8 hours). Track 3 included a two-step aging heat treat (1800° F. (982° C.) for 2 hours, followed by 1500° F. for 8 hours). After the aging steps were conducted and the aged material was tested, the aged material was subjected to an overaging step wherein the aged material was maintained at 1400° F. (760° C.) for 1000 hours, and evaluated for microstructural stability. Thus, heat samples were prepared in three "aged" conditions, i.e., aged as per Tracks 1, 2, and 3, and also were prepared in three "overaged" conditions, i.e., aged as per each of Tracks 1, 2, and 3 and then heated at 1400° F. (760° C.) for 1000 hours.

TABLE 4

Aging Heat Treatments

| Step | Description | | |
|---|---|---|---|
| | Track 1 | Track 2 | Track 3 |
| Aging Step 1 | 1900° F. (1038° C.), 2 hr | 1500° F. (816° C.), 8 hr | 1800° F. (982° C.), 2 hr |
| Aging Step 2 | 1450° F. (788° C.), 16 hr | n/a | 1500° F. (816° C.), 8 hr |

Various aged and overaged samples were tested for properties including yield strength, reduction in area, stress rupture, and elongation. Hardness was tested in the air-cooled annealed condition. Hardness can indicate suitability of the alloy for production in sheet and other flat product forms. Many γ'-strengthened nickel-base superalloys rapidly harden on cooling and as a result are unsuitable for high volume production. Therefore, an alloy according to the present disclosure preferably has a low hardness in the air-cooled condition.

Results of certain mechanical properties tests on aged samples produced by the sequence described above and heat-treated using the Track 1 sequence are provided in Tables 5 and 6 below. Elongation and yield strength also were evaluated for overaged samples, for which the Track 1 heat treatment was followed by heating the samples at 1400° F. (760° C.) for 1000 hours.

TABLE 5

Mechanical Properties, Track 1

| Heat | Aged Sample Yield Strength at Room Temperature ksi (MPa) | Overaged Sample Elongation (%) | Aged Sample Stress Rupture Life (1500° F./35 ksi) (hr) | Aged Sample Stress Rupture Life (1700° F./13 ksi) (hr) |
|---|---|---|---|---|
| A | 100.6 (693.6) | 22.7 | 225 | 132 |
| B | 104.2 (718.4) | 25.6 | 209 | 125 |
| C | 104.2 (718.4) | 20.2 | 259 | 139 |
| D | 110.7 (763.2) | 22.4 | 175 | 128 |
| E | 95.5 (658.4) | 20.9 | 231 | 92 |
| F | 96.6 (660.0) | 27.7 | 190 | 96 |
| G | 97.3 (670.9) | 25.7 | 148 | 87 |
| H | 104.6 (721.2) | 21.7 | 210 | 93 |
| I | 95.4 (657.8) | 20.9 | 225 | 87 |
| J | 120.6 (831.5) | 11.8 | 156 | 69 |
| K | 99 (683) | 20.6 | 151 | 54 |
| L | 96.6 (660.0) | 20.2 | 195 | 90 |
| M | 94.6 (652.2) | 18.1 | 159 | 40 |
| N | 116.8 (805.3) | 18.3 | 98 | 39 |
| O | 105.3 (726.0) | 26.9 | 267 | 96 |

TABLE 6

Mechanical Properties, Track 1

| Heat | Aged Sample Elongation (%) | Overaged Sample Yield Strength at Room Temperature ksi (MPa) |
|---|---|---|
| A | 30.7 | 97.1 (669.5) |
| B | 31.7 | 101.8 (701.9) |
| C | 34.3 | 103.9 (716.4) |
| D | 30.2 | 109.1 (752.2) |
| E | 29.6 | 95.3 (657.1) |

TABLE 6-continued

Mechanical Properties, Track 1

| Heat | Aged Sample Elongation (%) | Overaged Sample Yield Strength at Room Temperature ksi (MPa) |
|---|---|---|
| F | 32.8 | 99.9 (688.8) |
| G | 35.9 | 98.7 (680.5) |
| H | 31.2 | 106.5 (734.3) |
| I | 32.6 | 98.4 (678.4) |
| J | 24.4 | 121.3 (836.3) |
| K | 32.7 | 95.8 (660.5) |
| L | 32.6 | 93.1 (641.9) |
| M | 27.6 | 90.2 (621.9) |
| N | 27.3 | 107.5 (741.2) |
| O | 32.1 | 101.2 (697.7) |

Results of certain mechanical properties tests on samples produced by the sequence described above and heat-treated using the Track 2 sequence are provided in Tables 7 and 8 below. Elongation and yield strength also were evaluated for overaged samples, for which the Track 2 heat treatment was followed by heating the samples at 1400° F. (760° C.) for 1000 hours.

TABLE 7

Mechanical Properties, Track 2

| Heat | Aged Sample Yield Strength ksi (MPa) | Overaged Sample Elongation to Failure (%) | Aged Sample Stress Rupture Life (1500° F./35 ksi) (hr) |
|---|---|---|---|
| Comp. | 102.8 (708.8) | 17.7 | 116 |
| A | 99.5 (686.0) | 21.7 | 277 |
| B | 103.4 (712.9) | 22.3 | 292 |
| C | 107.3 (739.8) | 17.3 | 333 |
| D | 114 (786) | 20 | 148 |

TABLE 8

Mechanical Properties, Aged Material, Track 2

| Heat | Aged Sample Elongation to Failure (%) | Overaged Sample Yield Strength at Room Temperature ksi (MPa) | Aged Sample Yield Strength at 1400° F. ksi (MPa) | Aged Sample Elongation (%) at 1400° F. |
|---|---|---|---|---|
| Comp. | 27.3 | 102.6 (707.4) | 87.8 (605.4) | 12.5 |
| A | 28.6 | 103.6 (714.3) | 86.2 (594.3) | 11 |
| B | 23.3 | 107.6 (741.9) | 93.7 (646.0) | 10 |
| C | 25.1 | 109.2 (752.9) | 94.1 (648.8) | 10.5 |
| D | 30.6 | 115.2 (794.3) | 100.2 (690.9) | 12 |

Results of certain mechanical properties tests on samples produced by the sequence described above and heat-treated using the Track 3 sequence are provided in Tables 9 and 10 below. Elongation and yield strength also were evaluated for overaged samples, for which the Track 3 heat treatment was followed by heating the samples at 1400° F. (760° C.) for 1000 hours.

TABLE 9

| Mechanical Properties, Aged Material, Track 3 | | | |
|---|---|---|---|
| Heat | Aged Sample Yield Strength at Room Temperature ksi (MPa) | Overaged Sample Elongation (%) | Aged Sample Stress Rupture Life (1500° F./35 ksi) (hr) |
| Comp. | 91.5 (630.9) | 11.3 | 138 |
| A | 95.4 (657.8) | 17.7 | 246 |
| B | 97.4 (671.5) | 17 | 253 |
| C | 100 (689) | 17 | 265 |
| D | 103 (710) | 17.3 | 289 |

TABLE 10

| Mechanical Properties, Aged Material, Track 3 | | | | |
|---|---|---|---|---|
| Alloy | Aged Sample Elongation (%) | Overaged Sample Yield Strength at Room Temperature ksi (MPa) | Aged Sample Yield Strength at 1400° F. ksi (MPa) | Aged Sample Elongation (%) at 1400° F. |
| Comp. | 16.3 | 93.2 (642.6) | 78.8 (543.3) | 15.5 |
| A | 27.8 | 94.5 (651.6) | 87.3 (601.9) | 18 |
| B | 28.3 | 98.7 (680.5) | 91 (627.4) | 21.5 |
| C | 25.4 | 98.2 (677.1) | 88.9 (612.9) | 20.5 |
| D | 26.9 | 104.4 (719.8) | 94.5 (651.6) | 23 |

As shown in Tables 7 and 9, the alloy samples of experimental Heats A-D exhibited roughly twice the rupture life as the samples of the comparative alloy heat when evaluated at 1500° F. (816° C.) and 35 ksi (241 MPa). As shown in Tables 5 and 6, the aged and overaged samples of experimental Heats A-D exhibited superior ductility (e.g., elongation) relative to the comparative alloy in the overaged condition.

Samples of the comparative alloy heat and experimental Heats A-D listed in Table 1 also were characterized using a scanning electron microscope (SEM) to assess carbide formation and γ'-phase distribution. SEM micrographs of the alloys in the cold rolled and annealed condition are provided in FIGS. 1-5. SEM micrographs of the alloys in an aged condition are provided in FIGS. 6-25. SEM micrographs of the alloys in the overaged condition are provided in FIGS. 26-45. The cold rolled and annealed condition was achieved by homogenizing, hot rolling, annealing, water quenching, cold rolling, and annealing. Samples in the aged condition were further subjected to the one-step aging treatment of Track 2 (1500° F. (816° C.) for 8 hours) or the two-step aging treatment of Track 3 (1800° F. (982° C.) for 2 hours, followed by 1500° F. for 8 hours). Samples in the overaged condition were further subjected to the overaging step (1400° F. (760° C.) for 1000 hours) listed in Table 2.

Figure 6:
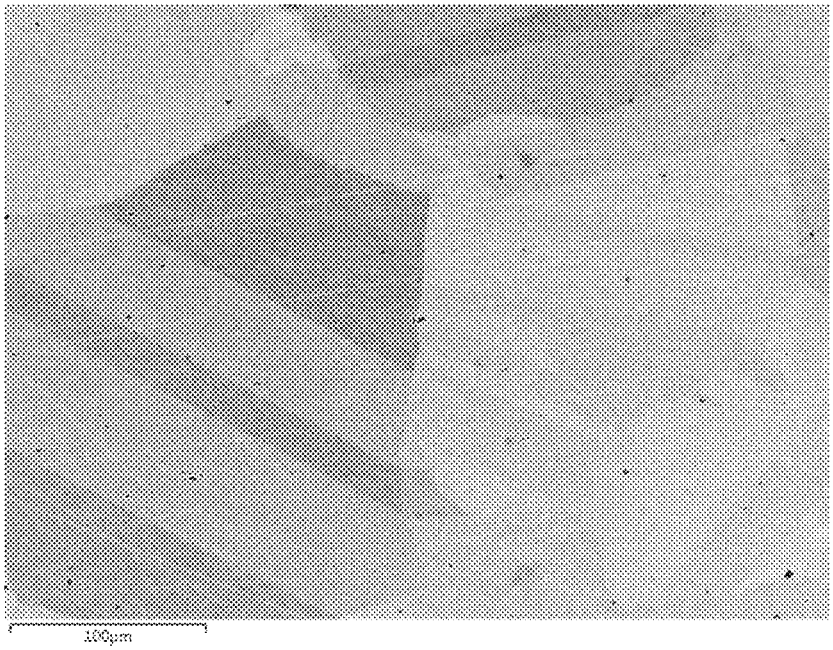
Figure 6:
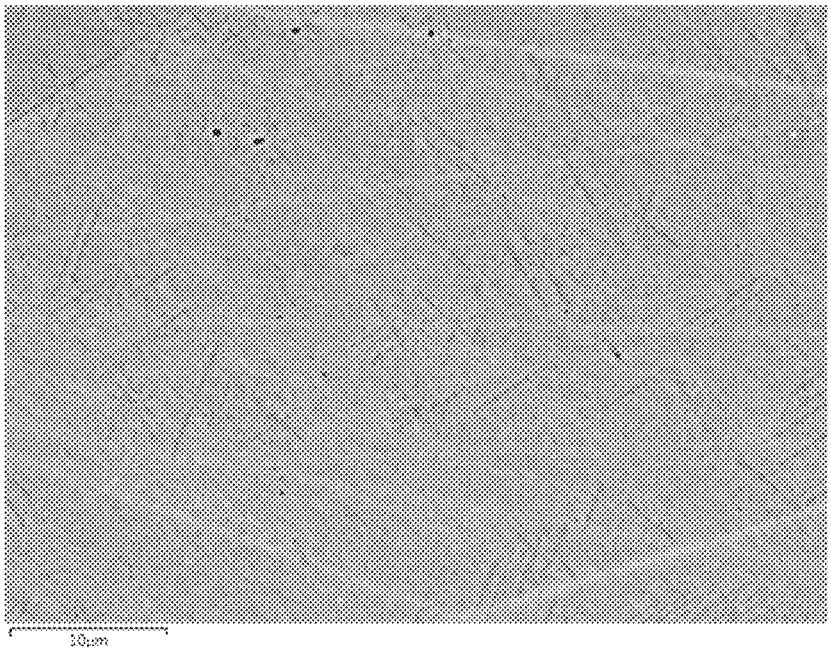
Figure 7:
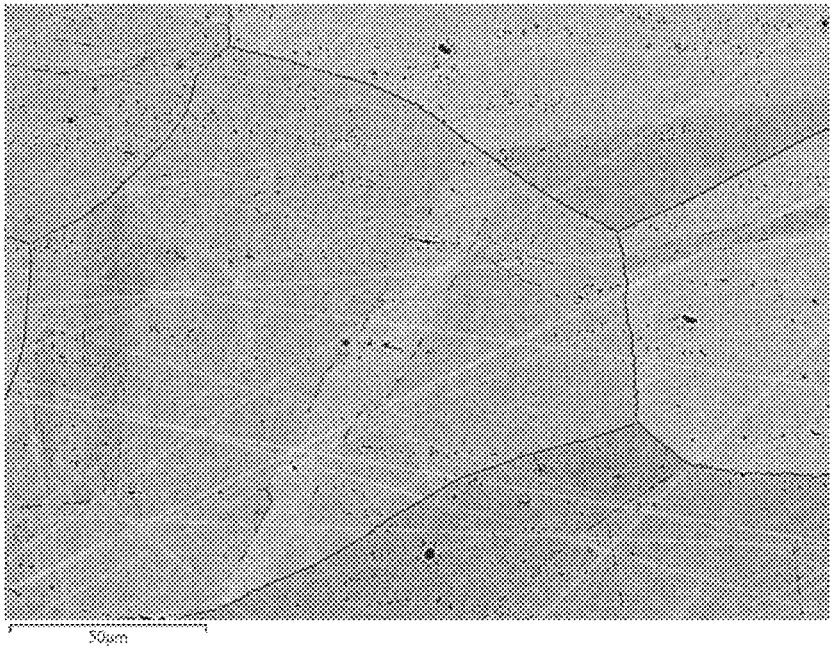
Figure 16:
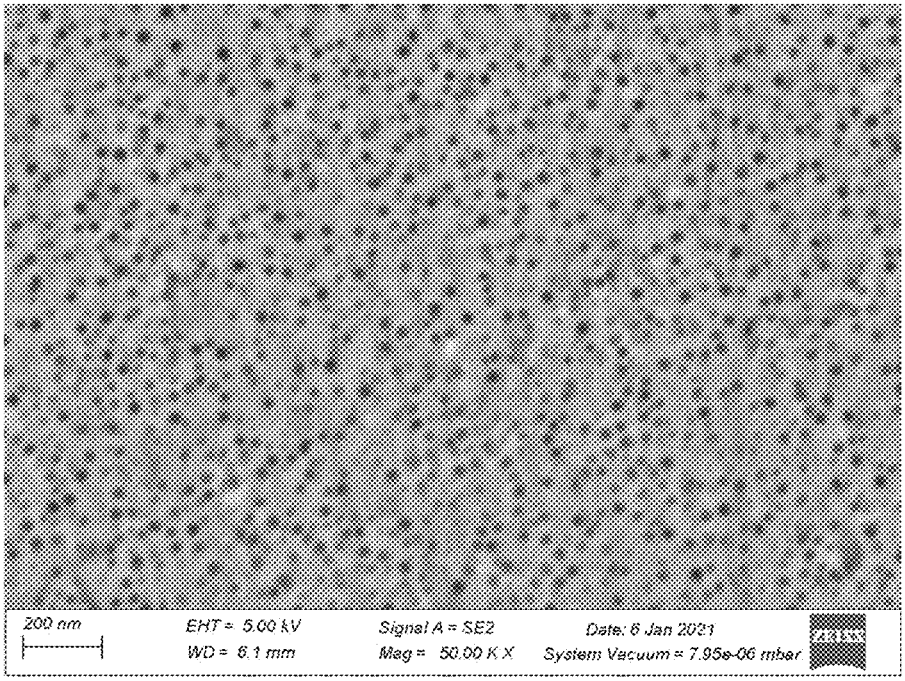
Figure 17:
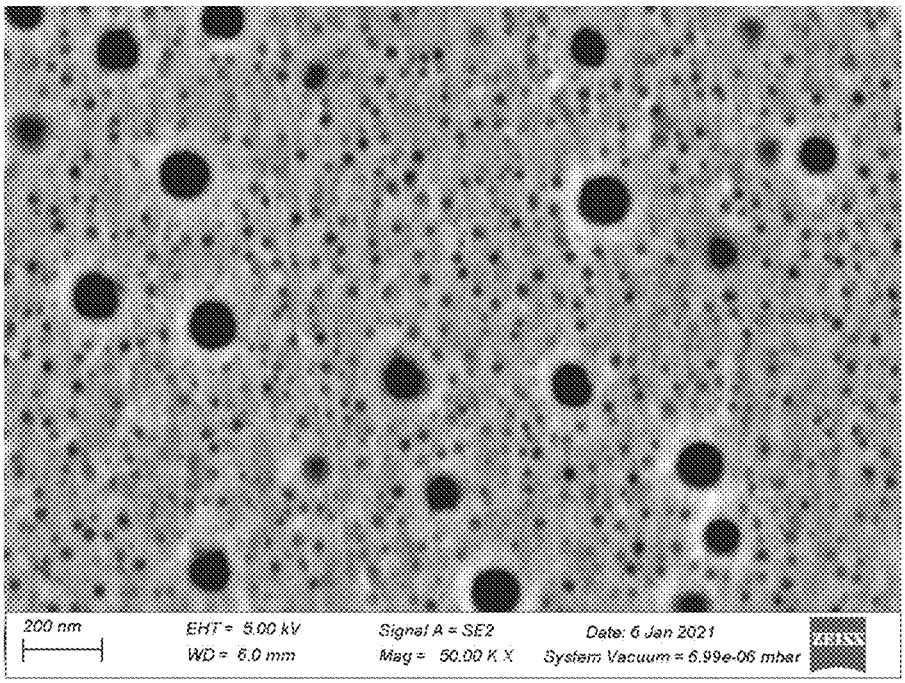
Figure 26:
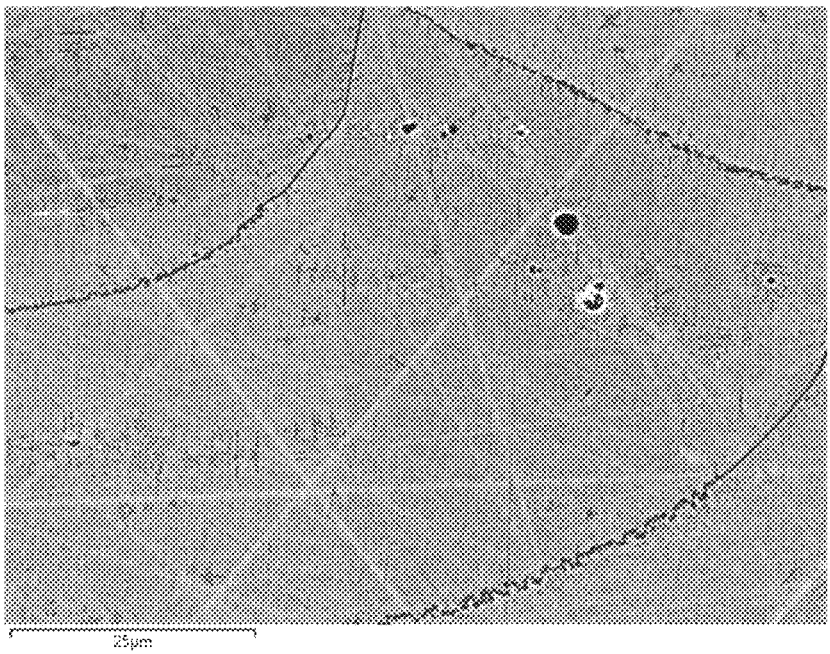
Figure 27:
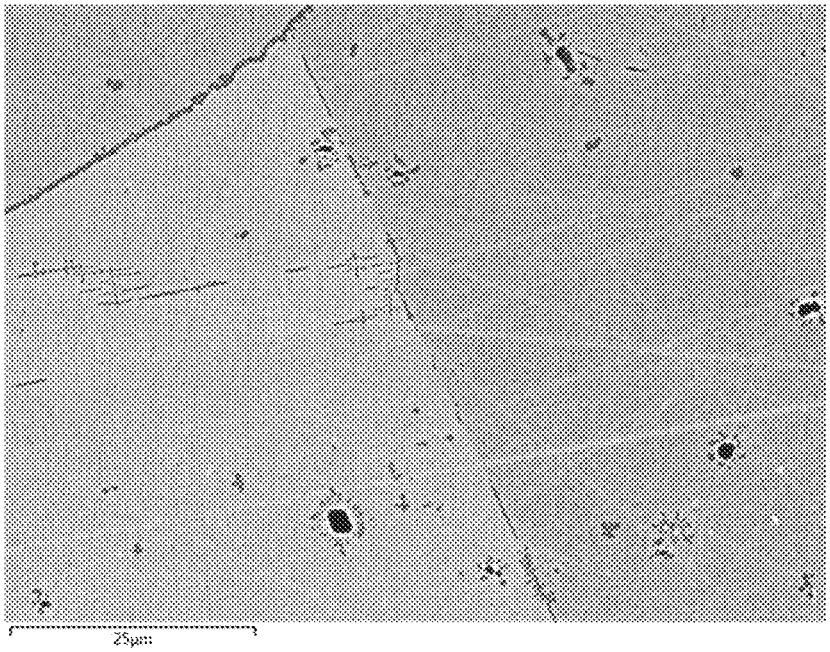
Figure 36:
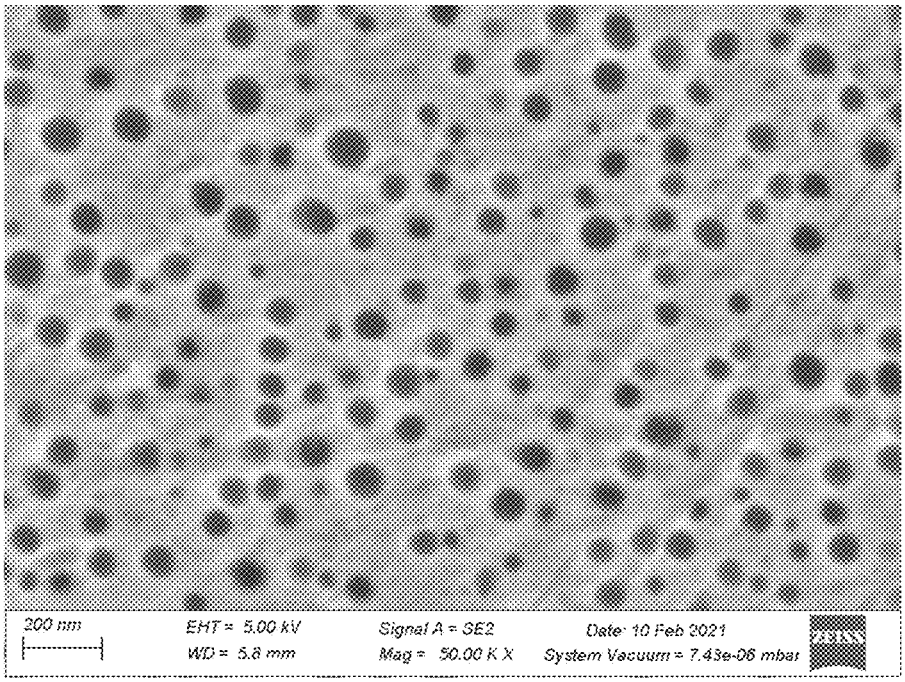
Figure 37:
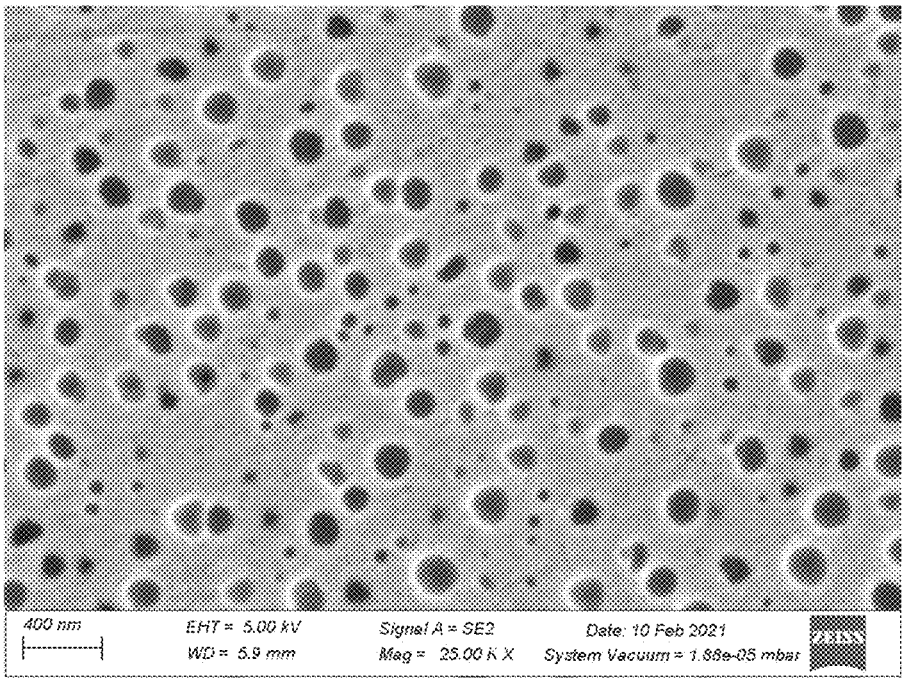

The comparative alloy is shown in the cold rolled and annealed condition in FIG. 1, in an aged condition (single-step aging of Track 2) in FIGS. 6 and 16, in an aged condition (two-step aging of Track 3) in FIGS. 7 and 17, in an overaged condition (aging and overaging steps of Track 2) in FIGS. 26 and 36, and in an overaged condition (aging and overaging steps of Track 3) in FIGS. 27 and 37.

Figure 2:
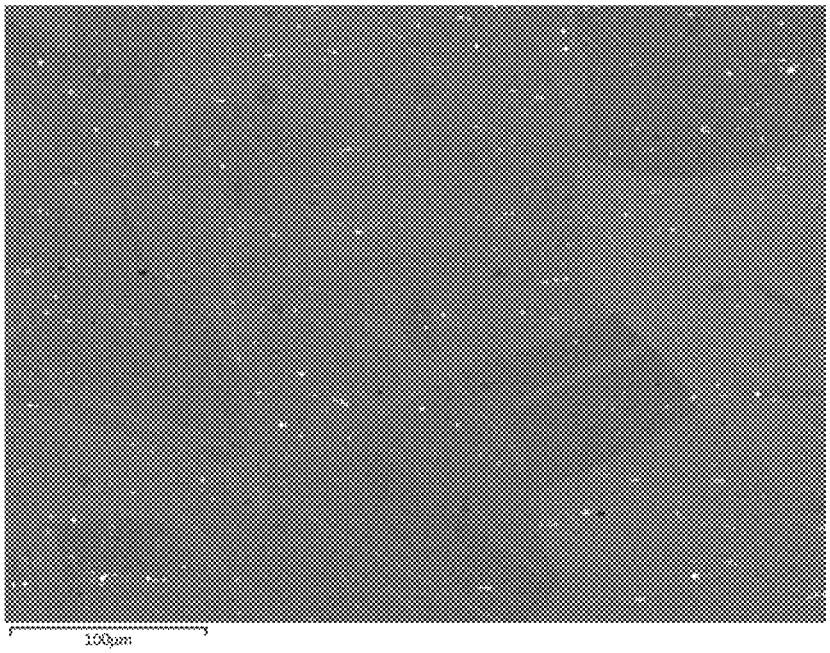
FIGS. 2-5, 8-15, 18-25, 28-35, and 38-45 are SEM images of non-limiting embodiments of nickel-base alloys according to the present disclosure.
Figure 2:
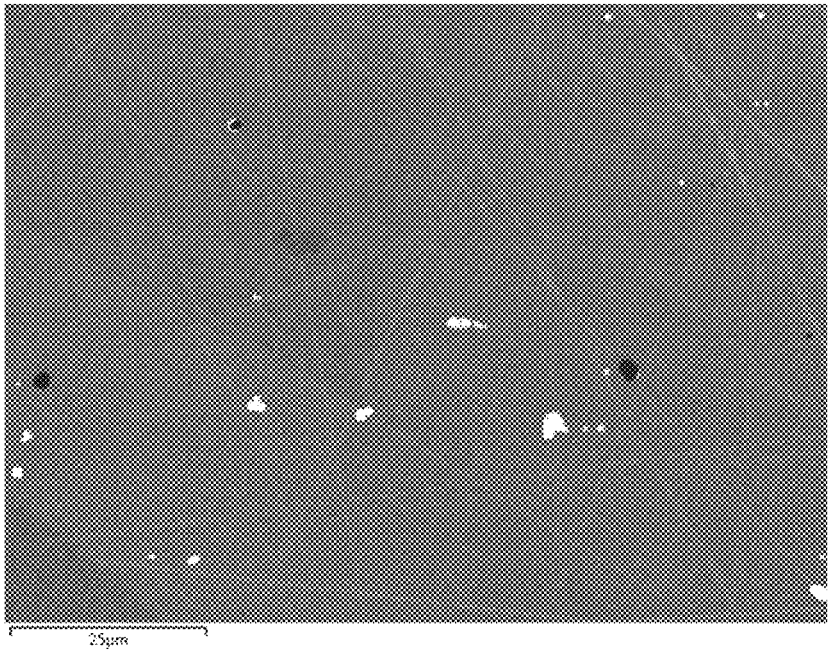
Figure 8:
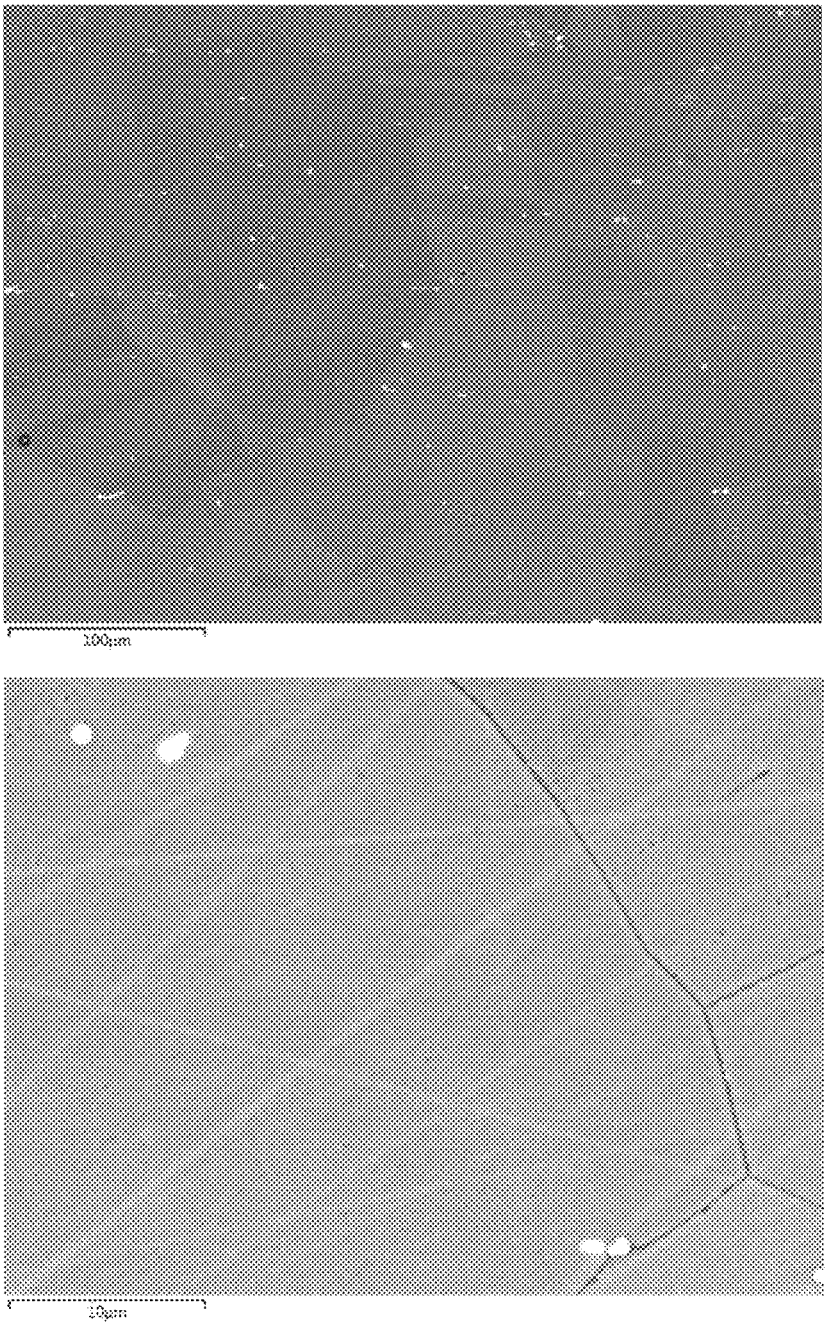
Figure 9:
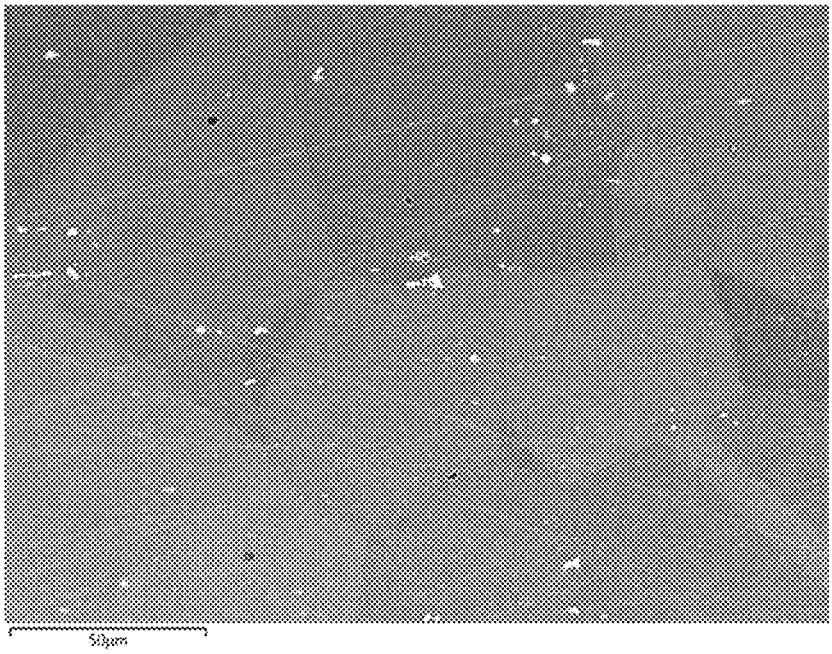
Figure 9:
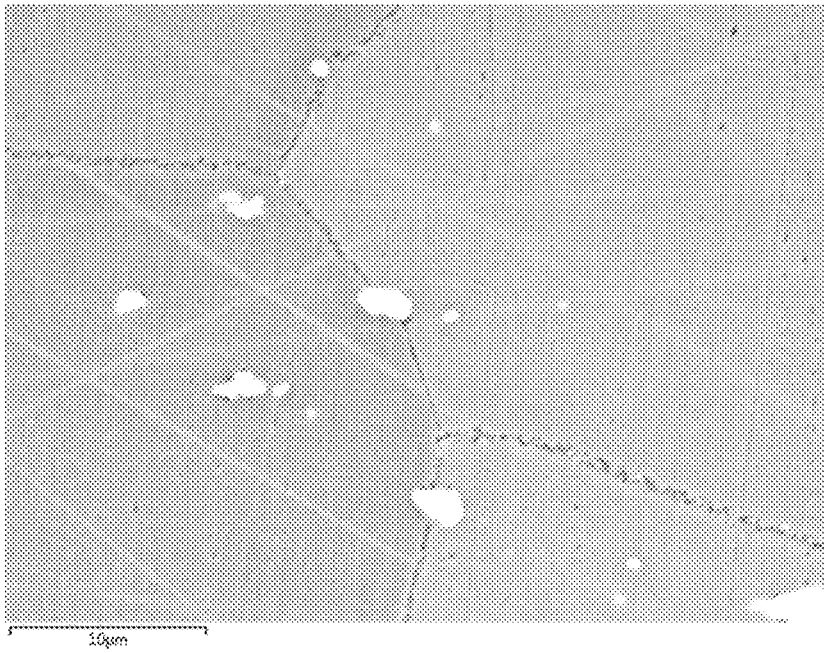
Figure 18:
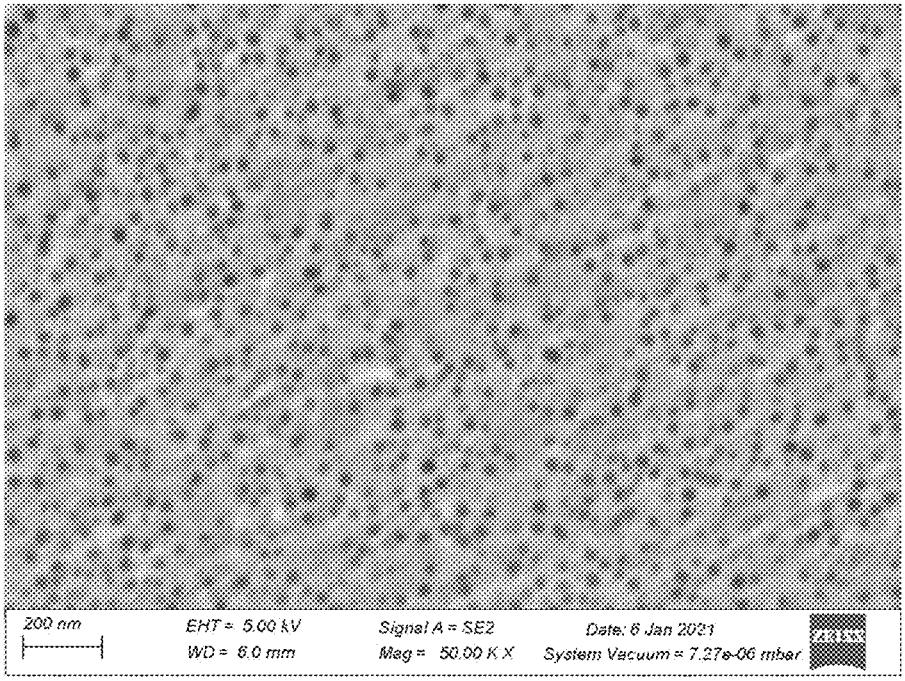
Figure 19:
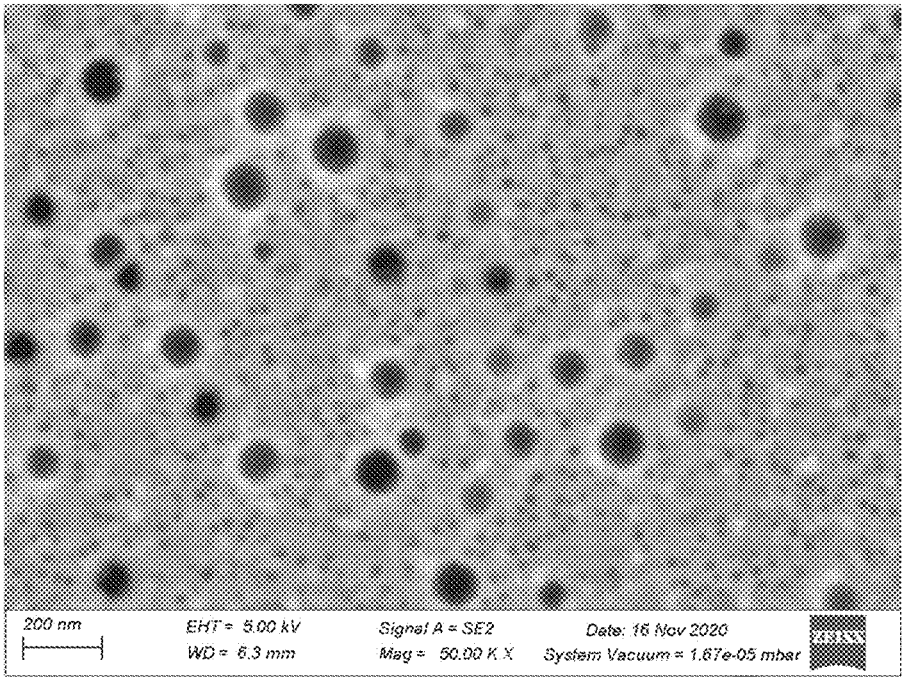
Figure 28:
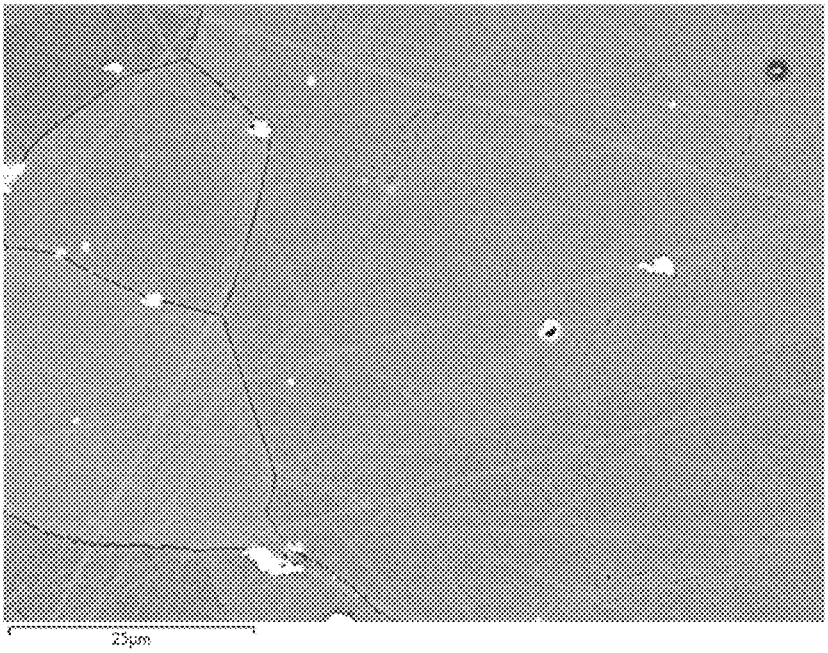
Figure 29:
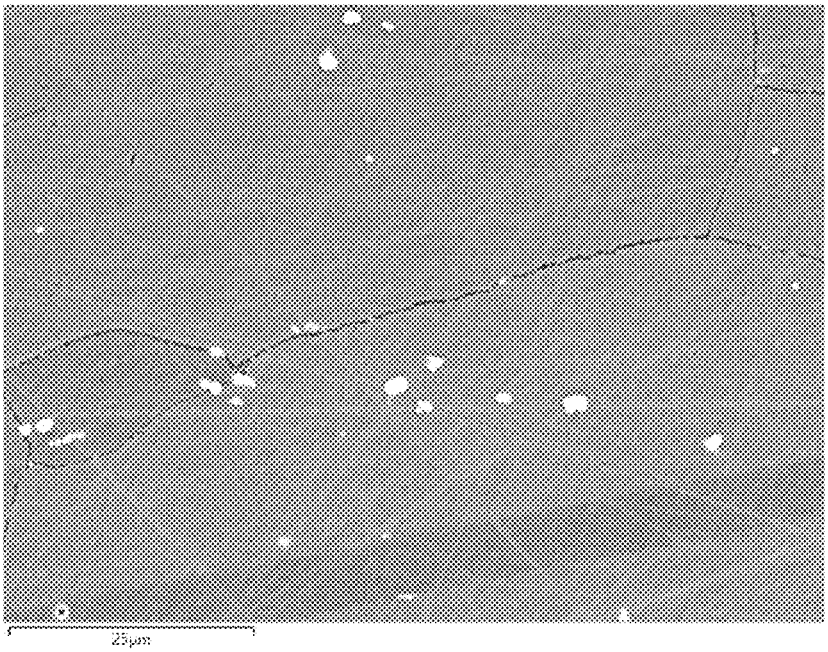
Figure 38:
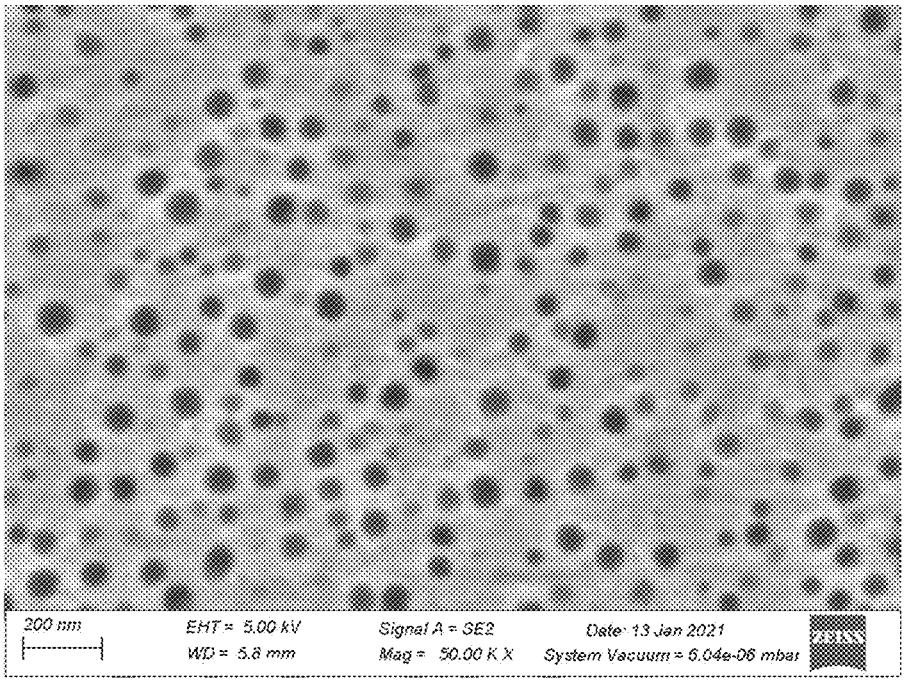
Figure 39:
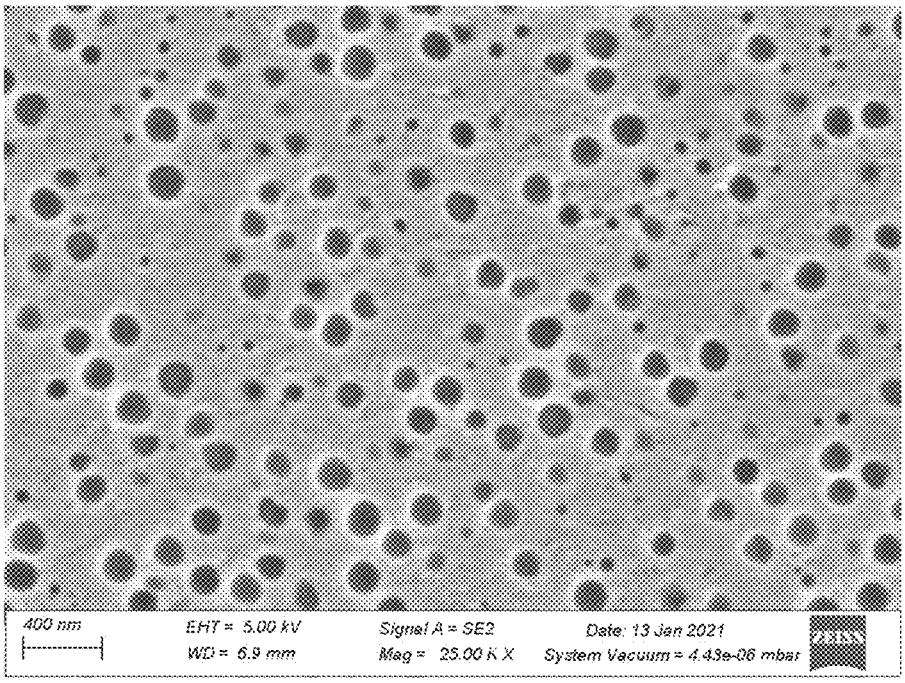

Experimental alloy Heat A is shown in the cold rolled and annealed condition in FIG. 2, in an aged condition (single-step aging of Track 2) in FIGS. 8 and 18, in an aged condition (two-step aging of Track 3) in FIGS. 9 and 19, in an overaged condition (aging and overaging steps of Track 2) in FIGS. 28 and 38, and in an overaged condition (aging and overaging steps of Track 3) in FIGS. 29 and 39.

Figure 3:
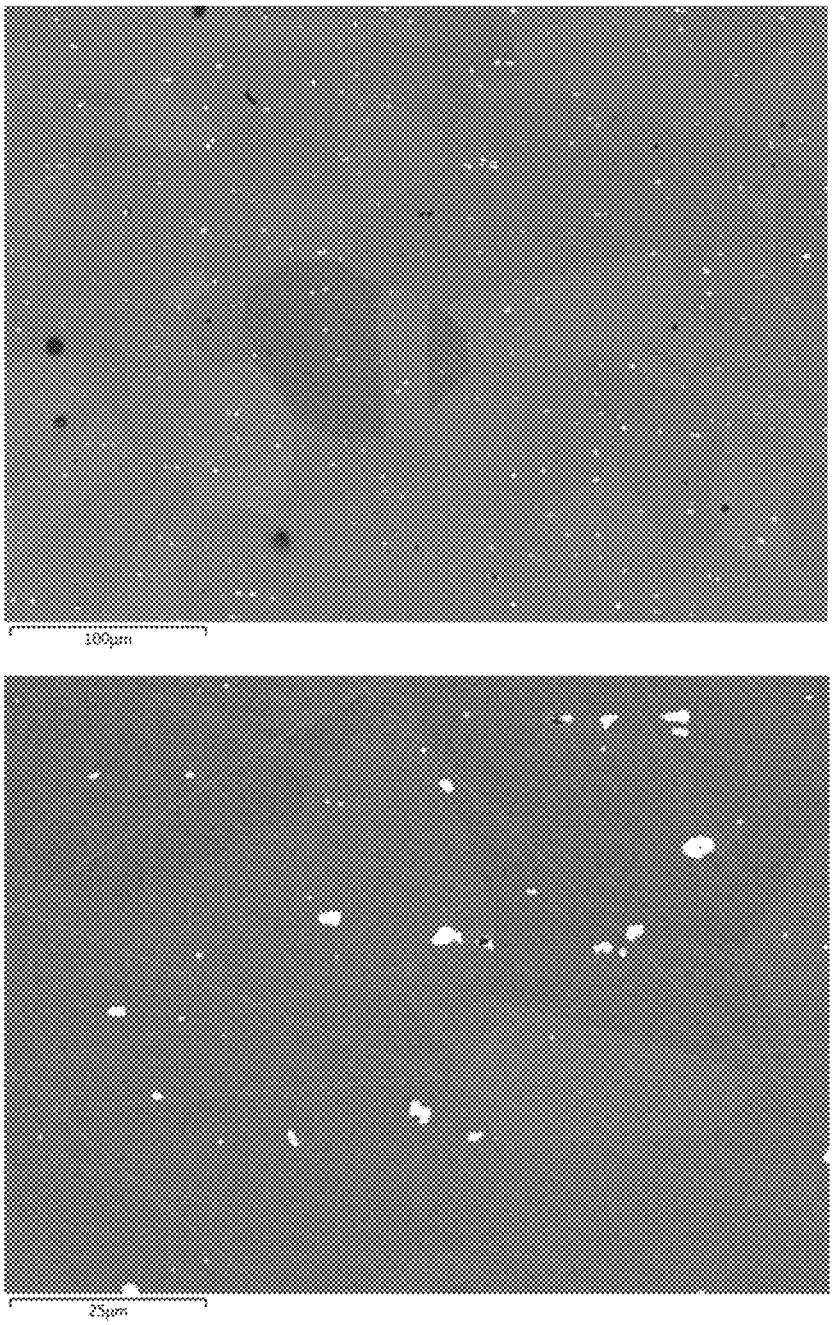
Figure 10:
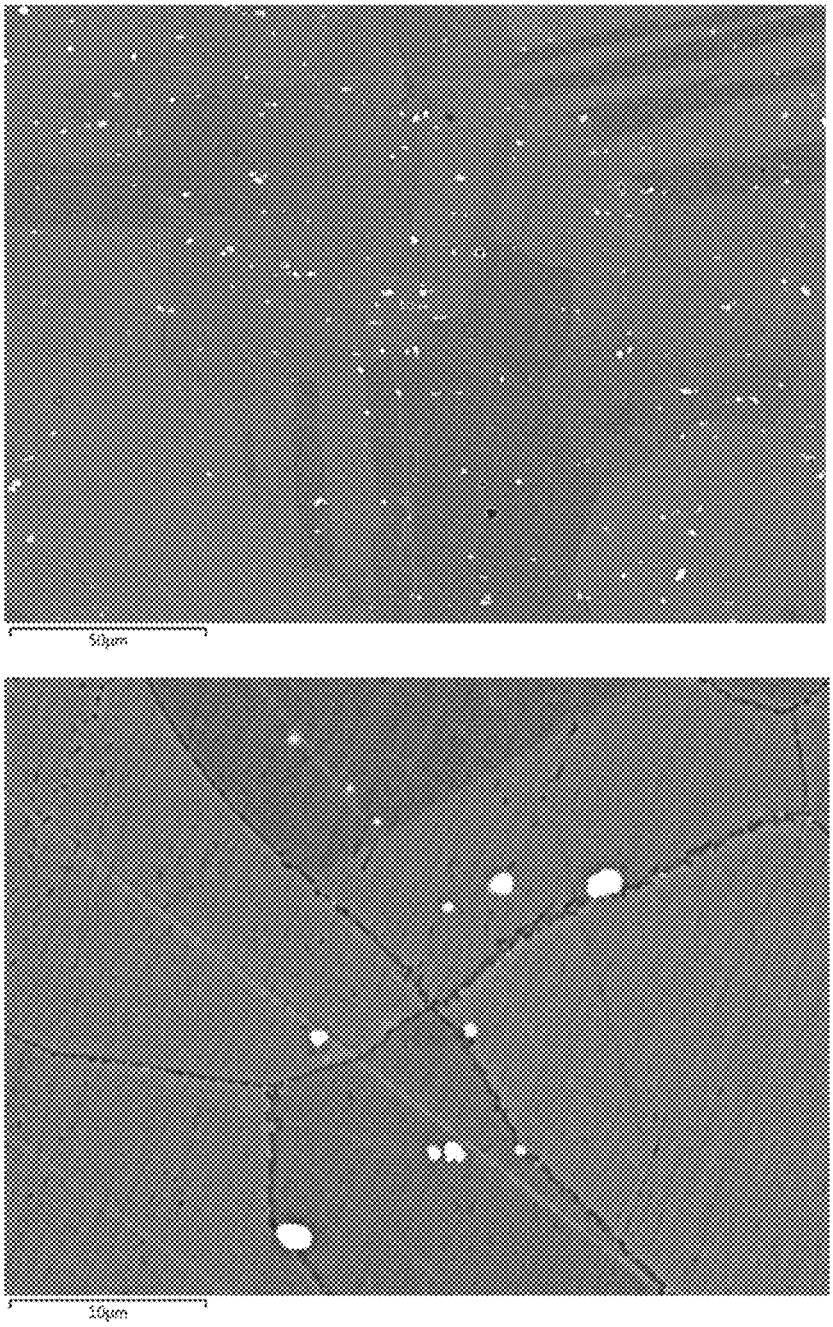
Figure 11:
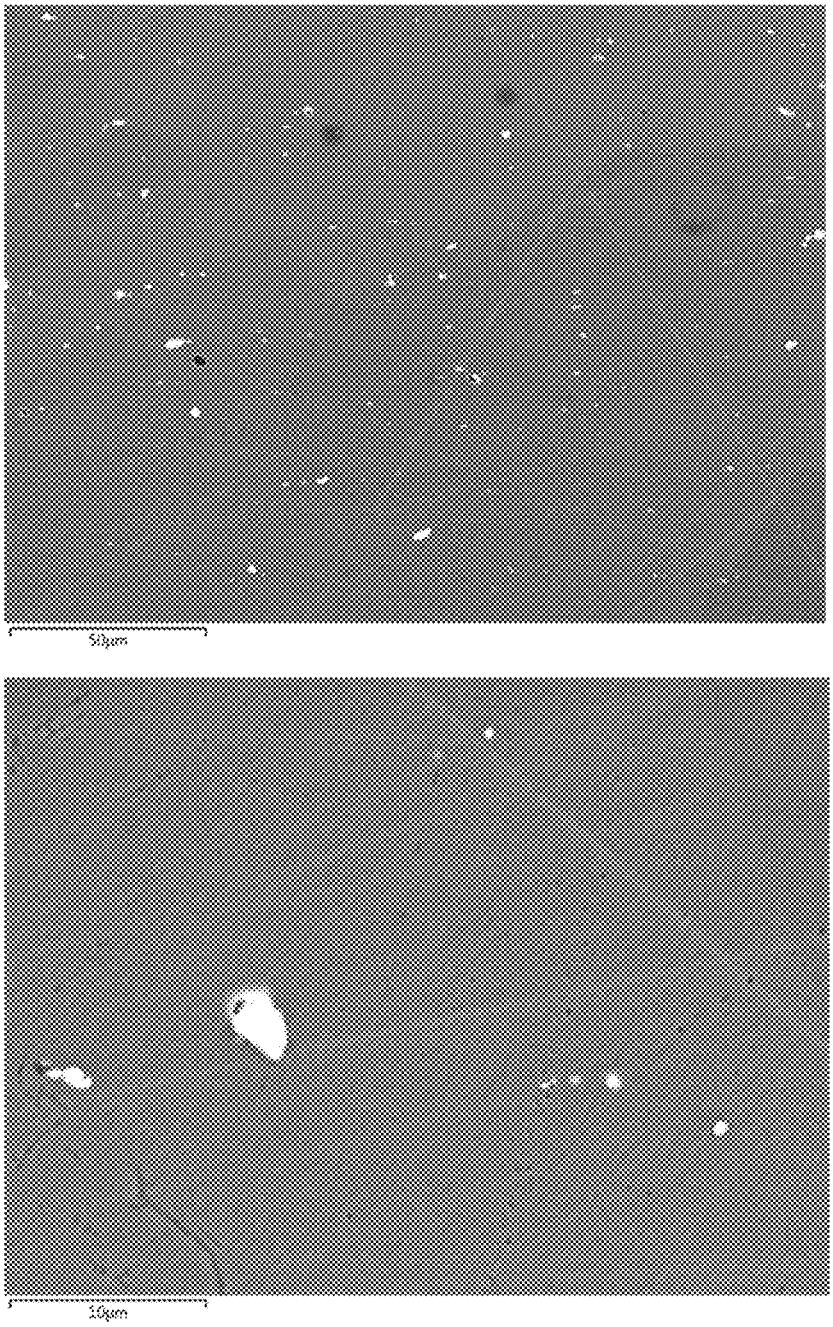
Figure 20:
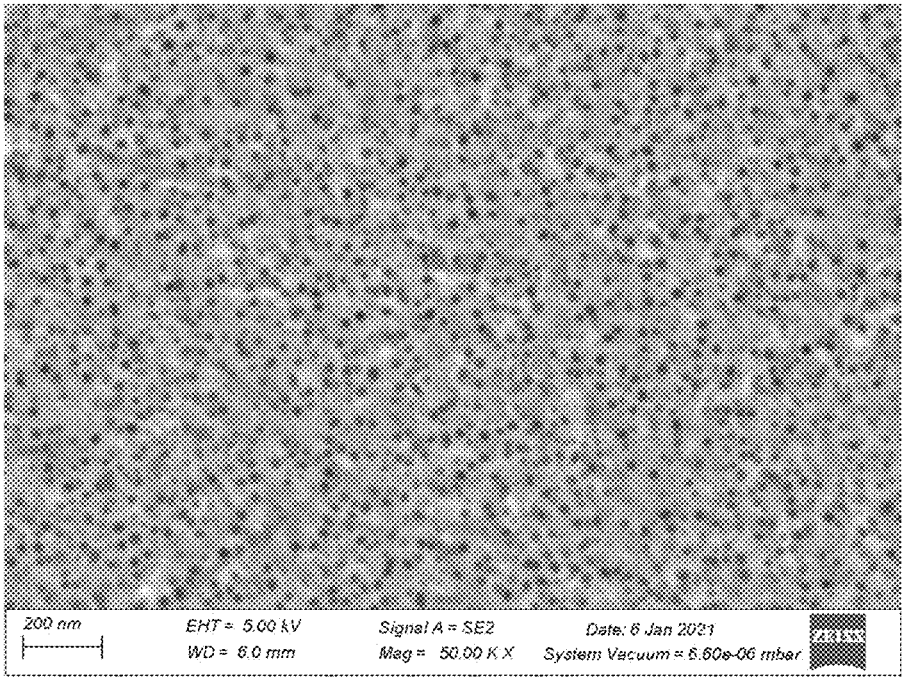
Figure 21:
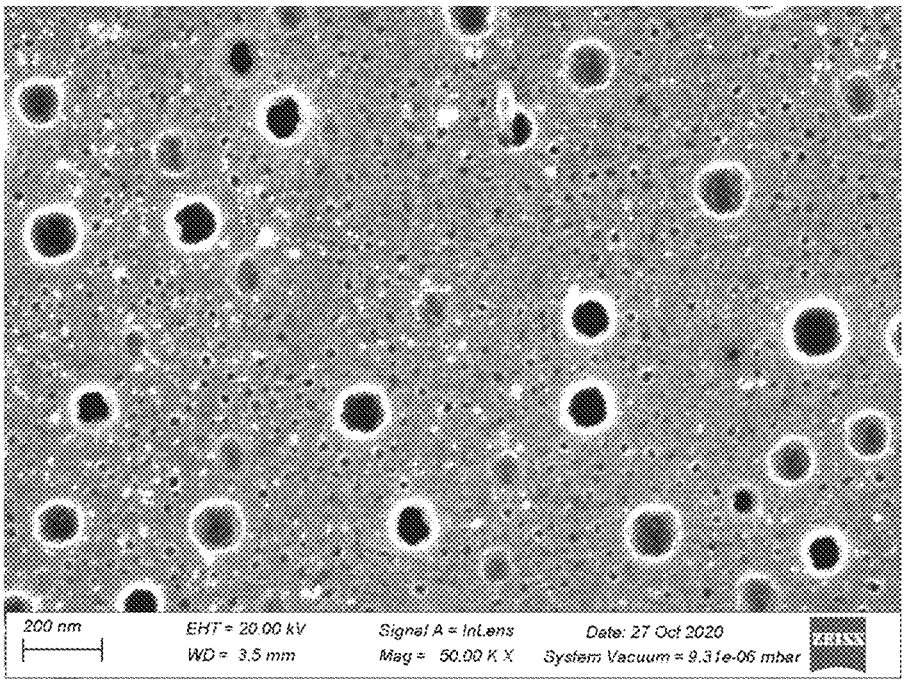
Figure 30:
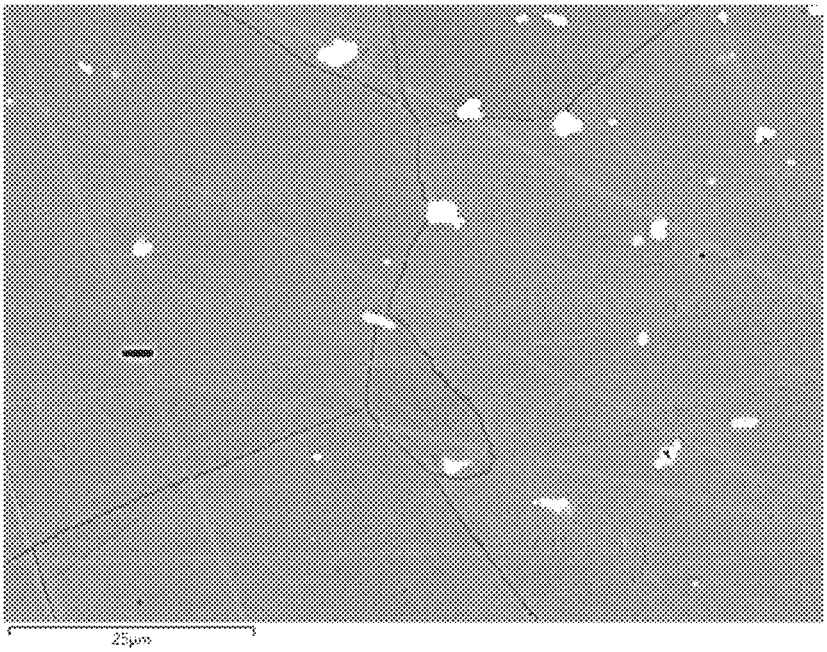
Figure 31:
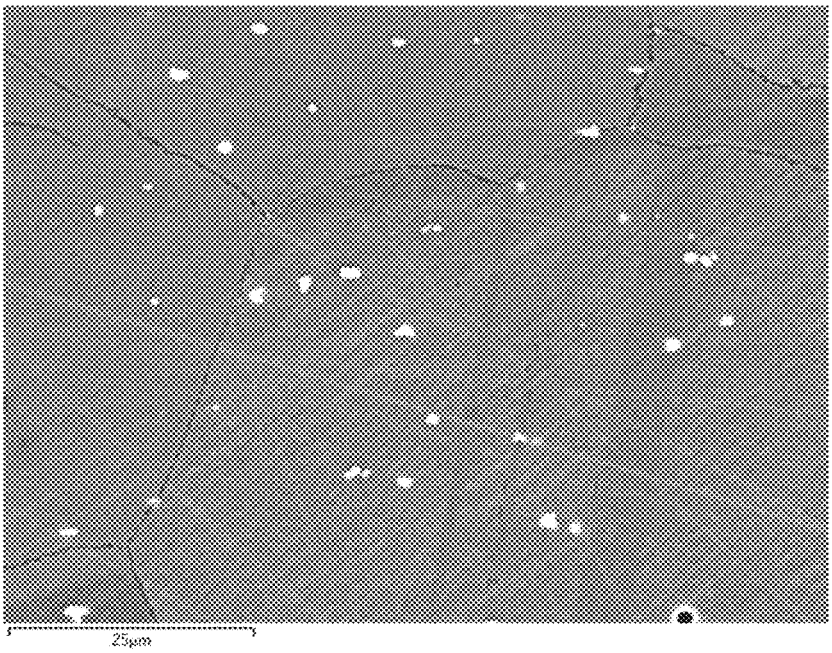
Figure 40:
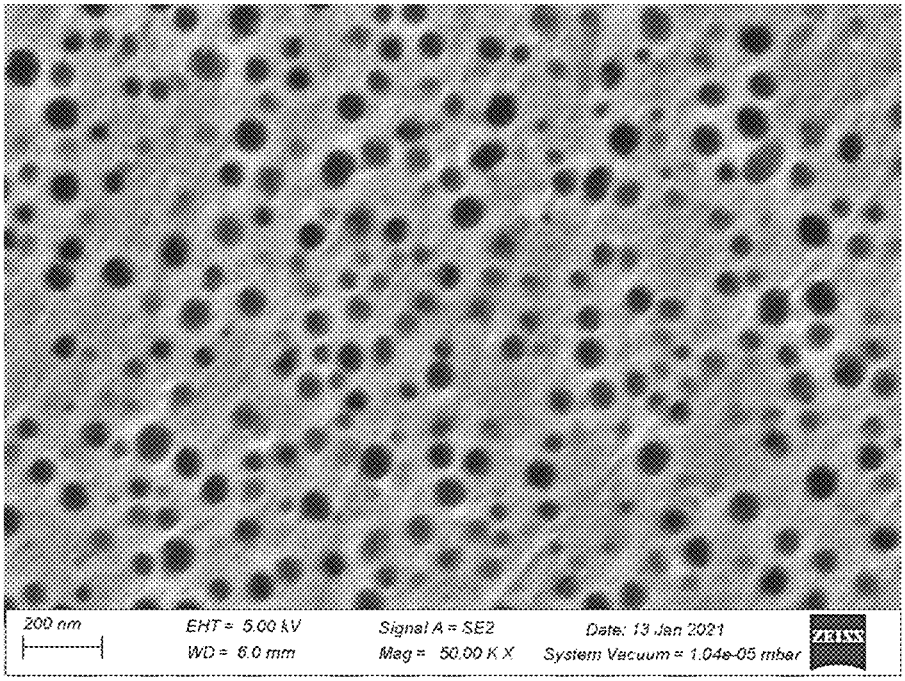
Figure 41:
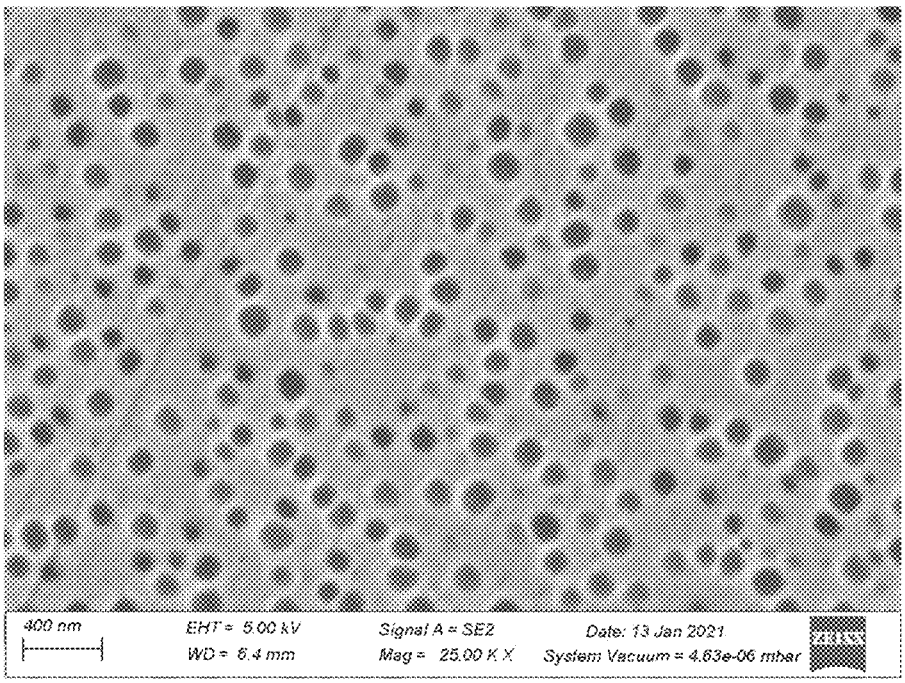

Experimental alloy Heat B is shown in the cold rolled and annealed condition in FIG. 3, in an aged condition (single-step aging of Track 2) in FIGS. 10 and 20, in an aged condition (two-step aging of Track 3) in FIGS. 11 and 21, in an overaged condition (aging and overaging steps of Track 2) in FIGS. 30 and 40, and in an overaged condition (aging and overaging steps of Track 3) in FIGS. 31 and 41.

Figure 4:
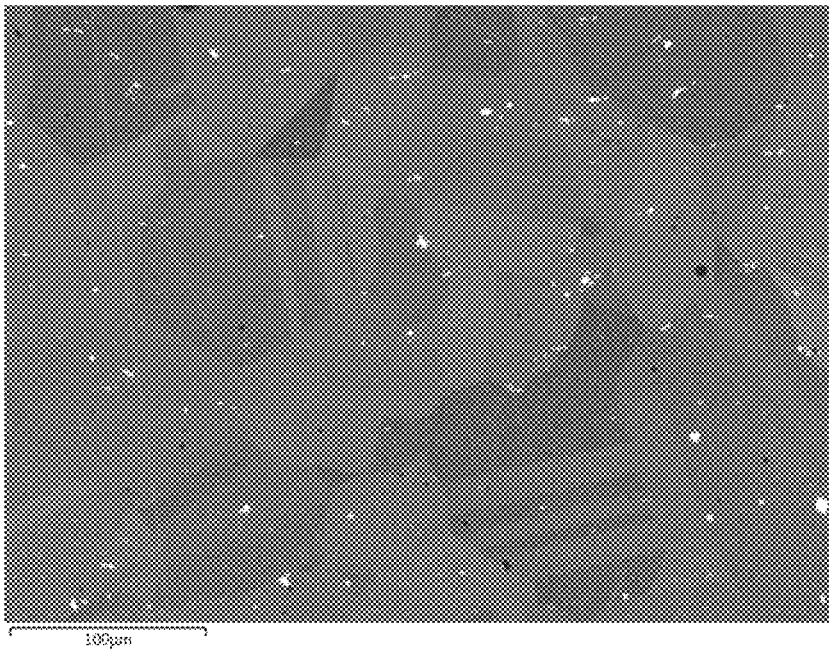
Figure 4:
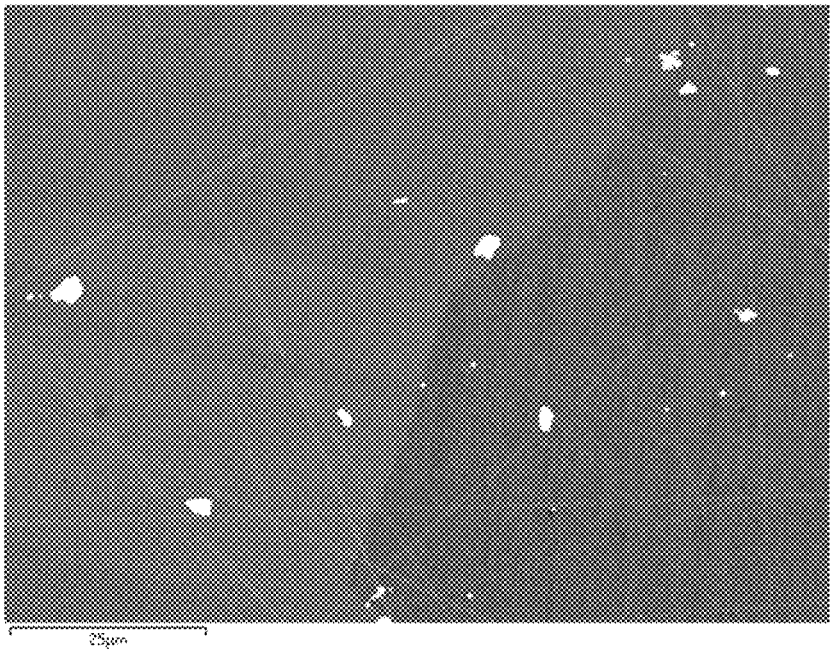
Figure 12:
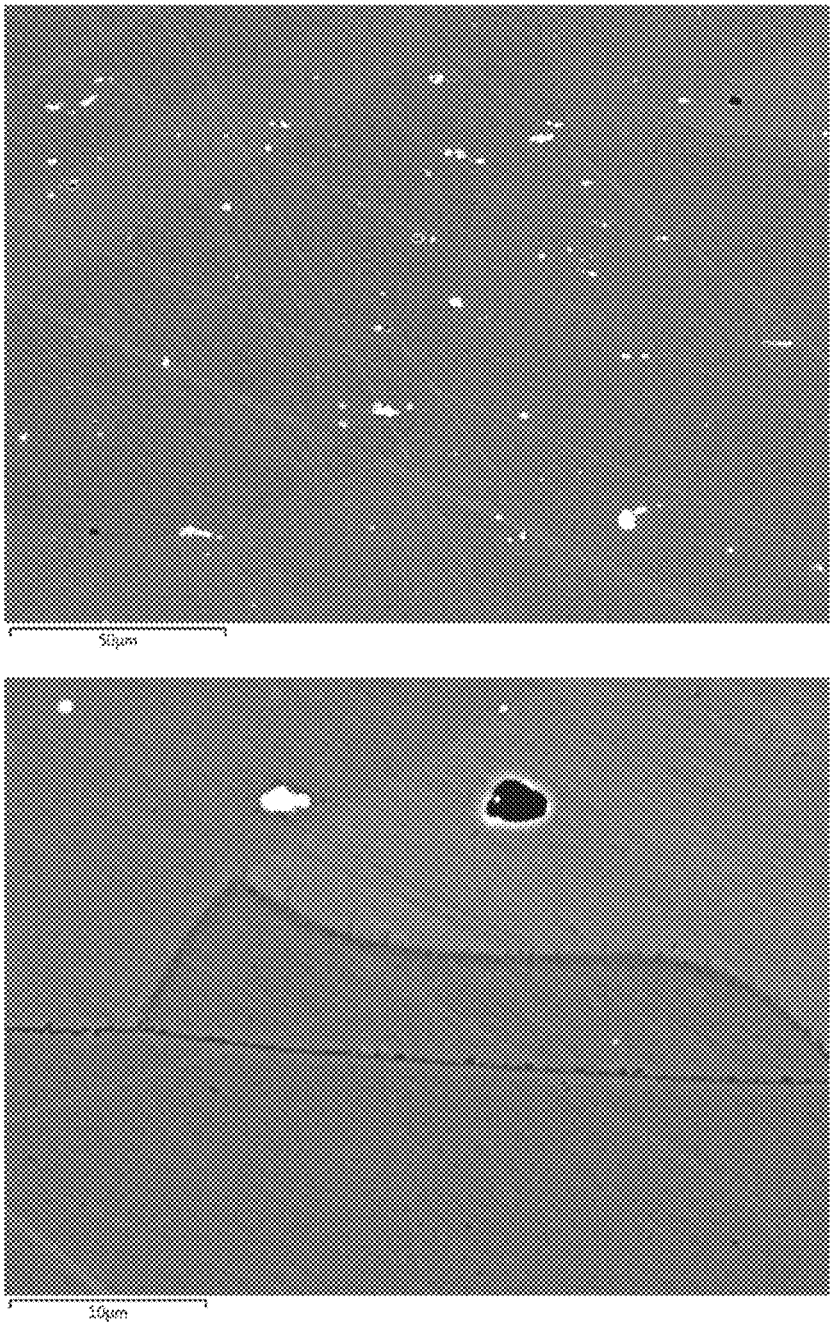
Figure 13:
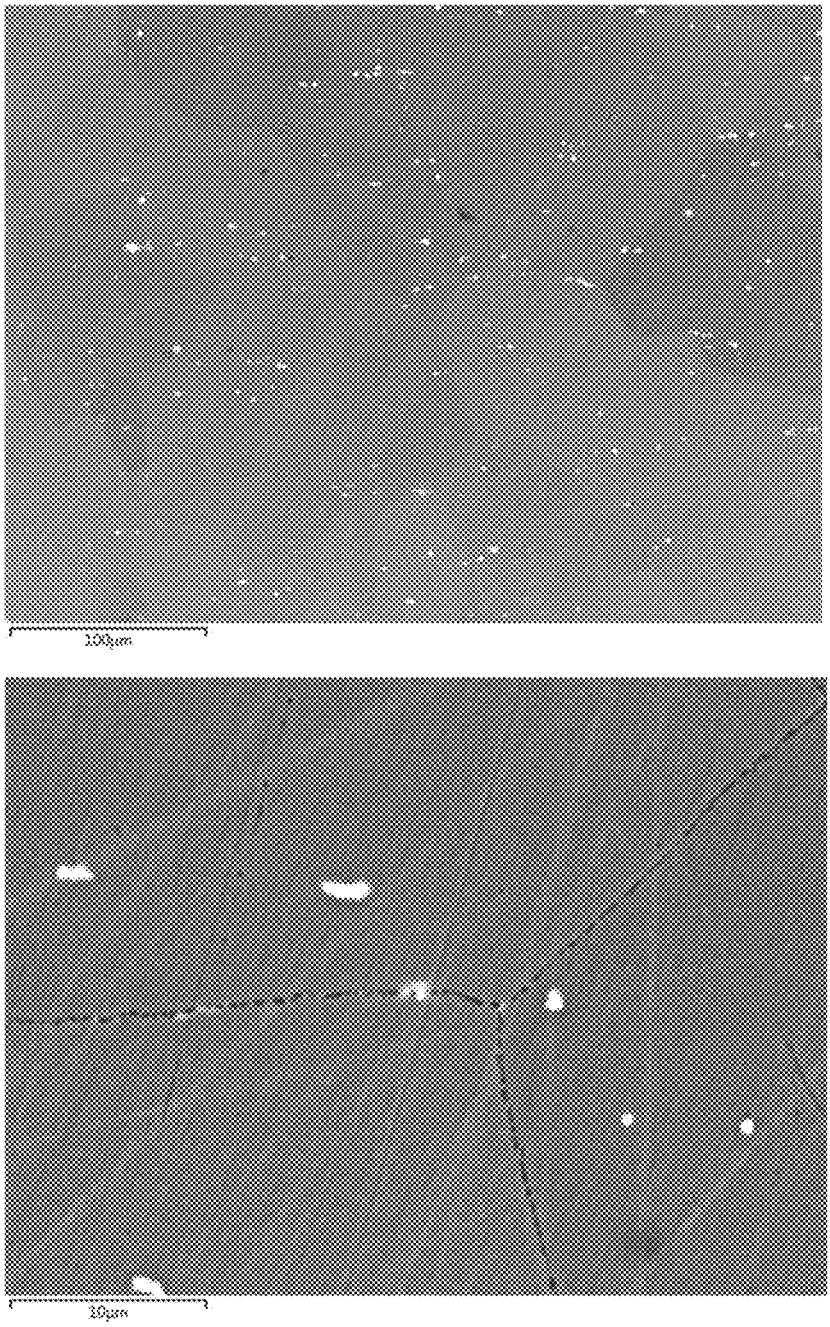
Figure 22:
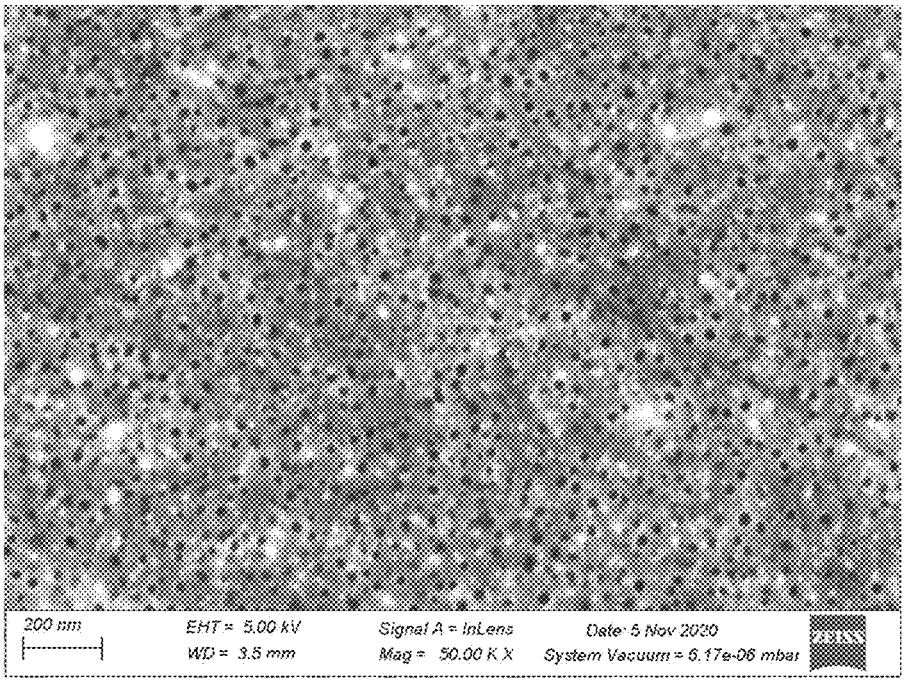
Figure 23:
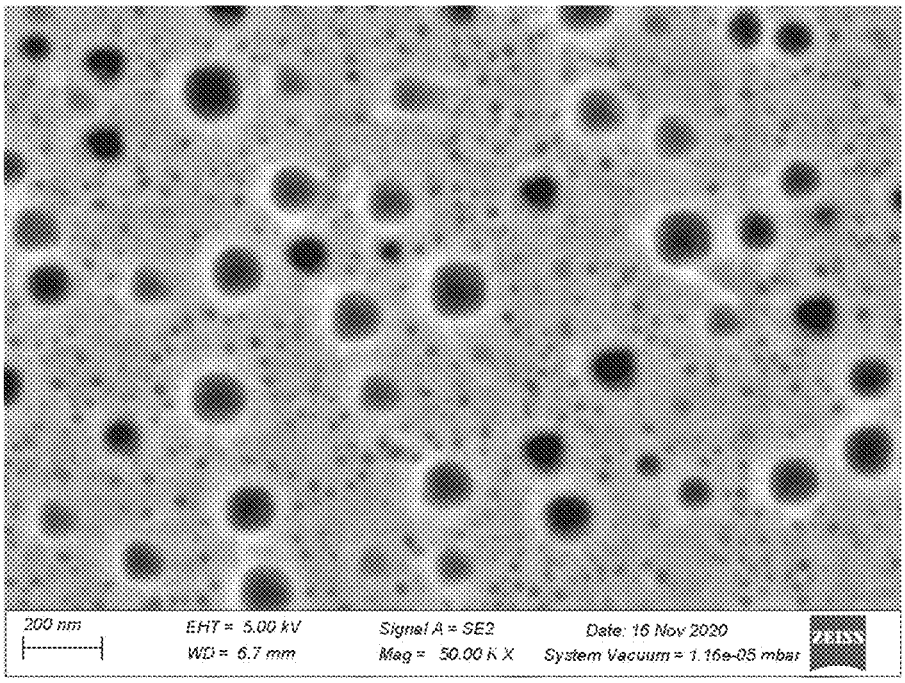
Figure 32:
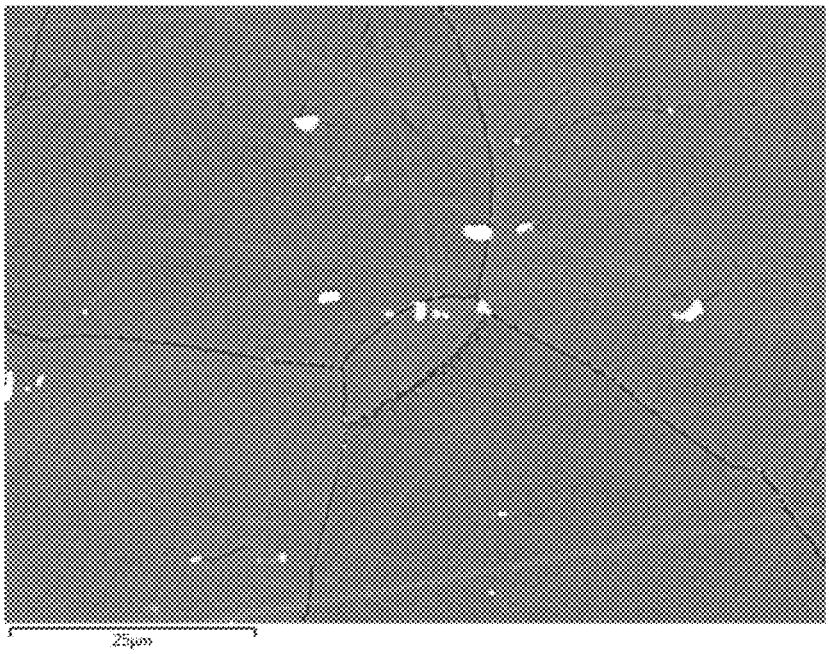
Figure 33:
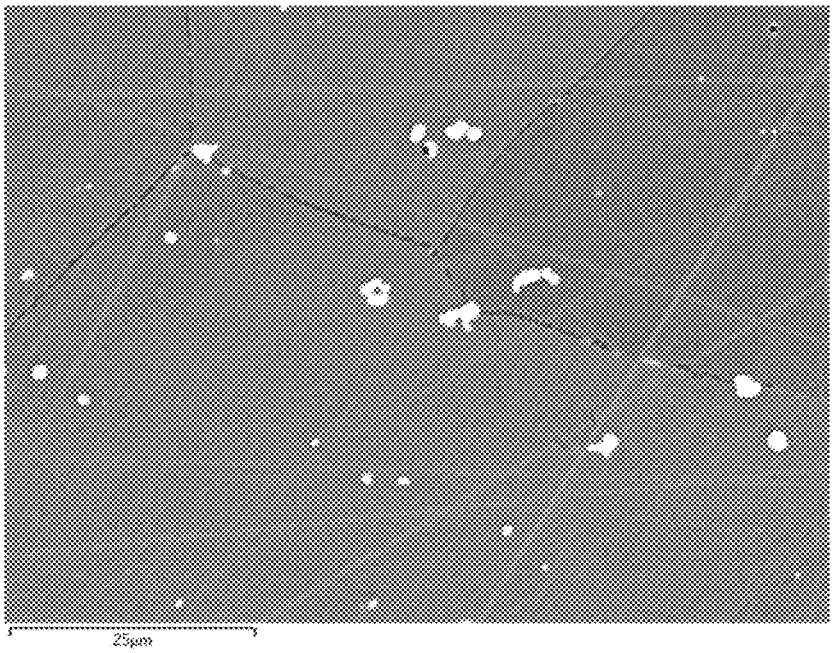
Figure 42:
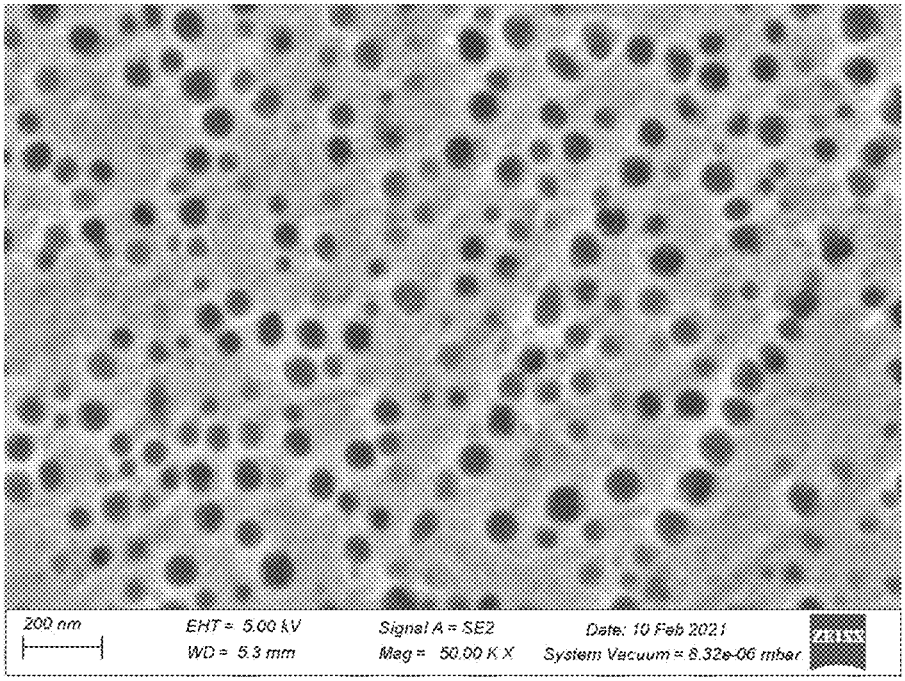
Figure 43:
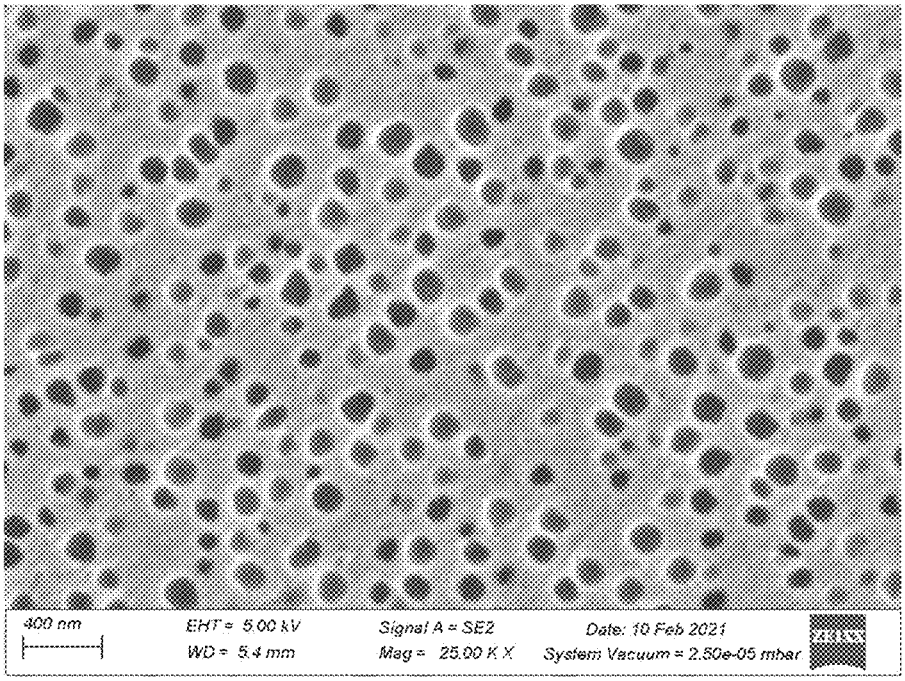

Experimental alloy Heat C is shown in the cold rolled and annealed condition in FIG. 4, in an aged condition (single-step aging of Track 2) in FIGS. 12 and 22, in an aged condition (two-step aging of Track 3) in FIGS. 13 and 23, in an overaged condition (aging and overaging steps of Track 2) in FIGS. 32 and 42, and in an overaged condition (aging and overaging steps of Track 3) in FIGS. 33 and 43.

Figure 5:
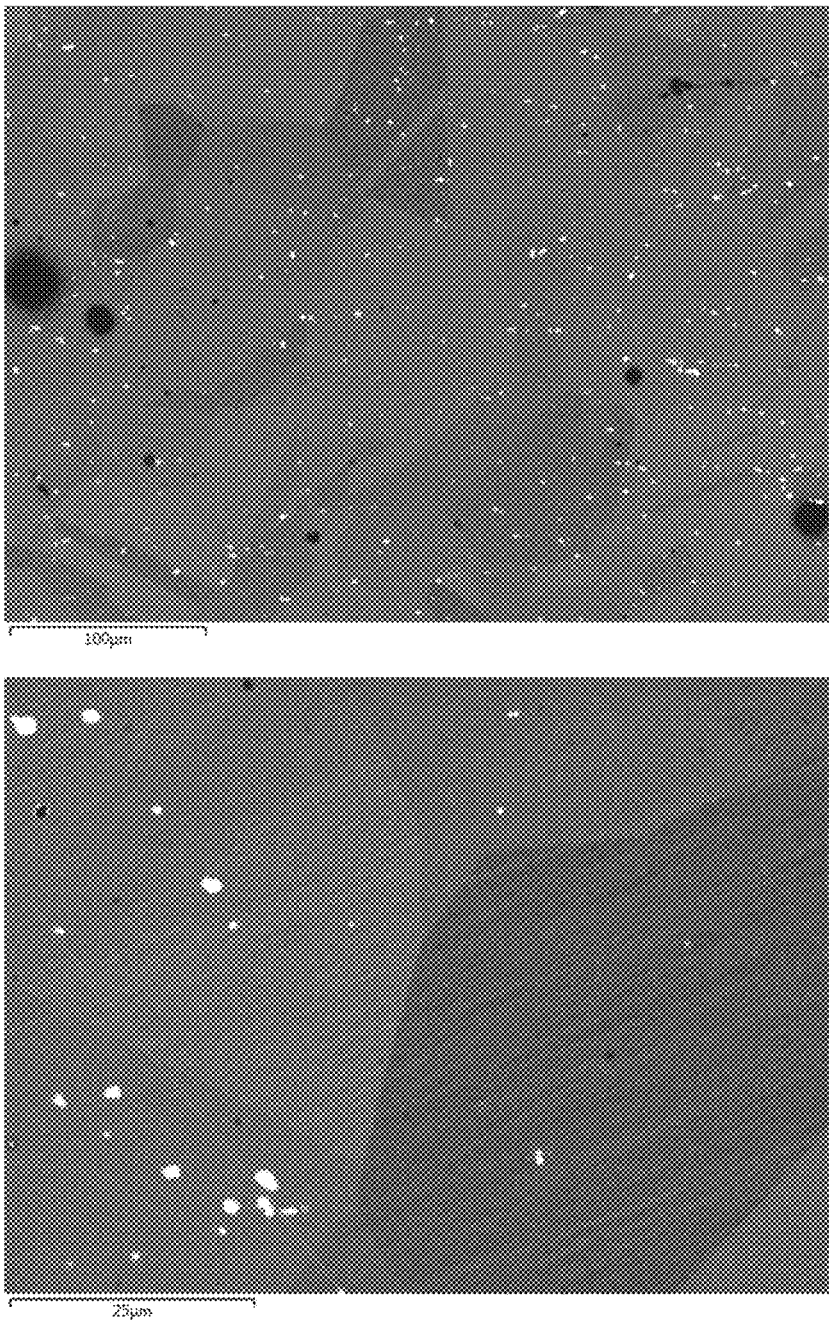
Figure 14:
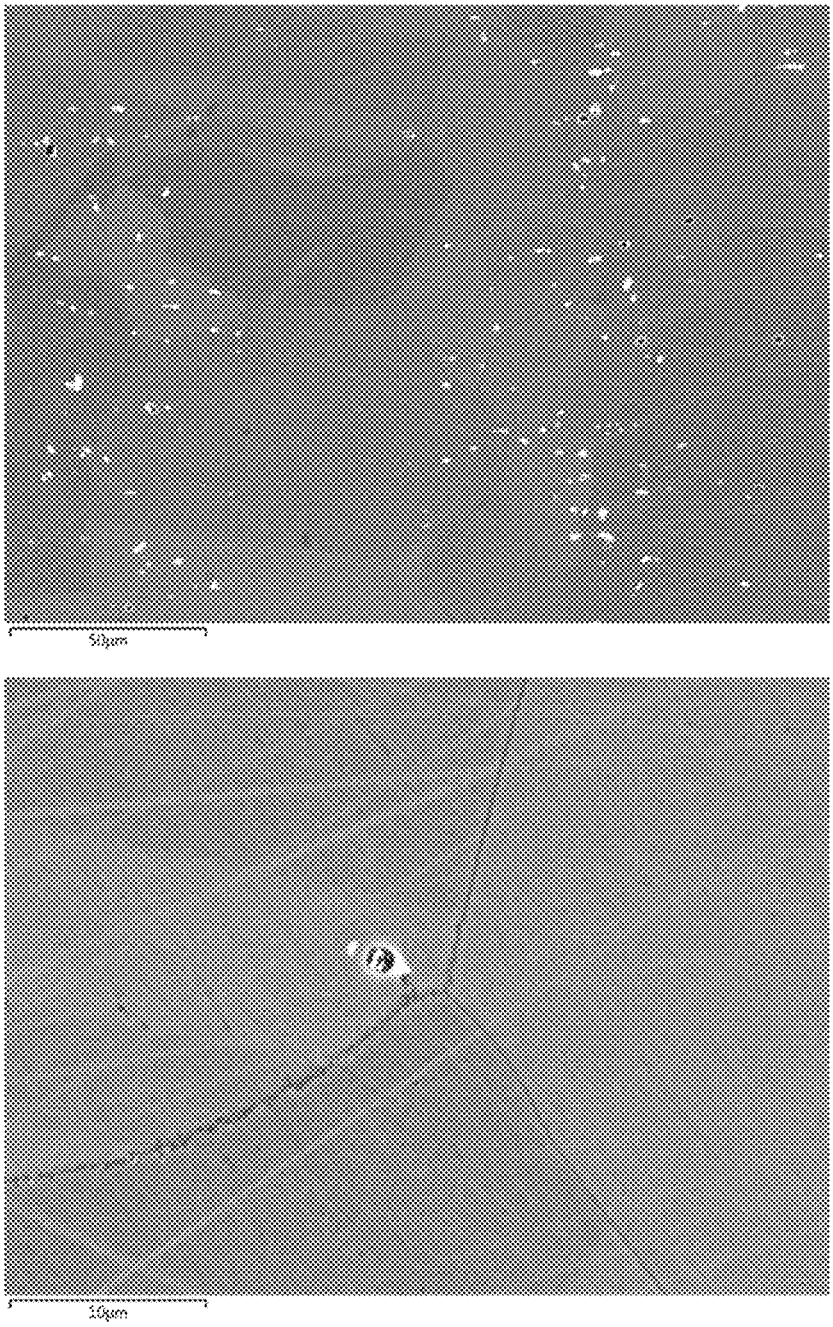
Figure 15:
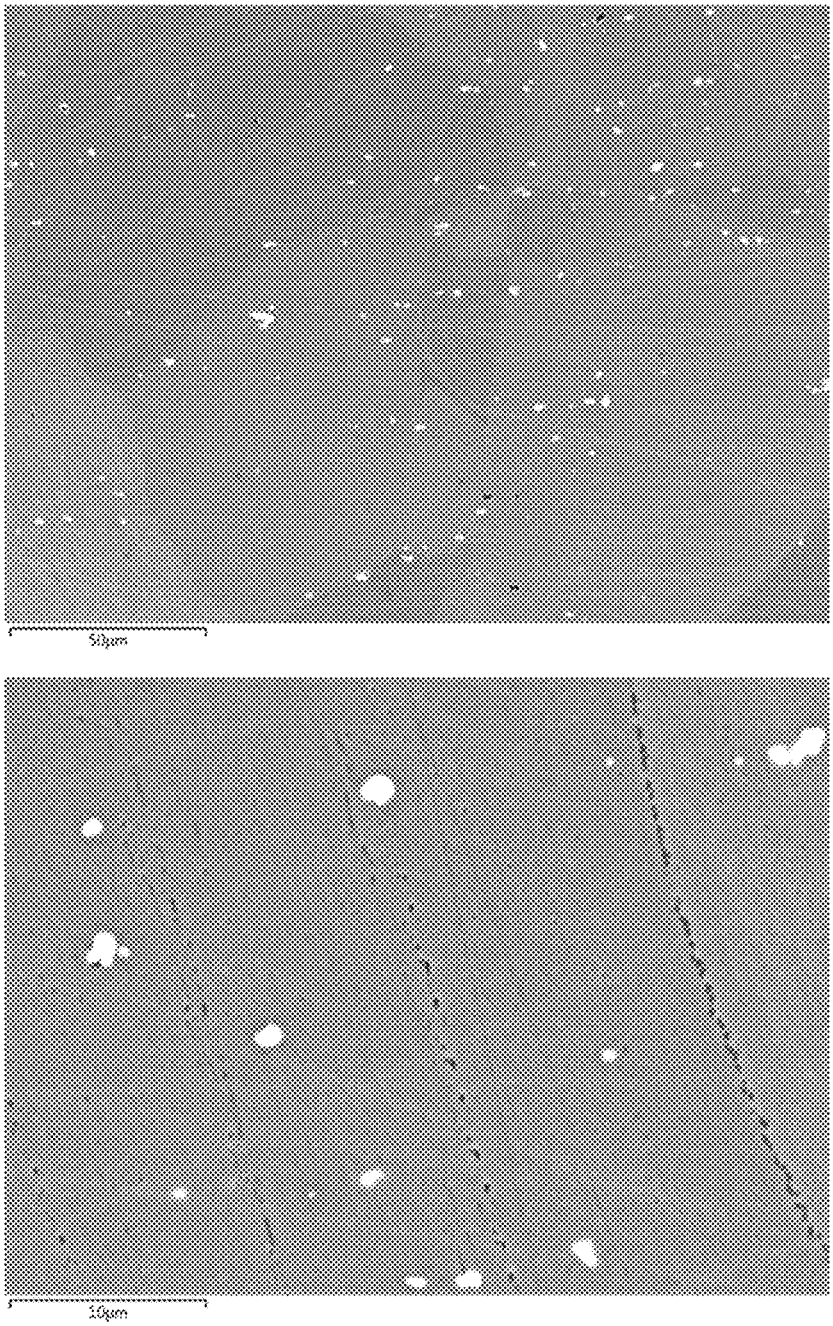
Figure 24:
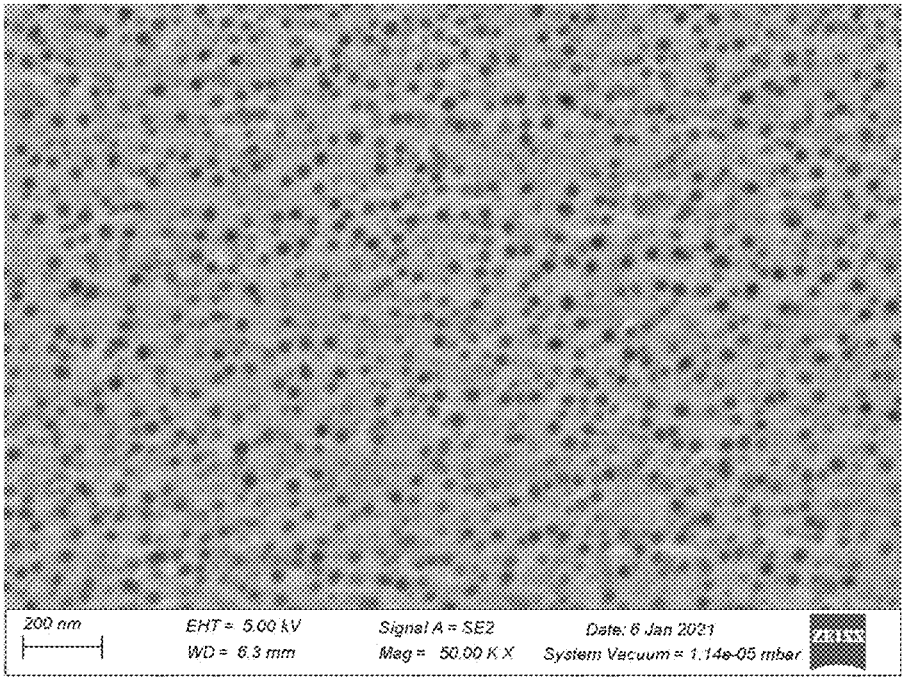
Figure 25:
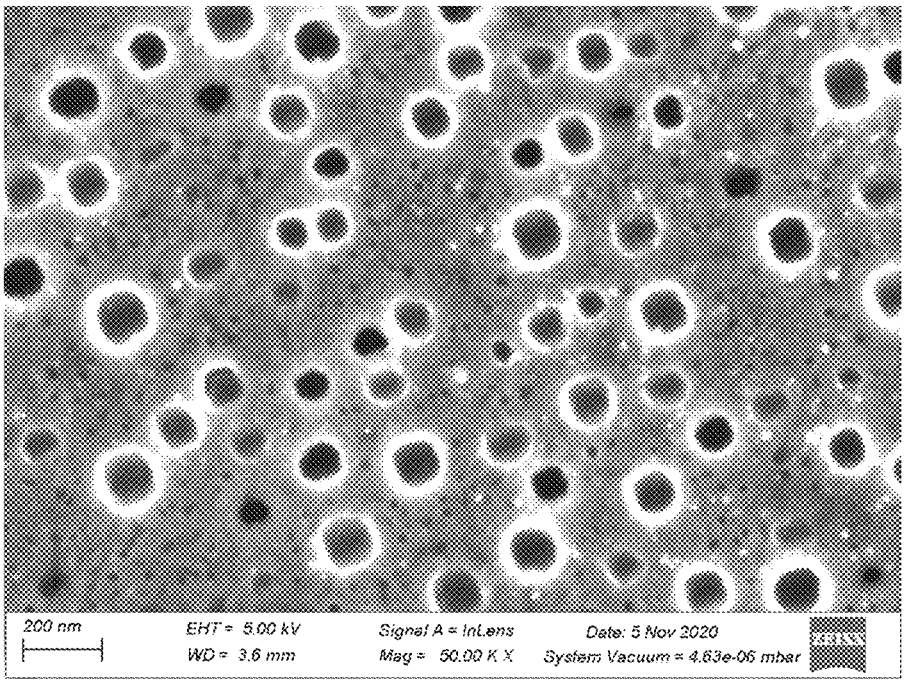
Figure 34:
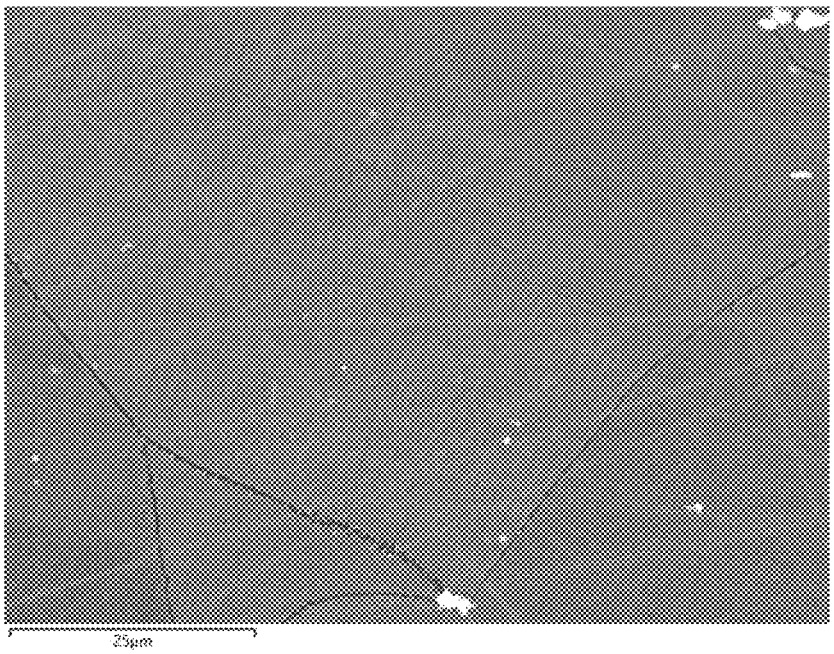
Figure 35:
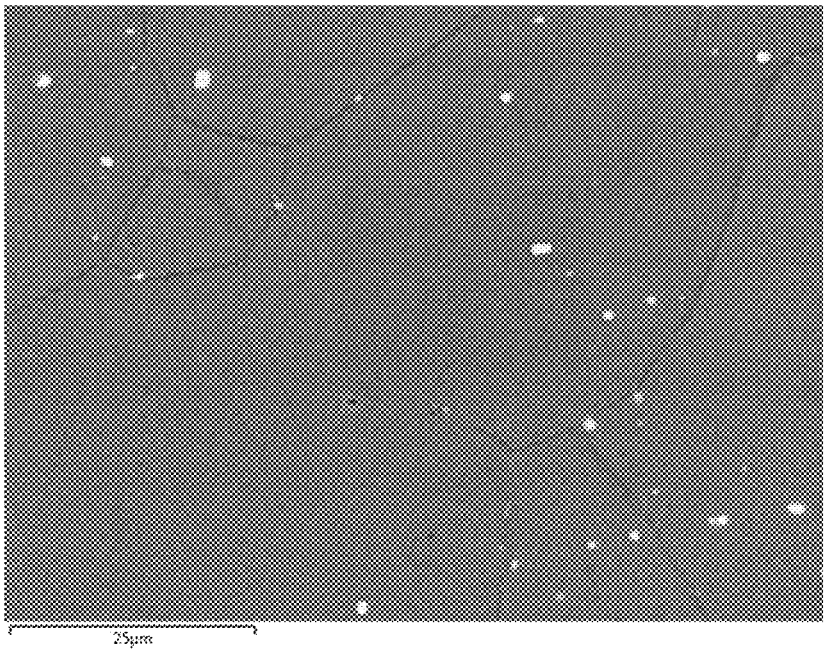
Figure 44:
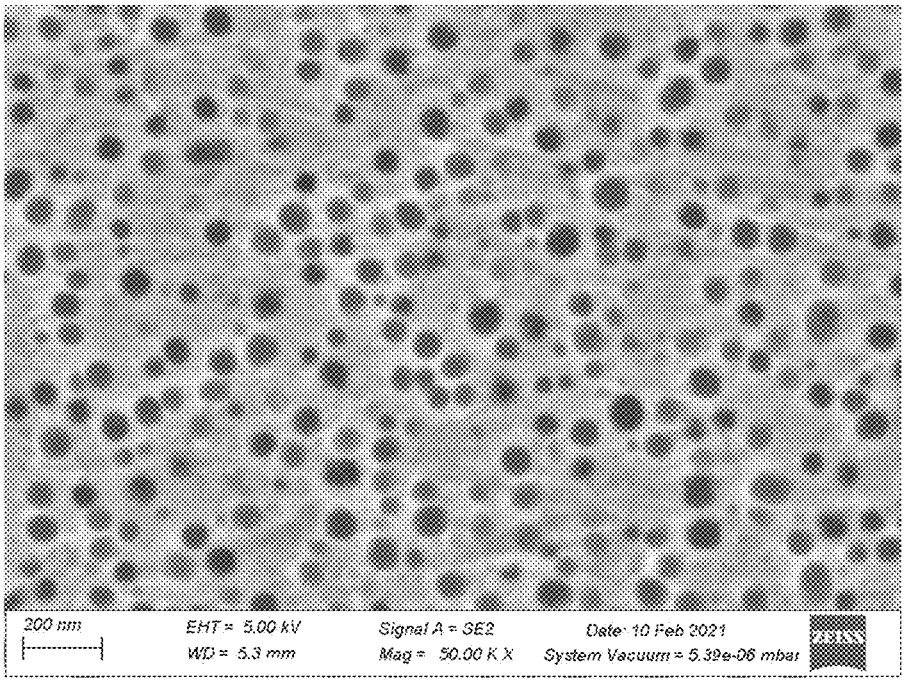
Figure 45:
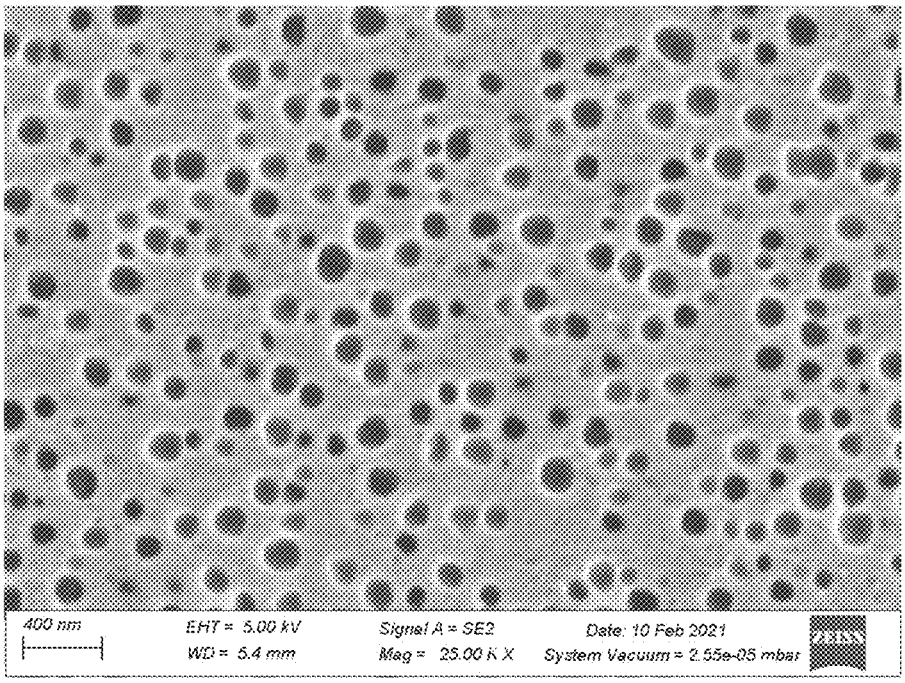

Experimental alloy Heat D is shown in the cold rolled and annealed condition in FIG. 5, in an aged condition (single-step aging of Track 2) in FIGS. 14 and 24, in an aged condition (two-step aging of track 3) in FIGS. 15 and 25, in an overaged condition (aging and overaging steps of Track 2) in FIGS. 34 and 44, and in an overaged condition (aging and overaging steps of Track 3) in FIGS. 35 and 45.

Based on the SEM characterizations, it was observed that the alloy of heats A-D exhibited reduced secondary carbide formation compared to the comparative alloy heat.

The dark features appearing in the SEM images of the comparative alloy heat shown in FIG. 1, were determined to predominantly be titanium and molybdenum primary carbides. The bright features appearing in the SEM images of Experimental Heats A-D shown in FIGS. 2, 3, 4, and 5 were determined to be predominantly tantalum, titanium, and molybdenum primary carbides, and the dark features in those images were determined to be oxides, holes from polishing, or surface contamination. This confirms that the addition of tantalum resulted in the formation of tantalum primary carbides in the experimental heats.

The dark features appearing in the SEM images of the comparative alloy heat shown in FIG. 6 were determined to be primarily titanium and molybdenum carbides, and the "needle-like" phases in that image were determined to be chromium rich secondary carbides. The bright features appearing in the SEM images of experimental Heats A-D shown in FIGS. 8, 10, 12, and 14 were determined to be predominantly tantalum, titanium, and molybdenum primary carbides, and limited secondary chromium rich secondary carbide precipitation along the grain boundaries also is visible. This confirms that the addition of tantalum can inhibit secondary carbide formation in the experimental heats.

The dark features appearing in the SEM image of the comparative alloy heat shown in FIG. 7 were determined to be primarily titanium and molybdenum carbides, and the extensive "needle-like" phases in the image were determined to be chromium rich secondary carbides. The bright features appearing in the SEM images of experimental Heats A-D shown in FIGS. 9, 11, 13, and 15 were determined to be predominantly tantalum, titanium, and molybdenum primary carbides, and limited secondary chromium rich secondary carbide precipitation along the grain boundaries also is visible and is more discretely formed. This confirms that the addition of tantalum can inhibit secondary carbide formation.

The SEM images shown in FIGS. 16 and 17 show γ'-phase distribution in the comparative alloy heat in the aged condition. The dark particles in those images are γ'-phase. Referring to FIG. 17, the larger dark particles may have formed during the high temperature aging step, and smaller dark particles may have formed during the low temperature aging step. The SEM images shown in FIGS. 18-25 illustrate γ'-phase distribution in experimental Heats A-D, respectively, in the aged condition. The images in FIGS. 18-20 and 23-24 were captured with a secondary electron detector, while the images in FIGS. 21-22 and 25 were taken with an in-lens (i.e., immersion lens) detector. Therefore, the contrast differs between those images.

The SEM images in FIGS. 26 and 27 illustrate extensive grain boundary precipitation of chromium rich secondary carbides along with intragranular precipitation of chromium rich secondary carbides in the comparative alloy heat in the overaged condition.

The SEM images in FIGS. 28-35 illustrate limited chromium rich secondary carbide formation in experimental Heats A-D in the overaged condition. This confirms that tantalum can inhibit secondary carbide formation. It is believed that the addition of niobium would similarly inhibit secondary carbide formation in the alloy.

The SEM images in FIGS. 36 and 37 illustrate γ'-phase distribution in the comparative alloy heat in the overaged condition. The dark particles in those images are the γ'-phase in the alloy.

The SEM images in FIGS. 38-45 illustrate γ'-phase distribution in experimental Heats A-D in the overaged condition.

Oxidation resistance of samples of the experimental alloy heats and commercial UNS N07208 alloy was evaluated. Resistance to oxidation at 1800° F. (982° C.) furnace temperature in flowing dry laboratory ambient air was determined. All samples were prepared with a 400 grit finish prior to oxidation testing. Samples were placed in the furnace for 144 hours, then removed from the furnace and air cooled to room temperature. The total mass of all samples was measured after every 144-hour cycle. Seven 144-hour cycles were run in total. The cycle at which mass gain transitioned to mass loss, indicating spallation of the oxide layer, was measured for all experimental alloy heat samples and for the commercial UNS 07208 alloy samples. All samples were tested in the heat-treated condition. Table 11 lists the average cycle number for three samples of each alloy at which the mass gain to mass loss transition occurred. In the case that only one or two reached test runout without mass loss, the no mass loss samples were treated as having gone 7 cycles before transitioning to mass loss. As shown in Table 11, all but one of the experimental alloys exhibited superior oxidation resistance relative to the UNS N07208 samples.

TABLE 11

Oxidation Resistance

| Alloy/Heat | Average Number of Cycles Before Mass Loss |
|---|---|
| Commercial UNS N07208 | 1.3 |
| A | No mass loss |
| B | 6.3 |
| C | 4 |
| D | 2.7 |
| E | No mass loss |
| F | 6 |
| G | 1.3 |
| H | No mass loss |
| I | 6.7 |
| J | No mass loss |
| K | 6.7 |
| L | 2.7 |

TABLE 11-continued

Oxidation Resistance

| Alloy/Heat | Average Number of Cycles Before Mass Loss |
|---|---|
| M | 1.7 |
| N | 3.7 |
| O | 6.7 |

The present inventor considers the combinations of mechanical property threshold values listed in Table 7 to be preferred, more preferred, and most preferred for particular applications in which an alloy according to the present disclosure may be used. However, it will be understood that the scope of the present disclosure is not necessarily limited to alloys exhibiting the mechanical properties values listed in Table 12. The properties combination provided in Table 12 are directed to non-limiting examples of commercially useful alloys included within the scope of the present disclosure.

TABLE 12

Alloy Properties

| Property | Preferred Properties | More Preferred Properties | Even More Preferred Properties |
|---|---|---|---|
| Annealed Sample Room Temp. Yield Strength (ksi) | <91 | <86 | <81 |
| 1500° F. (816° C.) CHRT Ductility (% reduction in area) | >7 | >8 | >10 |
| 1500° F. (816° C.)/ 35 ksi (241.3 MPa) Stress Rupture life (hr) | >100 | >140 | >180 |
| 1700° F. (927° C.)/ 13 ksi (89.6 MPa) Stress Rupture life (hr) | >40 | >60 | >80 |
| Aged[a] Sample Room Temp. Yield Strength (ksi) | >85 | >90 | >95 |
| Overaged[b] Sample Room Temp. Elongation (%) | >15 | >18 | >20 |

[a]Aged as per Track 1 steps
[b]Aged as per Track 1 steps, followed by 1400° F. (760° C.) for 1000 hours One non-limiting embodiment of an alloy according to the present disclosure comprises the various elemental contents listed in Table 13. It will be understood that the scope of the present disclosure is not necessarily limited to alloys comprising the elemental contents listed in Table 13.

TABLE 13

Elemental Chemistry

| | Chemistry Ranges (wt %) | | | | | | | | |
|---|---|---|---|---|---|---|---|---|---|
| | Co | Mo | W | Al | Ti | Nb | Ta | Fe | Cr |
| Min | 5 | 4 | 0 | 1.6 | 0.3 | 0 | 1.5 | 0 | 16 |
| Max | 20 | 10 | 5 | 3 | 1.5 | 1.2 | 4 | 5 | 23 |

In certain non-limiting embodiments of the alloy composition of Table 13, the alloy exhibits the "Preferred Properties" listed in Table 12. In certain non-limiting embodiments of the alloy composition of Table 13, the alloy composition satisfies one or more of the following chemistry limitations:

$$2.5<\{[Al]+0.56\times[Ti]+0.29\times[Nb]+0.15\times[Ta]\}<3.4$$

$$5<\{[Mo]+0.52\times[W]\}<10$$

$$0.8\leq\{[Nb]+0.51\times[Ta]\}\leq2.4$$

Another non-limiting embodiment of an alloy according to the present disclosure comprises the various elemental contents listed in Table 14. It will be understood that the scope of the present disclosure is not necessarily limited to alloys comprising the elemental contents listed in Table 14.

TABLE 14

| | Elemental Chemistry | | | | | | | | |
|---|---|---|---|---|---|---|---|---|---|
| | Chemistry Ranges (wt %) | | | | | | | | |
| | Co | Mo | W | Al | Ti | Nb | Ta | Fe | Cr |
| Min | 6 | 5 | 0 | 1.6 | 0.4 | 0 | 1.6 | 0 | 17 |
| Max | 19 | 10 | 3 | 2.7 | 1.4 | 0.9 | 3 | 3 | 21 |

In certain non-limiting embodiments of the alloy composition of Table 14, the alloy exhibits the "More Preferred Properties" listed in Table 12. In certain non-limiting embodiments of the alloy composition of Table 14, the alloy composition satisfies one or more of the following chemistry limitations:

$$2.6<\{[Al]+0.56\times[Ti]+0.29\times[Nb]+0.15\times[Ta]\}<3.3$$

$$6<\{[Mo]+0.52\times[W]\}<10$$

$$0.8\leq\{[Nb]+0.51\times[Ta]\}\leq1.7$$

A further another non-limiting embodiment of an alloy according to the present disclosure comprises the various elemental contents listed in Table 15. It will be understood that the scope of the present disclosure is not necessarily limited to alloys comprising the elemental contents listed in Table 15.

TABLE 15

| | Elemental Chemistry | | | | | | | | |
|---|---|---|---|---|---|---|---|---|---|
| | Chemistry Ranges (wt %) | | | | | | | | |
| | Co | Mo | W | Al | Ti | Nb | Ta | Fe | Cr |
| Min | 7 | 6 | 0 | 1.7 | 0.5 | 0 | 1.7 | 0 | 17 |
| Max | 18 | 9.5 | 1 | 2.4 | 1.3 | 0.5 | 2.9 | 1.5 | 21 |

In certain non-limiting embodiments of the alloy composition of Table 15, the alloy exhibits the "Even More Preferred Properties" listed in Table 12. In certain non-limiting embodiments of the alloy composition of Table 15, the alloy composition satisfies one or more of the following chemistry limitations:

$$2.7<\{[Al]+0.56\times[Ti]+0.29\times[Nb]+0.15\times[Ta]\}<3.3$$

$$6<\{[Mo]+0.52\times[W]\}<9.5$$

$$0.8\leq\{[Nb]+0.51\times[Ta]\}\leq1.5$$

The following numbered clauses are directed to various non-limiting embodiments according to the present disclosure:

Clause 1. A nickel-base alloy comprising, in weight percentages based on total weight of the nickel-base alloy:
1.6% to 3.0% aluminum;
0.3% to 1.5% titanium;
1.5% to 4% tantalum;
nickel; and
impurities.

Clause 2. The nickel-base alloy of clause 1, comprising 1.6% to 2.7% aluminum, in weight percentages based on total weight of the nickel-base alloy.

Clause 3. The nickel-base alloy of clause 1, comprising 1.7% to 2.4% aluminum, in weight percentages based on total weight of the nickel-base alloy.

Clause 4. The nickel-base alloy of any of clauses 1-3, comprising 0.4% to 1.4% titanium, in weight percentages based on total weight of the nickel-base alloy.

Clause 5. The nickel-base alloy of any of clauses 1-3, comprising 0.5% to 1.3% titanium, in weight percentages based on total weight of the nickel-base alloy.

Clause 6. The nickel-base alloy of any of clauses 1-5, comprising 1.6% to 3% tantalum, in weight percentages based on total weight of the nickel-base alloy.

Clause 7. The nickel-base alloy of any of clauses 1-5, comprising 1.7% to 2.9% tantalum, in weight percentages base on total weight of the nickel-base alloy.

Clause 8. The nickel-base alloy of clause 1, comprising, in weight percentages based on total weight of the nickel-base alloy:
1.6% to 3% aluminum;
0.3% to 1.5% titanium;
1.5% to 4% tantalum;
16% to 23% chromium;
5% to 20% cobalt;
4% to 10% molybdenum;
0 to 5% tungsten;
nickel; and
impurities.

Clause 9. The nickel-base alloy of clause 1, comprising, in weight percentages based on total weight of the nickel-base alloy:
1.6% to 3% aluminum;
0.3% to 1.5% titanium;
1.5% to 4% tantalum;
16% to 23% chromium;
5% to 20% cobalt;
4% to 10% molybdenum;
0 to 5% tungsten;
0 to 1.2% niobium;
0 to 0.5% carbon;
0 to 0.1% boron;
0 to 5% iron;
0 to 2% manganese;
0 to 2% vanadium;
0 to 2% copper;
0 to 1% silicon;
0 to 1% zirconium;
0 to 1% hafnium;
0 to 1% rhenium;
a total of 0 to 1% of rare earth elements;
nickel; and
impurities.

Clause 10. The nickel-base alloy of clause 1, comprising, in weight percentages based on total weight of the nickel-base alloy:

1.6% to 2.7% aluminum;
0.4% to 1.4% titanium;
1.6% to 3% tantalum;
17% to 21% chromium;
6% to 19% cobalt;
5% to 10% molybdenum;
0 to 3% tungsten;
nickel; and
impurities.

Clause 11. The nickel-base alloy of clause 1, comprising, in weight percentages based on total weight of the nickel-base alloy:

1.6% to 2.7% aluminum;
0.4% to 1.4% titanium;
1.6% to 3% tantalum;
17% to 21% chromium;
6% to 19% cobalt;
5% to 10% molybdenum;
0 to 3% tungsten;
0 to 0.9% niobium;
0 to 0.2% carbon;
0 to 0.05% boron;
0 to 3% iron;
0 to 2% manganese;
0 to 2% vanadium;
0 to 2% copper;
0 to 1% silicon;
0 to 1% zirconium;
0 to 1% hafnium;
0 to 1% rhenium;
a total of 0 to 1% of rare earth elements;
titanium; and
impurities.

Clause 12. The nickel-base alloy of clause 1, comprising, in weight percentages based on total weight of the nickel-base alloy:

1.7% to 2.4% aluminum;
0.5% to 1.3% titanium;
1.7% to 2.9% tantalum;
17% to 21% chromium;
7% to 18% cobalt;
6% to 9.5% molybdenum;
0 to 1% tungsten;
nickel; and
impurities.

Clause 13. The nickel-base alloy of clause 1, comprising, in weight percentages based on total weight of the nickel-base alloy:

1.7% to 2.4% aluminum;
0.5% to 1.3% titanium;
1.7% to 2.9% tantalum;
17% to 21% chromium;
7% to 18% cobalt;
6% to 9.5% molybdenum;
0 to 1% tungsten;
0 to 0.5% niobium;
0 to 0.2% carbon;
0 to 0.05% boron;
0 to 1.5% iron;
0 to 2% manganese;
0 to 2% vanadium;
0 to 2% copper;
0 to 1% silicon;
0 to 1% zirconium;
0 to 1% hafnium;
0 to 1% rhenium;
a total of 0 to 1% of rare earth elements;
titanium; and
impurities.

Clause 14. A nickel-base alloy, consisting of, in weight percentages based on total weight of the nickel-base alloy:

1.6% to 3% aluminum;
0.3% to 1.5% titanium;
1.5% to 4% tantalum;
16% to 23% chromium;
5% to 20% cobalt;
4% to 10% molybdenum;
0 to 5% tungsten;
0 to 1.2% niobium;
0 to 0.5% carbon;
0 to 0.1% boron;
0 to 5% iron;
0 to 2% manganese;
0 to 2% vanadium;
0 to 2% copper;
0 to 1% silicon;
0 to 1% zirconium;
0 to 1% hafnium;
0 to 1% rhenium;
a total of 0 to 1% of rare earth elements;
nickel; and
impurities.

Clause 15. A nickel-base alloy consisting of, in weight percentages based on total weight of the nickel-base alloy:

1.6% to 2.7% aluminum;
0.4% to 1.4% titanium;
1.6% to 3% tantalum;
17% to 21% chromium;
6% to 19% cobalt;
5% to 10% molybdenum;
0 to 3% tungsten;
0 to 0.9% niobium;
0 to 0.2% carbon;
0 to 0.05% boron;
0 to 3% iron;
0 to 2% manganese;
0 to 2% vanadium;
0 to 2% copper;
0 to 1% silicon;
0 to 1% zirconium;
0 to 1% hafnium;
0 to 1% rhenium;
a total of 0 to 1% of rare earth elements;
titanium; and
impurities.

Clause 16. A nickel-base alloy consisting of, in weight percentages based on total weight of the nickel-base alloy:

1.7% to 2.4% aluminum;
0.5% to 1.3% titanium;
1.7% to 2.9% tantalum;
17% to 21% chromium;
7% to 18% cobalt;
6% to 9.5% molybdenum;
0 to 1% tungsten;
0 to 0.5% niobium;
0 to 0.2% carbon;
0 to 0.05% boron;
0 to 1.5% iron;
0 to 2% manganese;
0 to 2% vanadium;
0 to 2% copper;

0 to 1% silicon;
0 to 1% zirconium;
0 to 1% hafnium;
0 to 1% rhenium;
a total of 0 to 1% of rare earth elements;
titanium; and impurities.

Clause 17. The nickel-base alloy of any of clauses 1-9 and 14, provided that a composition of the nickel-base alloy satisfies the following equation, in weight percentage concentrations based on total weight of the nickel-base alloy:

$$2.5<\{[Al]+0.56\times[Ti]+0.29\times[Nb]+0.15\times[Ta]\}<3.4.$$

Clause 18. The nickel-base alloy of any of clauses 1-9 and 14, provided that a composition of the nickel-base alloy satisfies the following equation, in weight percentage concentrations based on total weight of the nickel-base alloy:

$$5\%<\{[Mo]+0.52\times[W]\}<10\%.$$

Clause 19. The nickel-base alloy of any of clauses 1-9 and 14, provided that a composition of the nickel-base alloy satisfies the following equation, in weight percentage concentrations based on total weight of the nickel-base alloy:

$$0.8\%<\{[Nb]+0.51\times[Ta]\}\leq 2.4\%.$$

Clause 20. The nickel-base alloy of any of clauses 1-11, 14, and 15, provided that a composition of the nickel-base alloy satisfies the following equation, in weight percentage concentrations based on total weight of the nickel-base alloy:

$$2.6<\{[Al]+0.56\times[Ti]+0.29\times[Nb]+0.15\times[Ta]\}<3.3.$$

Clause 21. The nickel-base alloy of any of clauses 1-11, 14, and 15, provided that a composition of the nickel-base alloy satisfies the following equation, in weight percentage concentrations based on total weight of the nickel-base alloy:

$$6\%<\{[Mo]+0.52\times[W]\}<9.5\%$$

Clause 22. The nickel-base alloy of any of clauses 1-11, 14, and 15 provided that a composition of the nickel-base alloy satisfies the following equation, in weight percentage concentrations based on total weight of the nickel-base alloy:

$$0.8\%<\{[Nb]+0.51\times[Ta]\}\leq 1.7\%.$$

Clause 23. The nickel-base alloy of any of clauses 1-16, provided that a composition of the nickel-base alloy satisfies the following equation, in weight percentage concentrations based on total weight of the nickel-base alloy:

$$2.7<\{[Al]+0.56\times[Ti]+0.29\times[Nb]+0.15\times[Ta]\}<3.3.$$

Clause 24. The nickel-base alloy of any of clauses 1-16, provided that a composition of the nickel-base alloy satisfies the following equation, in weight percentage concentrations based on total weight of the nickel-base alloy:

$$6\%<\{[Mo]+0.52\times[W]\}<9.5\%.$$

Clause 25. The nickel-base alloy of any of clauses 1-16, provided that a composition of the nickel-base alloy satisfies the following equation, in weight percentage concentrations based on total weight of the nickel-base alloy:

$$0.8\%<\{[Nb]+0.51\times[Ta]\}\leq 1.5\%.$$

Clause 26. A nickel-base alloy comprising, in weight percentages based on the total weight of the nickel-base alloy:
1.6% to 3.0% aluminum;
0.3% to 1.5% titanium;
1.5% to 4% tantalum;
0 to 1.2% niobium;
0 to 5% tungsten; and
nickel;
provided that a composition of the nickel-base alloy satisfies at least one of the following equations:

$$2.5<\{[Al]+0.56\times[Ti]+0.29\times[Nb]+0.15\times[Ta]\}<3.4$$

$$5<\{[Mo]+0.52\times[W]\}<10$$

$$0.8\leq\{[Nb]+0.51\times[Ta]\}\leq 2.4.$$

Clause 27. The nickel-base alloy of clause 26, comprising 1.6% to 2.7% aluminum, in weight percentages based on total weight of the nickel-base alloy.

Clause 28. The nickel-base alloy of clauses 26, comprising 1.7% to 2.4% aluminum, in weight percentages based on total weight of the nickel-base alloy.

Clause 29. The nickel-base alloy of any of clauses 26-28, comprising 0.4% to 1.4% titanium, in weight percentages based on total weight of the nickel-base alloy.

Clause 30. The nickel-base alloy of any of clauses 26-28, comprising 0.5% to 1.3% titanium, in weight percentages based on total weight of the nickel-base alloy.

Clause 31. The nickel-base alloy of any of clauses 26-30, comprising 1.6% to 3% tantalum, in weight percentages based on total weight of the nickel-base alloy.

Clause 32. The nickel-base alloy of any of clauses 26-30, comprising 1.7% to 2.9% tantalum, in weight percentages base on total weight of the nickel-base alloy.

Clause 33. The nickel-base alloy of any of clauses 26-30, provided that a composition of the nickel-base alloy satisfies the following equation, in weight percentage concentrations based on total weight of the nickel-base alloy:

$$2.6<\{[Al]+0.56\times[Ti]+0.29\times[Nb]+0.15\times[Ta]\}<3.3.$$

Clause 34. The nickel-base alloy of any of clauses 26-30, provided that a composition of the nickel-base alloy satisfies the following equation, in weight percentage concentrations based on total weight of the nickel-base alloy:

$$2.7<\{[Al]+0.56\times[Ti]+0.29\times[Nb]+0.15\times[Ta]\}<3.3.$$

Clause 35. A nickel-base alloy comprising, in weight percentages based on total weight of the nickel-base alloy:
1.6% to 3% aluminum;
0.3% to 1.5% titanium;
1.5% to 4% tantalum;
16% to 23% chromium;
5% to 20% cobalt;
4% to 10% molybdenum;
0 to 5% tungsten;
0 to 1.2% niobium;
0 to 0.5% carbon;
0 to 0.1% boron;
0 to 5% iron;
0 to 2% manganese;
0 to 2% vanadium;
0 to 2% copper;
0 to 1% silicon;
0 to 1% zirconium;
0 to 1% hafnium;
0 to 1% rhenium;
a total of 0 to 1% of rare earth elements; and
nickel;

provided that a composition of the nickel-base alloy satisfies the following equations:

$$2.5<\{[Al]+0.56\times[Ti]+0.29\times[Nb]+0.15\times[Ta]\}<3.4$$

$$5<\{[Mo]+0.52\times[W]\}<10$$

$$0.8\leq\{[Nb]+0.51\times[Ta]\}\leq2.4.$$

Clause 36. The nickel-base alloy of clause 35 comprising, in weight percentages based on total weight of the nickel-base alloy:

1.7% to 2.4% aluminum;
0.5% to 1.3% titanium;
1.7% to 2.9% tantalum;
17% to 21% chromium;
7% to 18% cobalt;
6% to 9.5% molybdenum;
0 to 1% tungsten;
0 to 0.5% niobium;
0 to 0.2% carbon;
0 to 0.05% boron;
0 to 1.5% iron;
0 to 2% manganese;
0 to 2% vanadium;
0 to 2% copper;
0 to 1% silicon;
0 to 1% zirconium;
0 to 1% hafnium;
0 to 1% rhenium;
a total of 0 to 1% of rare earth elements; and
titanium.

Clause 37. The nickel-base alloy of any of clauses 35 and 36, provided that a composition of the nickel-base alloy satisfies the following equations:

$$2.6<\{[Al]+0.56\times[Ti]+0.29\times[Nb]+0.15\times[Ta]\}<3.3$$

$$6<\{[Mo]+0.52\times[W]\}<10$$

$$0.8\leq\{[Nb]+0.51\times[Ta]\}\leq1.7.$$

Clause 38. The nickel-base alloy of any of clauses 35-37 comprising, in weight percentages based on total weight of the nickel-base alloy:

1.7% to 2.4% aluminum;
0.5% to 1.3% titanium;
1.7% to 2.9% tantalum;
17% to 21% chromium;
7% to 18% cobalt;
6% to 9.5% molybdenum;
0 to 1% tungsten;
0 to 0.5% niobium;
0 to 0.2% carbon;
0 to 0.05% boron;
0 to 1.5% iron;
0 to 2% manganese;
0 to 2% vanadium;
0 to 2% copper;
0 to 1% silicon;
0 to 1% zirconium;
0 to 1% hafnium;
0 to 1% rhenium;
a total of 0 to 1% of rare earth elements; and
titanium.

Clause 39. The nickel-base alloy of any of clauses 35-38, provided that a composition of the nickel-base alloy satisfies the following equations:

$$2.7<\{[Al]+0.56\times[Ti]+0.29\times[Nb]+0.15\times[Ta]\}<3.3$$

$$6<\{[Mo]+0.52\times[W]\}<9.5$$

$$0.8\leq\{[Nb]+0.51\times[Ta]\}\leq1.5.$$

Clause 40. The nickel-base alloy of any of clauses 1-39, provided that the nickel-base alloy exhibits a yield strength in an annealed state of less than 91 ksi (627.4 MPa) at room temperature.

Clause 41. The nickel-base alloy of any of clauses 1-39, provided that the nickel-base alloy exhibits a yield strength in an annealed state of less than 86 ksi (592.9 MPa) at room temperature.

Clause 42. The nickel-base alloy of any of clauses 1-39, provided that the nickel-base alloy exhibits a yield strength in an annealed state of less than 81 ksi (558.5 MPa) at room temperature.

Clause 43. The nickel-base alloy of any of clauses 1-42, provided that the nickel-base alloy exhibits a 1500° F. (816° C.) CHRT ductility (% reduction in area) greater than 7%.

Clause 44. The nickel-base alloy of any of clauses 1-42, provided that the nickel-base alloy exhibits a 1500° F. (816° C.) CHRT ductility (% reduction in area) greater than 8%.

Clause 45. The nickel-base alloy of any of clauses 1-42, provided that the nickel-base alloy exhibits a 1500° F. (816° C.) CHRT ductility (% reduction in area) greater than 10%.

Clause 46. The nickel-base alloy of any of clauses 1-45, provided that the nickel-base alloy exhibits a stress rupture life greater than 100 hours when tested at 1500° F. (816° C.) under stress of 35 ksi (241.3 MPa).

Clause 47. The nickel-base alloy of any of clauses 1-45, provided that the nickel-base alloy exhibits a stress rupture life greater than 140 hours when tested at 1500° F. (816° C.) under stress of 35 ksi (241.3 MPa).

Clause 48. The nickel-base alloy of any of clauses 1-45, provided that the nickel-base alloy exhibits a stress rupture life greater than 180 hours when tested at 1500° F. (816° C.) under stress of 35 ksi (241.3 MPa).

Clause 49. The nickel-base alloy of any of clauses 1-48, provided that the nickel-base alloy exhibits a stress rupture life greater than 40 hours when tested at 1700° F. (927° C.) under stress of 13 ksi (89.6 MPa).

Clause 50. The nickel-base alloy of any of clauses 1-48, provided that the nickel-base alloy exhibits a stress rupture life greater than 60 hours when tested at 1700° F. (927° C.) under stress of 13 ksi (89.6 MPa).

Clause 51. The nickel-base alloy of any of clauses 1-48, provided that the nickel-base alloy exhibits a stress rupture life greater than 80 hours when tested at 1700° F. (927° C.) under stress of 13 ksi (89.6 MPa).

Clause 52. The nickel-base alloy of any of clauses 1-51, provided that the nickel-base alloy exhibits a yield strength at room temperature greater than 85 ksi (586.1 MPa) in an aged condition, wherein aging involves maintaining the alloy at 1900° F. (1038° C.) for 2 hours, followed by maintaining the alloy 1450° F. (788° C.) for 16 hours.

Clause 53. The nickel-base alloy of any of clauses 1-51, provided that the nickel-base alloy exhibits a yield strength at room temperature greater than 90 ksi (620.5 MPa) in an aged condition, wherein aging involves maintaining the alloy at 1900° F. (1038° C.) for 2 hours, followed by maintaining the alloy 1450° F. (788° C.) for 16 hours.

Clause 54. The nickel-base alloy of any of clauses 1-51, provided that the nickel-base alloy exhibits a yield strength at room temperature greater than 95 ksi (655.0 MPa) in an aged condition, wherein aging involves maintaining the alloy at 1900° F. (1038° C.) for 2 hours, followed by maintaining the alloy 1450° F. (788° C.) for 16 hours.

Clause 55. The nickel-base alloy of any of clauses 1-53, provided that the nickel-base alloy exhibits a tensile elongation to failure greater than 15% in an overaged condition, wherein the overaged material has been aged at 1900° F. (1038° C.) for 2 hours, followed by 1450° F. (788° C.) for 16 hours, followed by overaging at 1400° F. (760° C.) for 1000 hours.

Clause 56. The nickel-base alloy of any of clauses 1-53, provided that the nickel-base alloy exhibits a tensile elongation to failure greater than 18% in an overaged condition, wherein the overaged material has been aged at 1900° F. (1038° C.) for 2 hours, followed by 1450° F. (788° C.) for 16 hours, followed by overaging at 1400° F. (760° C.) for 1000 hours.

Clause 57. The nickel-base alloy of any of clauses 1-53, provided that the nickel-base alloy exhibits a tensile elongation to failure greater than 20% in an overaged condition, wherein the overaged material has been aged at 1900° F. (1038° C.) for 2 hours, followed by 1450° F. (788° C.) for 16 hours, followed by overaging at 1400° F. (760° C.) for 1000 hours.

Embodiments of alloys according to the present disclosure might be produced in forms including, for example, foil, sheet, plate, wire, billet, slab, castings, powder, and other forms. Embodiments of alloys according to the present disclosure may have properties rendering them useful in applications including, for example, heat exchangers, gas turbine transition ducts, and additively manufactured parts.

One skilled in the art will recognize that the herein described alloys and methods, and the discussion accompanying them, are used as examples for the sake of conceptual clarity and that various modifications are contemplated. Consequently, as used herein, the specific examples/embodiments set forth and the accompanying discussion are intended to be representative of their more general classes. In general, use of any specific exemplar is intended to be representative of its class and should not be taken as limiting. While the present disclosure provides descriptions of various specific embodiments for the purpose of illustrating various aspects of the present disclosure and/or its potential applications, it is understood that variations and modifications will occur to those skilled in the art. Accordingly, the invention or inventions described herein should be understood to be at least as broad as they are claimed and not as more narrowly defined by particular examples and illustrative embodiments provided herein.

What is claimed is:

1. A nickel-base alloy comprising, in weight percentages based on total weight of the nickel-base alloy:
1.6% to 2.5% aluminum;
0.5% to 1.3% titanium;
2.2% to 4% tantalum;
greater than 6% to 9.5% molybdenum;
greater than 0 to less than 0.5% tungsten;
7% to 15% cobalt;
18% to 21% chromium;
0 to less than 0.5% niobium;
greater than 0 to 2% manganese;
greater than 0 to 0.5% silicon;
0 to 0.05% boron; and
nickel;
wherein the nickel-base alloy exhibits a stress rupture life greater than 140 hours when tested at 1500° F. (816° C.) under stress of 35 ksi (241.3 MPa).

2. The nickel-base alloy of claim 1, comprising 1.7% to 2.4% aluminum, in weight percentages based on total weight of the nickel-base alloy.

3. The nickel-base alloy of claim 1, comprising 2.2% to 3% tantalum, in weight percentages based on total weight of the nickel-base alloy.

4. The nickel-base alloy of claim 1, comprising 2.2% to 2.9% tantalum, in weight percentages based on total weight of the nickel-base alloy.

5. The nickel-base alloy of claim 1, comprising, in weight percentages based on total weight of the nickel-base alloy:
1.6% to 2.5% aluminum;
0.5% to 1.3% titanium;
2.2% to 4% tantalum;
18% to 21% chromium;
7% to 15% cobalt;
greater than 6% to 9.5% molybdenum;
greater than 0 to less than 0.5% tungsten;
0 to less than 0.5% niobium;
0 to 0.5% carbon;
0 to 0.05% boron;
0 to 5% iron;
greater than 0 to 2% manganese;
0 to 2% vanadium;
0 to 2% copper;
greater than 0 to 0.5% silicon;
0 to 1% zirconium;
0 to 1% hafnium;
0 to 1% rhenium;
a total of 0 to 1% of rare earth elements;
nickel; and
impurities.

6. The nickel-base alloy of claim 1, comprising, in weight percentages based on total weight of the nickel-base alloy:
1.6% to 2.5% aluminum;
0.5% to 1.3% titanium;
2.2% to 3% tantalum;
18% to 21% chromium;
7% to 15% cobalt;
greater than 6% to 9.5% molybdenum;
greater than 0 to less than 0.5% tungsten;
0 to less than 0.5% niobium;
greater than 0 to 2% manganese;
greater than 0 to 0.5% silicon;
0 to 0.2% carbon;
0 to 0.05% boron;
0 to 3% iron;
0 to 2% manganese;
0 to 2% vanadium;
0 to 2% copper;
0 to 1% silicon;
0 to 1% zirconium;
0 to 1% hafnium;
0 to 1% rhenium;
a total of 0 to 1% of rare earth elements;
nickel; and
impurities.

7. The nickel-base alloy of claim 1, comprising, in weight percentages based on total weight of the nickel-base alloy:
1.7% to 2.4% aluminum;
0.5% to 1.3% titanium;
2.2% to 2.9% tantalum;
18% to 21% chromium;
7% to 15% cobalt;

greater than 6% to 9.5% molybdenum;
greater than 0 to less than 0.5% tungsten;
0 to less than 0.5% niobium;
greater than 0 to 2% manganese;
greater than 0 to 0.5% silicon;
0 to 0.05% boron;
nickel; and
impurities.

8. The nickel-base alloy of claim 1, comprising, in weight percentages based on total weight of the nickel-base alloy:
1.7% to 2.4% aluminum;
0.5% to 1.3% titanium;
2.2% to 2.9% tantalum;
18% to 21% chromium;
7% to 15% cobalt;
greater than 6% to 9.5% molybdenum;
greater than 0 to less than 0.5% tungsten;
0 to less than 0.5% niobium;
0 to 0.2% carbon;
0 to 0.05% boron;
0 to 1.5% iron;
greater than 0 to 2% manganese;
0 to 2% vanadium;
0 to 2% copper;
greater than 0 to 0.5% silicon;
0 to 1% zirconium;
0 to 1% hafnium;
0 to 1% rhenium;
a total of 0 to 1% of rare earth elements;
nickel; and
impurities.

9. The nickel-base alloy of claim 1, provided that a composition of the nickel-base alloy satisfies the following equation, in weight percentage concentrations based on total weight of the nickel-base alloy:

$$2.5<\{[Al]+0.56\times[Ti]+0.29\times[Nb]+0.15\times[Ta]\}<3.4.$$

10. The nickel-base alloy of claim 1, provided that a composition of the nickel-base alloy satisfies the following equation, in weight percentage concentrations based on total weight of the nickel-base alloy:

$$5\%<\{[Mo]+0.52\times[W]\}<10\%.$$

11. The nickel-base alloy of claim 1, provided that a composition of the nickel-base alloy satisfies the following equation, in weight percentage concentrations based on total weight of the nickel-base alloy:

$$0.8\%\leq\{[Nb]+0.51\times[Ta]\}\leq2.4\%.$$

12. The nickel-base alloy of claim 1, wherein the nickel-base alloy exhibits a stress rupture life greater than 180 hours when tested at 1500° F. (816° C.) under stress of 35 ksi (241.3 MPa).

13. A nickel-base alloy comprising, in weight percentages based on total weight of the nickel-base alloy:
1.6% to 2.5% aluminum;
0.5% to 1.3% titanium;
2.2% to 4% tantalum;
18% to 21% chromium;
7% to 15% cobalt;
greater than 6% to 9.5% molybdenum;
greater than 0 to less than 0.5% tungsten;
0 to less than 0.5% niobium;
0 to 0.5% carbon;
0 to 0.05% boron;
0 to 5% iron;
greater than 0 to 2% manganese;
0 to 2% vanadium;
0 to 2% copper;
greater than 0 to 0.5% silicon;
0 to 1% zirconium;
0 to 1% hafnium;
0 to 1% rhenium;
a total of 0 to 1% of rare earth elements; and
nickel;
wherein the nickel-base alloy exhibits a stress rupture life greater than 140 hours when tested at 1500° F. (816° C.) under stress of 35 ksi (241.3 MPa);
provided that a composition of the nickel-base alloy satisfies the following equations:

$$2.5<\{[Al]+0.56\times[Ti]+0.29\times[Nb]+0.15\times[Ta]\}<3.4$$

$$5<\{[Mo]+0.52\times[W]\}<10$$

$$0.8\leq\{[Nb]+0.51\times[Ta]\}\leq2.4.$$

14. The nickel-base alloy of claim 13 comprising, in weight percentages based on total weight of the nickel-base alloy:
1.7% to 2.4% aluminum;
0.5% to 1.3% titanium;
2.2% to 2.9% tantalum;
18% to 21% chromium;
7% to 15% cobalt;
greater than 6% to 9.5% molybdenum;
greater than 0 to less than 0.5% tungsten;
0 to less than 0.5% niobium;
0 to 0.2% carbon;
0 to 0.05% boron;
0 to 1.5% iron;
greater than 0 to 2% manganese;
0 to 2% vanadium;
0 to 2% copper;
greater than 0 to 0.5% silicon;
0 to 1% zirconium;
0 to 1% hafnium;
0 to 1% rhenium;
a total of 0 to 1% of rare earth elements; and
nickel.

15. The nickel-base alloy of claim 14, provided that a composition of the nickel-base alloy satisfies the following:

$$2.6<\{[Al]+0.56\times[Ti]+0.29\times[Nb]+0.15\times[Ta]\}<3.3$$

$$6<\{[Mo]+0.52\times[W]\}<10$$

$$0.8\leq\{[Nb]+0.51\times[Ta]\}\leq1.7.$$

16. The nickel-base alloy of claim 13, wherein the nickel-base alloy exhibits a stress rupture life greater than 180 hours when tested at 1500° F. (816° C.) under stress of 35 ksi (241.3 MPa).

17. A nickel-base alloy consisting of, in weight percentages based on total weight of the nickel-base alloy:
1.6% to 2.5% aluminum;
0.5% to 1.3% titanium;
2.2% to 4% tantalum;
18% to 21% chromium;
7% to 15% cobalt;
greater than 6% to 9.5% molybdenum;
greater than 0 to less than 0.5% tungsten;
0 to less than 0.5% niobium;
0 to 0.5% carbon;
0 to 0.05% boron;
0 to 5% iron;

greater than 0 to 2% manganese;
0 to 2% vanadium;
0 to 2% copper;
greater than 0 to 0.5% silicon;
0 to 1% zirconium;
0 to 1% hafnium;
0 to 1% rhenium;
a total of 0 to 1% of rare earth elements;
nickel; and
impurities;
wherein the nickel-base alloy exhibits a stress rupture life greater than 140 hours when tested at 1500° F. (816° C.) under stress of 35 ksi (241.3 MPa).

18. The nickel-base alloy of claim 17, provided that a composition of the nickel-base alloy satisfies the following:

$$2.5<\{[Al]+0.56\times[Ti]+0.29\times[Nb]+0.15\times[Ta]\}<3.4$$

$$5<\{[Mo]+0.52\times[W]\}<10$$

$$0.8\leq\{[Nb]+0.51\times[Ta]\}\leq2.4.$$

19. The nickel-base alloy of claim 17, wherein a tantalum content is 2.2% to 3%, in weight percentages based on total weight of the nickel-base alloy.

20. The nickel-base alloy of claim 17, consisting of, in weight percentages based on total weight of the nickel-base alloy:
1.6% to 2.5% aluminum;
0.5% to 1.3% titanium;
2.2% to 3% tantalum;
18% to 21% chromium;
7% to 15% cobalt;
greater than 6% to 9.5% molybdenum;
greater than 0 to less than 0.5% tungsten;
0 to less than 0.5% niobium;
0 to 0.2% carbon;
0 to 0.05% boron;
0 to 3% iron;
greater than 0 to 2% manganese;
0 to 2% vanadium;
0 to 2% copper;
greater than 0 to 0.5% silicon;
0 to 1% zirconium;
0 to 1% hafnium;
0 to 1% rhenium;
a total of 0 to 1% of rare earth elements;
nickel; and
impurities.

21. The nickel-base alloy of claim 20, provided that a composition of the nickel-base alloy satisfies the following:

$$2.6<\{[Al]+0.56\times[Ti]+0.29\times[Nb]+0.15\times[Ta]\}<3.3$$

$$6<\{[Mo]+0.52\times[W]\}<10$$

$$0.8\leq\{[Nb]+0.51\times[Ta]\}\leq1.7.$$

22. The nickel-base alloy of claim 17, consisting of, in weight percentages based on total weight of the nickel-base alloy:
1.7% to 2.4% aluminum;
0.5% to 1.3% titanium;
2.2% to 2.9% tantalum;
18% to 21% chromium;
7% to 15% cobalt;
greater than 6% to 9.5% molybdenum;
greater than 0 to less than 0.5% tungsten;
0 to less than 0.5% niobium;
0 to 0.2% carbon;
0 to 0.05% boron;
0 to 1.5% iron;
greater than 0 to 2% manganese;
0 to 2% vanadium;
0 to 2% copper;
greater than 0 to 0.5% silicon;
0 to 1% zirconium;
0 to 1% hafnium;
0 to 1% rhenium;
a total of 0 to 1% of rare earth elements;
nickel; and
impurities.

23. The nickel-base alloy of claim 22, provided that a composition of the nickel-base alloy satisfies the following:

$$2.7<\{[Al]+0.56\times[Ti]+0.29\times[Nb]+0.15\times[Ta]\}<3.3$$

$$6<\{[Mo]+0.52\times[W]\}<9.5$$

$$0.8\leq\{[Nb]+0.51\times[Ta]\}\leq1.5.$$

24. The nickel-base alloy of claim 17, wherein the nickel-base alloy exhibits a stress rupture life greater than 180 hours when tested at 1500° F. (816° C.) under stress of 35 ksi (241.3 MPa).

25. An article of manufacture comprising a nickel-base alloy comprising:
1.6% to 2.5% aluminum;
0.5% to 1.3% titanium;
2.2% to 4% tantalum;
18% to 21% chromium;
7% to 15% cobalt;
greater than 6% to 9.5% molybdenum;
0 to less than 0.5% niobium;
greater than 0 to 2% manganese;
greater than 0 to 0.5% silicon;
greater than 0 to less than 0.5% tungsten;
0 to 0.05% boron;
nickel; and
impurities;
wherein the nickel-base alloy exhibits a stress rupture life greater than 140 hours when tested at 1500° F. (816° C.) under stress of 35 ksi (241.3 MPa).

26. The article of manufacture of claim 25, selected from the group consisting of foil, a sheet, a plate, a wire, a billet, a slab, a casting, a powder, a heat exchanger, a gas turbine transition duct, and an additively manufactured part.

27. The article of manufacture of claim 25, wherein the nickel-base alloy exhibits a stress rupture life greater than 180 hours when tested at 1500° F. (816° C.) under stress of 35 ksi (241.3 MPa).

* * * * *